US005227975A

United States Patent [19]

Nakaniwa

[11] Patent Number: 5,227,975

[45] Date of Patent: Jul. 13, 1993

[54] AIR/FUEL RATIO FEEDBACK CONTROL SYSTEM FOR INTERNAL COMBUSTION ENGINE

[75] Inventor: Shinpei Nakaniwa, Gunma, Japan

[73] Assignee: Japan Electronic Control Systems Co., Ltd., Isezaki, Japan

[21] Appl. No.: 599,223

[22] Filed: Oct. 18, 1990

[30] Foreign Application Priority Data

Oct. 18, 1989 [JP] Japan ..... 1-269207

[51] Int. Cl.[5] ..... F02D 45/00

[52] U.S. Cl. ..... 364/431.05; 123/693; 123/696

[58] Field of Search ..... 364/431.05, 431.06, 364/431.01, 431.04; 123/440, 489, 672, 674, 693, 696, 703

[56] References Cited

U.S. PATENT DOCUMENTS

| | | | |
|---|---|---|---|
| 4,029,061 | 6/1977 | Asano | 123/32 |
| 4,174,680 | 11/1979 | Anzai | 123/32 |
| 4,534,330 | 8/1985 | Osuga et al. | 123/440 |
| 4,671,244 | 6/1987 | Clement et al. | 123/489 |
| 4,853,862 | 8/1989 | Shiraishi et al. | 364/431.05 |

FOREIGN PATENT DOCUMENTS

| | | |
|---|---|---|
| 0157004 | 10/1985 | European Pat. Off. . |
| 0277826 | 8/1988 | European Pat. Off. . |
| 58-53661 | 3/1983 | Japan . |
| 60-240840 | 11/1985 | Japan . |
| 63-51273 | 4/1988 | Japan . |

*Primary Examiner*—Parshotam S. Lall
*Assistant Examiner*—E. J. Pipala
*Attorney, Agent, or Firm*—Foley & Lardner

[57] ABSTRACT

An air/fuel ratio feedback control system for an internal combustion engine sets an air/fuel ratio feedback correction coefficient on the basis of an air/fuel ratio for an air/fuel mixture introduced into a combustion chamber of the engine, to cause the air/fuel ratio to approach a set point thereof. The correction coefficient consists of a rich control proportional component $P_R$, a lean control proportional component $P_L$ and an integral component I. When the air/fuel ratio set by the feedback control system deviates from an initial set point (the stoichiometric value) due to deterioration of an oxygen sensor for detecting the air/fuel ratio, the feedback control system compensates for the deviation to cause the air/fuel ratio to approach the initial set point, by varying a ratio of the rich control proportional component $P_R$ to the lean control proportional component $P_L$ in accordance with magnitudes of rich and lean detection levels, or by correcting a balance between the rich and lean control proportional components $P_R$ and $P_L$ on the basis of a relationship between signal level varying speeds of the proportional components $P_R$ and $P_L$, a relationship between rich and lean control times, a relationship between rich and lean detection levels or the like.

12 Claims, 24 Drawing Sheets

AIR/FUEL RATIO FEEDBACK CONTROL SYSTEM FOR INTERNAL COMBUSTION ENGINE

BACKGROUND OF THE INVENTION

1. Field of the Invention

The present invention relates generally to an air/fuel ratio feedback control system for an internal combustion engine. More specifically, the invention relates to an air/fuel ratio feedback control system for performing λ control of feedback control in order to maintain the air/fuel ratio close to a stoichiometric value.

2. Description of The Background Art

In recent years, various types of fuel injection control systems for internal combustion engines, which can perform air/fuel ratio feedback control for an air/fuel mixture to be introduced into the engine combustion chamber, have been proposed. One such system is disclosed in Japanese Patent First (unexamined) Publication (Tokkai Sho.) No. 60-240840. The disclosed system detects an intake air flow rate Q, an intake pressure PB and so forth as quantities measuring the state of intake air, to derive a basic fuel injection amount Tp on the basis of these quantities and an engine revolution speed N. The basic fuel injection amount Tp is modified to derive a fuel injection amount Ti by utilizing various correction coefficients COEF, LAMBDA and Ts in accordance with the following formula.

$$Ti = Tp \times COEF \times LAMBDA + Ts$$

The COEF is a combined correction coefficient derived on the basis of various kinds of engine running states, such as an engine coolant temperature and so forth. The LAMBDA is an air/fuel ratio feedback correction coefficient set on the basis of an air/fuel ratio of an air/fuel mixture, which is derived from oxygen concentration contained in exhaust gas. The correction coefficient Ts is a correction value for compensating for battery voltage. Fuel, of an amount corresponding to the modified fuel injection amount Ti, is introduced into the engine combustion chamber by means of an electromagnetic fuel injection valve and so forth.

The air/fuel ratio feedback correction coefficient LAMBDA is generally derived through a PI (proportional-integral) control process. The correction coefficient LAMBDA consists of a rich control proportional component $P_R$ which is used when the air/fuel ratio varies from rich to lean across a stoichiometric value, a lean control proportional component $P_L$ which is used when the air/fuel ratio varies from lean to rich across the stoichiometric value, a rich control integral component $I_R$ which is used while the air/fuel mixture is held lean, and a lean control integral component $I_L$ which is used while the air/fuel mixture is held rich. The integral components are derived by integrating an integral constant over a period while the air/fuel mixture is maintained rich or lean. In the practical process, the correction coefficient LAMBDA is derived on the basis of the deviation of the air/fuel ratio from the stoichiometric value. The air/fuel ratio is derived on the basis of the means of an oxygen ($O_2$) sensor.

When the air/fuel ratio is richer than the stoichiometric value, the correction coefficient LAMBDA is decreased by the lean control proportional component $P_L$, and then it is gradually decreased in accordance with the lean control integral component $I_L$ so as to prevent the air/fuel ratio from rapidly decreasing. Thereafter, when the air/fuel ratio varies from rich to lean across the stoichiometric value, the correction coefficient LAMBDA is increased by the rich control proportional component $P_R$, and then it is gradually increased in accordance with the rich control integral component $I_R$ so as to prevent the air/fuel ratio from being rapidly increased. Such processes are repeatedly performed, to cause the air/fuel ratio to approach the stoichiometric value.

As the oxygen sensors for the air/fuel ratio feedback control, sensors can be generally used which detect whether the air/fuel ratio is held rich or lean relative to the stoichiometric value by utilizing the fact in that the oxygen concentration in the exhaust gas rapidly varies at the stoichiometric value. One of such sensors is disclosed in Japanese Utility-Model First (unexamined) Publication (Jikkai Sho.) No. 63-51273. The disclosed sensor is formed with electrodes on inner and outer surfaces of a zirconia tube, and it monitors electromotive force produced between the electrodes in accordance with a ratio of oxygen concentration in the atmospheric air introduced into the interior of the tube to that in the exhaust gas to which the outer surface of the tube is exposed, to indirectly detect whether the air/fuel ratio for the air/fuel mixture introduced into the engine is held rich or lean relative to the stoichiometric value.

In a case where such an oxygen sensor is used for the air/fuel ratio feedback control, if the oxygen sensor deteriorates. The output characteristic of the detection signal relative to the air/fuel ratio varies from the output characteristic of the initial oxygen sensor when it is initially used, as shown in FIGS. 1 to 4, so that the air/fuel ratio can not be controlled to approach near the stoichiometric value by the feedback control.

Some exhaust systems for automotive engines are provided with a catalytic converter rhodium (CCRO) system which converts harmful gas components, such as carbon monoxide (CO), hydrocarbon (HC) and nitrogen oxides (NOx), in the exhaust gas into harmless components, such as carbon dioxide ($CO_2$), aqueous vapor ($H_2O$) and nitrogen ($N_2$) to purify the exhaust gas. Since conversion efficiency by the catalytic converter rhodium system is best when the air/fuel mixture which is burned is such that the air/fuel ratio is the stoichiometric value, if the air/fuel ratio controlled by the feedback control deviates from the stoichiometric valve due to deterioration of the oxygen sensor, there is a disadvantage in that the conversion efficiency by the catalytic converter rhodium system decreases and concentrations of harmful components, such as CO, HC and NOx, in the exhaust gas increase.

Even if there is little variation in the static characteristic of the oxygen sensor, if, for example, response time of the oxygen sensor when the air/fuel ratio varies from rich to lean or lean to rich across a stoichiometric value when the sensor is no longer new, varies from a response time when the oxygen sensor was new, there is also a disadvantage in that the set point of the air/fuel ratio deviates from the initial set point (the stoichiometric value) so that the exhaust gas can not be sufficiently purified by means of the catalytic converter rhodium system.

Variations in output characteristics of oxygen sensors due to deterioration thereof, as shown in FIGS. 1 to 4, are described below, respectively.

FIG. 1 shows a relationship between the output voltage of an oxygen sensor and the air/fuel ratio for the air/fuel mixture in a case where, for example, a well-known zirconia tube type oxygen sensor is used in a condition where a small amount of heat deterioration has occurred in the zirconia, compared to a similar oxygen sensor when new. In this case, the output characteristic of the used oxygen sensor shifts in a rich direction from the characteristic of the new oxygen sensor. In addition, as shown in FIG. 5 and the Table below, the response time of the used oxygen sensor when the air/fuel ratio varies from rich to lean across the stoichiometric value, becomes shorter than the initial response time, i.e. the response time when the sensor is new, so that the control frequency becomes higher than the initial frequency. Therefore, when feedback control is performed by using such a deteriorated (used) oxygen sensor, the air/fuel ratio is so controlled as to approach a richer value than the stoichiometric value.

TABLE

| | OUTPUT Rich | OUTPUT Lean | CONTROL FREQUENCY | RESPONSE BALANCE (FIG. 5) | A/F RATIO SET POINT |
|---|---|---|---|---|---|
| HEAT DETERIORATION SMALL | — | — | HIGH | A, b | RICH |
| INSIDE DETERIORATION | LOW | LOW | — | A, a | RICH |
| OUTSIDE BLINDING | — | HIGH | LOW | A c or d | LEAN |
| HEAT DETERIORATION LARGE | LOW | — | LOW | B or C a | RICH |

In addition, as shown in FIG. 2, when such heat deterioration becomes great (for example, after the sensor has seen considerable use), the output (the maximum voltage) while the air/fuel mixture is held rich, is decreased, as a result, the control frequency of the oxygen sensor becomes lower than the initial control frequency, and the response speed becomes low and a normal output characteristic of oxygen sensor, such that the output thereof rapidly varies at the stoichiometric value of the air/fuel ratio, cannot be obtained.

As mentioned above, in a case where a zirconia tube type oxygen sensor is used, atmospheric air is introduced into the interior of the zirconia tube, and an electromotive force is produced between the electrodes formed on inner and outer surfaces in accordance with a ratio of the oxygen concentration in the atmosphere to that in the exhaust gas. Therefore, if the electrode formed on the inner surface deteriorates or if blinding is produced in a layer which inhibits the zirconia tube from directly sensing the exhaust gas, the output characteristic of the oxygen sensor varies as shown in FIGS. 3 and 4.

That is, when the inner electrode deteriorates, outputs of the oxygen sensor on both of the rich and lean sides (the maximum and minimum output voltages) are decreased since the electromotive force can be not sufficiently sensed. As a result, the set point to which the air/fuel ratio is controlled to approach by the feedback control, moves toward a richer value than the stoichiometric value. On the other hand, when blinding is produced on the outer protective layer, the output of the oxygen sensor on the lean side (the minimum output voltage) becomes high, since the ratio of oxygen concentration in the exhaust gas outside of the tube to that in the atmospheric air introduced into the tube can not increase while the air/fuel ratio is held lean. As a result, the response characteristic of the oxygen sensor when the air/fuel ratio varies from rich to lean across the stoichiometric value, becomes poor, so that the set point of the air/fuel ratio moves toward a leaner value than the stoichiometric value.

SUMMARY OF THE INVENTION

It is therefore a principal object of the present invention to provide an air/fuel ratio feedback control system which, when an air/fuel ratio controlled by the feedback control system deviates from the initial set point (the stoichiometric value: $\lambda=1$) due to deterioration of an oxygen sensor for detecting an air/fuel ratio for an air/fuel mixture introduced into an internal combustion engine, can compensate for the deviation to cause the air/fuel ratio to approach the initial set point.

In order to accomplish the aforementioned and other objects, an air/fuel ratio feedback control system for an internal combustion engine, according to the present invention, includes setting means for setting an air/fuel ratio feedback correction coefficient on the basis of an air/fuel ratio for an air/fuel mixture introduced into a combustion chamber of the engine, to cause the air/fuel ratio to approach a set point thereof, and correcting means for compensating for deviation of the set point from the initial set point (the stoichiometric value) by varying a ratio of a rich control proportional component $P_R$ and a lean control proportional component $P_L$ of the air/fuel ratio feedback correction coefficient in accordance with magnitudes of the rich and lean detection levels, or by varying a balance between the rich and lean control proportional components $P_R$ and $P_L$ on the basis of at least one relationship between signal level varying speeds of the proportional components $P_R$ and $P_L$, between rich and lean control times, between rich and lean detection levels and so forth.

According to one aspect of the present invention, an air/fuel ratio feedback control system for an internal combustion engine comprises: air/fuel ratio detecting means for monitoring an air/fuel ratio for an air/fuel mixture to be introduced into a combustion chamber of the engine, to produce a detection signal representative of the air/fuel ratio, the detection level of the detection signal varying in accordance with the air/fuel ratio to a rich detection level when the air/fuel ratio is held richer than a set point of the air/fuel ratio, and a lean detection level when the air/fuel ratio is held leaner than the set point; correction value setting means for setting a correction value which is used for causing the air/fuel ratio to approach the set point, the correction value including an increasing component used for causing the air/fuel ratio to become richer and a decreasing component used for causing the air/fuel ratio to become leaner; fuel injection amount control means for controlling amount of fuel to be introduced into the combustion chamber on the basis of the correction value; signal level determining means for receiving the detection signal to determine magnitudes of the rich and lean detection levels, to produce a rich detection level indicative signal and a lean detection level indicative signal; and correction value varying means for varying a ratio of the increasing component to the decreasing component of the correction value in accordance with the magnitudes of the rich and lean detection level indicative signals.

According to another aspect of the present invention, an air/fuel ratio feedback control system for an internal combustion engine comprises: air/fuel ratio detecting means for monitoring an air/fuel ratio for an air/fuel mixture to be introduced into a combustion chamber of the engine, to produce a detection signal representative of the air/fuel ratio, the detection level of the detection signal varying in accordance with the air/fuel ratio to a rich detection level when the air/fuel ratio is held richer than a set point of the air/fuel ratio, and a lean detection level when the air/fuel ratio is held leaner than the set point; correction value setting means for setting a correction value which is used for causing the air/fuel ratio to approach the set point, the correction value including an increasing component used for causing the air/fuel ratio to be rich and a decreasing component used for causing the air/fuel ratio to be lean; fuel injection amount control means for controlling the amount of fuel to be introduced into the combustion chamber on the basis of the correction value; signal level varying speed measuring means for receiving the detection signal to determine a signal level increasing speed of the detection signal which is an increase amount per unit time of the detection signal, and a signal level decreasing speed of the detection signal which is decrease amount per unit time of the detection signal, to produce a signal level increasing speed indicative signal and a signal level decreasing speed indicative signal; increasing/decreasing time measuring means for receiving the detection signal to determine an increasing time which is an elapsed time until the air/fuel ratio begins to approach the set point after the air/fuel ratio varies from lean to rich, and a decreasing time which is an elapsed time until the air/fuel ratio begins to approach the set point after the air/fuel ratio varies from rich to lean, to produce an increasing time indicative signal and a decreasing time indicative signal; rich/lean control time measuring means for receiving the detection signal to determine a rich control time which is an elapsed time while the air/fuel ratio varies in a rich direction, and a lean control time which is an elapsed time while the air/fuel ratio varies in a lean direction, to produce a rich control time indicative signal and a lean control time indicative signal; rich/lean detection signal level determining means for receiving the detection signal to determine magnitudes of the rich and lean detection levels, to produce a rich detection level indicative signal and a lean detection level indicative signal; and balance correcting means for correcting a balance between the increasing and the decreasing components of the correction value on the basis of at least one of the relationships between the signal level increasing and decreasing speed indicative signals, between the increasing and decreasing time indicative signals, between the rich and lean control time indicative signals, and between the rich and lean detection level indicative signals.

According to a further aspect of the present invention, an air/fuel ratio feedback control system for an internal combustion engine comprises: air/fuel ratio detecting means for monitoring an air/fuel ratio for an air/fuel mixture to be introduced into a combustion chamber of the engine, to produce a detection signal representative of the air/fuel ratio, the detection level of the detection signal varying in accordance with the air/fuel ratio to a rich detection level when the air/fuel ratio is held richer than a set point of the air/fuel ratio, and a lean detection level when the air/fuel ratio is held leaner than the set point; correction value setting means for setting a correction value which is used for causing the air/fuel ratio to approach the set point, the correction value including an increasing component used for causing the air/fuel ratio to become richer and a decreasing component used for causing the air/fuel ratio to become leaner; fuel injection amount control means for controlling an amount of fuel to be introduced into the combustion chamber on the basis of the correction value; signal level varying speed measuring means for receiving the detection signal to determine a signal level increasing speed of the detection signal which is an increase amount per unit time of the detection signal, and a signal level decreasing speed of the detection signal which is an decrease amount per unit time of the detection signal, to produce a signal level increasing speed indicative signal and a signal level decreasing speed indicative signal; and balance correcting means for correcting a balance between the increasing and the decreasing components of the correction value on the basis of a relationship between the signal level increasing and decreasing speed indicative signals.

In a still further aspect of the present invention an air/fuel ratio feedback control system for an internal combustion engine comprises: air/fuel ratio detecting means for monitoring an air/fuel ratio for an air/fuel mixture to be introduced into a combustion chamber of the engine, to produce a detection signal representative of the air/fuel ratio, the detection level of the detection signal varying in accordance with the air/fuel ratio to a rich detection level when the air/fuel ratio is held richer than a set point of the air/fuel ratio, and a lean detection level when the air/fuel ratio is held leaner than the set point; correction value setting means for setting a correction value which is used for causing the air/fuel ratio to approach the set point, the correction value including an increasing component used for causing the air/fuel ratio to be rich and a decreasing component used for causing the air/fuel ratio to be lean; fuel injection amount control means for controlling the amount of fuel to be introduced into the combustion chamber on the basis of the correction value; increasing/decreasing time measuring means for receiving the detection signal to determine an increasing time which is an elapsed time until the air/fuel ratio begins to approach the set point after the air/fuel ratio varies from lean to rich, and a decreasing time which is an elapsed time until the air/fuel ratio begins to approach the set point after the air/fuel ratio varies from rich to lean, to produce an increasing time indicative signal and a decreasing time indicative signal; and balance correcting means for correcting a balance between the increasing and the decreasing components of the correction value on the basis of a relationship between the increasing and decreasing time indicative signals.

Also, according to the principles of the present invention an air/fuel ratio feedback control system for an internal combustion engine may comprise: air/fuel ratio detecting means for monitoring an air/fuel ratio for an air/fuel mixture to be introduced into a combustion chamber of the engine, to produce a detection signal representative of the air/fuel ratio, the detection level of the detection signal varying in accordance with the air/fuel ratio to a rich detection level when the air/fuel ratio is held richer than a set point of the air/fuel ratio, and a lean detection level when the air/fuel ratio is held leaner than the set point; correction value setting means for setting a correction value which is used for causing the air/fuel ratio to approach the set point, the correction value including an increasing component used for causing the air/fuel ratio to be rich and a decreasing component used for causing the air/fuel ratio to be lean; fuel injection amount control means for controlling the amount of fuel to be introduced into the combustion chamber on the basis of the correction value; rich/lean control time measuring means for receiving the detection signal to determine a rich control time which is an elapsed time while the air/fuel ratio varies in a rich direction, and a lean control time which is an elapsed time while the air/fuel ratio varies in a lean direction, to produce a rich control time indicative signal and a lean control time indicative signal; and balance correcting means for correcting a balance between the increasing and the decreasing components of the correction value on the basis of a relationship between the rich and lean control time indicative signals.

Finally, according to the present invention an air/fuel ratio feedback control system for an internal combustion engine may comprise: air/fuel ratio detecting means for monitoring an air/fuel ratio for an air/fuel mixture to be introduced into a combustion chamber of the engine, to produce a detection signal representative of the air/fuel ratio, the detection level of the detection signal varying in accordance with the air/fuel ratio to a rich detection level when the air/fuel ratio is held richer than a set point of the air/fuel ratio, and to a lean detection level when the air/fuel ratio is held leaner than a set point; correction value setting means for setting a correction value which is used for causing the air/fuel ratio to approach the set point, the correction value including an increasing component used for causing the air/fuel ratio to become richer and a decreasing component used for causing the air/fuel ratio to become leaner; fuel injection amount control means for controlling the amount of fuel to be introduced into the combustion chamber on the basis of the correction value; rich/lean detection signal level determining means for receiving the detection signal to determine magnitudes of the rich and lean detection levels, to produce a rich detection level indicative signal and a lean detection level indicative signal; and balance correcting means for correcting a balance between the increasing and the decreasing components of the correction value on the basis of a relationship between the rich and lean detection level indicative signals.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings:

FIG. 11 is a flow chart of a program for initializing various parameters, which is executed at a timing when an ignition switch becomes ON:

FIG. 12(*b*) is a flow chart of a program for correcting the slice level SL of the oxygen sensor by using membership characteristic values, for compensating for a variation of the response balance of the oxygen sensor due to deterioration thereof;

FIG. 12(*c*) is a flow chart of a program for setting parameters Slpr and Slpl which respectively define rich and lean control starting timings, by using the membership characteristic values, for compensating for variation of the balance between the rich and lean control times due to deterioration of the oxygen sensor;

DESCRIPTION OF THE PREFERRED EMBODIMENT

Figure 6:
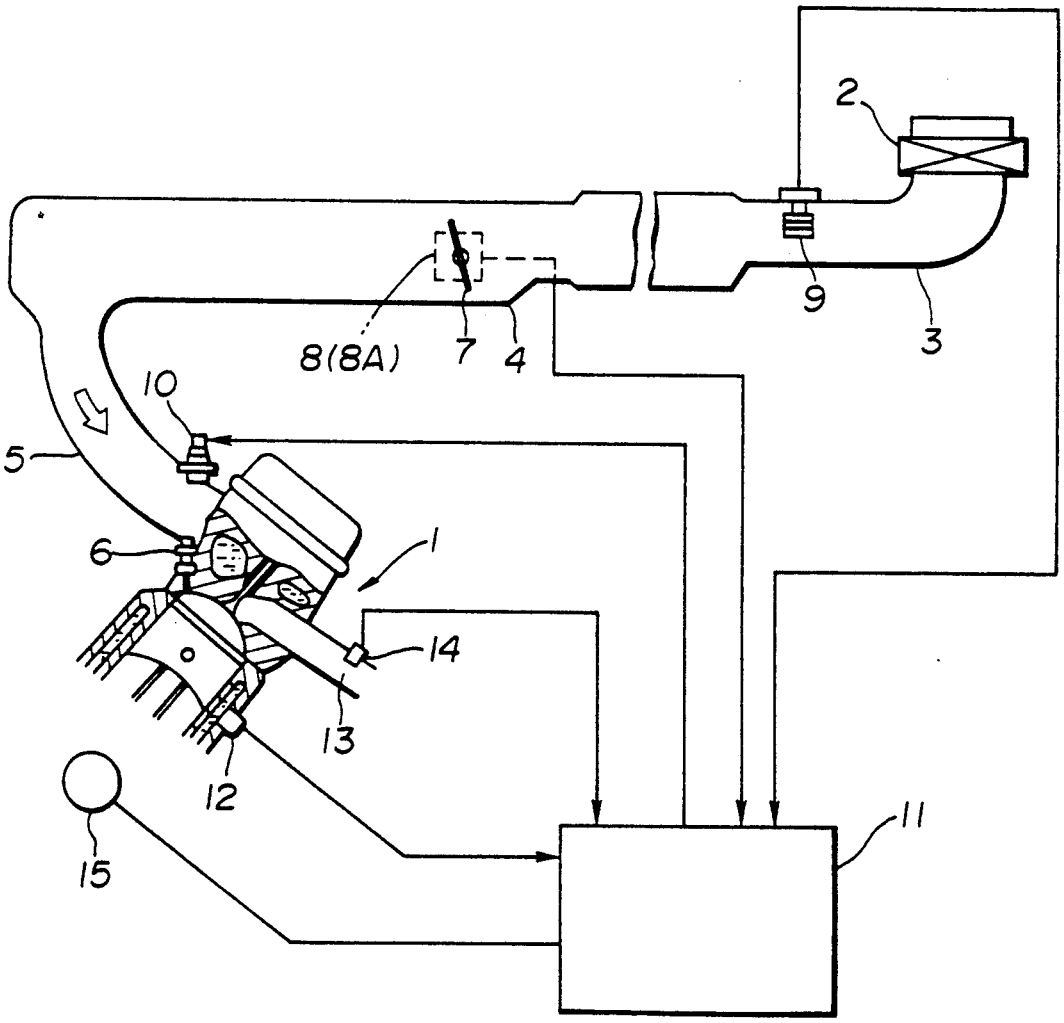
FIG. 6 is a schematic view of a fuel injection system for injecting a controlled amount of fuel to an air induction system of an internal combustion engine, to which an air/fuel ratio feedback control system, according to the present invention, can be applied.

Referring now to the drawings, particularly to FIG. 6, there is schematically shown a fuel injection control system for injecting a controlled amount of fuel to an air induction system of an internal combustion engine. The preferred embodiment of an air/fuel ratio feedback control system, according to the present invention, can be applied to this fuel injection control system.

As is well known, air is introduced into an internal combustion engine 1 through an air cleaner 2, an intake duct 3, a throttle chamber 4 and an intake manifold 5. The throttle chamber 4 houses therein a throttle valve 7 with which an accelerator pedal (not shown) is associated, to vary an open area of the throttle chamber 4 to control an intake air flow rate Q.

The throttle valve 7 is provided with a throttle sensor 8. The throttle sensor 8 has a potentiometer for detecting an opening angle TVO of the throttle valve 7, and an idle switch 8A which is turned ON when the throttle valve is positioned in a fully closed position (idle position).

The intake duct 3 arranged upstream of the throttle valve 7 is provided with an air flow meter 9 which monitors the flow rate Q of intake air introduced into the internal combustion engine 1 to output a voltage signal in accordance with the intake air flow rate Q.

In addition, the respective branching portions of the intake manifold 5 arranged downstream of the throttle valve 7 are provided with electromagnetic fuel injection valves 10 for the respective cylinders. The fuel injection valve 10 is designed to open on the basis of a driving pulse signal output from a control unit 11, housing therein a microcomputer as will be described hereinafter, at a timing derived in synchronism with an engine revolution cycle. Fuel is compressed to be transmitted from a fuel pump (not shown) to the fuel injection valve 10 while the pressure thereof is controlled to be a predetermined value by means of a pressure regulator, so that the pressure-controlled fuel is injected to the intake manifold 5. That is, the amount of fuel injected by the fuel injection valve 10 is controlled on the basis of an opening period of the fuel injection valve 10.

In addition, an engine coolant temperature sensor 12 is disposed within an engine coolant passage or a cooling jacket of the engine 1 for detecting an engine coolant temperature Tw, and an oxygen sensor ($O_2$/S) 14 serving as air/fuel ratio detecting means is provided for indirectly detecting an air/fuel ratio for an air/fuel mixture introduced into the engine combustion chamber by monitoring an oxygen concentration in the exhaust gas passing through an exhaust passage 13 of the engine 1.

A well-known oxygen sensor as disclosed in Japanese Utility-Model First (unexamined) Publication (Jikkai Sho.) No. 63-51273 and so forth, can be used as the oxygen sensor 14. Oxygen sensors of this type are formed with electrodes on inner and outer surfaces of a zirconia tube. Atmospheric air is introduced into the interior of the zirconia tube, and exhaust gas, having a lower concentration of oxygen, is introduced outside of the tube. When a ratio of the oxygen concentration in the inner atmospheric air to that in the outer exhaust gas varies due to variation of the oxygen concentration in the exhaust gas, an electromotive force is produced between the electrodes. That is, when the air/fuel ratio is richer than the stoichiometric value, or when oxygen is insufficient, the oxygen concentration ratio becomes large, so that electromotive force (voltage) $VO_2$ is produced between the electrodes. On the other hand, when the air/fuel ratio is leaner than the stoichiometric value, or when oxygen is excessive, the oxygen concentration ratio becomes small, so that electromotive force $VO_2$ is scarcely produced. In this way, it is determined whether the air/fuel ratio for the air/fuel mixture introduced into the engine combustion chamber is richer or leaner than the stoichiometric value. According to the present invention, other types of sensors, which have a tube made of a material other than zirconia, or which are not of the tube type at all, can also be used.

Furthermore, the respective combustion chambers for the respective cylinders are provided with ignition plugs 6.

A crank angle sensor 15 is provided for monitoring the angular position of a crankshaft to produce a crank reference signal REF at every predetermined angular position, e.g. every 70° BTDC (before top-dead-center) position, of the crankshaft (or at every 180° in the case of 4-cycle engines), and a crank position signal POS at every given angular displacement, e.g. 1°. The crank angle sensor 15 is disposed within an engine accessory, such as a distributor, which rotates synchronously with engine revolution for monitoring the crankshaft angular position.

The control unit 11 receives the crank position signal POS to count the number thereof for a predetermined period of time, or the crank reference signal REF to measure a period thereof, for deriving the engine revolution speed N.

The control unit 11 performs a fuel injection control including an air/fuel ratio feedback control, a malfunction detection for the oxygen sensor 14, and a correction control for compensating the feedback control on the basis of the detected malfunction.

FIGS. 7 to 15 and 19 show flow charts of control processes executed by the control unit 11.

FIGS. 7(*a*) to 7(*d*) collectively show a flow chart of a program for setting an air/fuel ratio feedback correction coefficient LAMBDA (a feedback correction value) by which the air/fuel ratio is so controlled as to approach the set point (the stoichiometric value), through a PI (proportional-integral) control process. This program is executed every 10 ms.

At step 1, various engine running state data, such as the intake air flow rate Q, the engine revolution speed N, the engine coolant temperature Tw and the opening angle TVO of the throttle valve, and the output voltage $VO_2$ of the oxygen sensor 14 are input.

At step 2, on the basis of the intake air flow rate Q and the engine revolution speed N input at step 1, a basic fuel injection amount is derived.

$$Tp (\leftarrow K \times Q/N, K; \text{constant})$$

At step 3, a basic fuel injection criterion Tp corresponding to the engine revolution speed N input at step 1 is selected from a map in which relationships between fuel injection criteria and revolution speed N are stored. The selected basic fuel injection criterion (amount) Tp is set in a register A which will be hereinafter referred to as "reg A". The basic fuel injection criterion Tp set in "reg A" is used for determining whether or not the current running condition belongs to a predetermined high exhaust-temperature region.

At step 4, the basic fuel injection criterion Tp set in "reg A" at step 3 is compared with the basic fuel injection amount Tp derived at step 2, and it is determined whether or not the current running condition belongs to the predetermined high exhaust-temperature region.

When the basic fuel injection amount Tp derived for the current running condition is greater than "reg A", it is determined that the current running condition belongs to the predetermined high exhaust-temperature region, and the routine goes to step 5. At step 5, a flag f is set to be 1, and then the routine goes to step 7. This flag f indicates if the current running condition belongs to the predetermined high exhaust-temperature region. When the current running condition belongs to the predetermined high exhaust-temperature region, the flag f is set to be 1, and when it does not belong to the region, the flag f is set to be 0.

On the other hand, when the basic fuel injection amount Tp derived for the current running condition is less than the basic fuel injection criterion Tp set in "reg A", the running condition does not belong to the predetermined high exhaust-temperature region, and the routine goes to step 6. At step 6, the flag is set to be zero, so that it can be determined that the running condition has not entered the predetermined high exhaust-temperature region.

At next step 7, it is determined whether or not variation ΔTVO per unit time of opening angle TVO of the throttle valve 7 is substantially zero, so that it is determined whether or not the engine 1 operates in a steady running state.

When the variation ΔTVO is not substantially zero, it is determined that the engine 1 operates in a transient running state in which the opening angle TVO of the throttle valve 7 is varying. In this case, the routine goes to step 8 in which a timer value Tmacc, for measuring an elapsed time after the engine running state varies from a steady running state to a transient running state, is set to be a predetermined value, e.g. 300. On the other hand, when the variation ΔTVO is substantially zero, it is determined that the engine 1 operates in a steady running state in which the opening angle TVO of the throttle valve is substantially constant. In this case, the routine goes to step 9 in which it is determined whether or not the aforementioned timer value Tmacc is zero. When it is not zero, the routine goes to step 10 in which the timer value Tmacc is decreased by 1.

Therefore, when the engine 1 operates in the transient running state, the timer value Tmacc is set to a predetermined value. When the opening angle TVO of the throttle valve 7 becomes constant so that the engine running state varies to the steady running state, the timer value Tmacc is decreased by 1 at each execution of the program. When a period of time corresponding to the predetermined timer value elapses after the engine running state becomes steady, the timer value Tmacc becomes zero, so that a sufficiently stable steady running state can be determined.

Thereafter, the routine goes from step 8, 9 or 10 to step 11. At step 11, a rich control proportional component $P_R$, a lean control proportional component $P_L$ and an integral component I of the air/fuel ratio feedback correction coefficient LAMBDA (the initial value = 1.0) used for the PI (proportional-integral) control process are selected from a map in which these components are preset for every engine running condition, classified according to the engine revolution speed N input at step 1 and the basic fuel injection amount Tp derived at step 2. The rich control proportional component $P_R$ is used for performing a proportional control to increase the air/fuel ratio feedback correction coefficient LAMBDA when the air/fuel ratio varies from rich to lean across a stoichiometric value, and the lean control proportional component $P_L$ is used for performing the proportional control to decrease the correction coefficient LAMBDA when the air/fuel ratio varies from lean to rich across the stoichiometric value. In addition, the integral component I is used for performing an integral control to gradually increase the correction coefficient LAMBDA while the air/fuel mixture is held lean, and to gradually decrease the correction coefficient LAMBDA while the air/fuel mixture is held rich. As will be described hereinafter, the integral control of the correction coefficient LAMBDA is performed by integrating a value which is obtained by multiplying a fuel injection amount Ti by the aforementioned integral component I, over a period while the air/fuel mixture is maintained lean or rich.

At step 12, it is determined whether or not a command D for diagnosing deterioration of the oxygen sensor 14 is given. This command D is given in accordance with a flow chart of a program shown in FIG. 15, which will be described hereinafter. In a case where deterioration of the oxygen sensor 14 is diagnosed, the response balance of the oxygen sensor 14 must be detected by performing rich and lean controls of the same proportion, that is, by causing the absolute value of the increased amount of the correction coefficient LAMBDA by the lean control to be equal to that of the decreased amount of the correction coefficient LAMBDA by the rich control. Therefore, when the command D for diagnosing deterioration of the oxygen sensor 14 is given, the routine goes to step 13 in which the rich control proportional component $P_R$ and the lean control proportional component $P_L$ are set to be the same predetermined value (CV) as each other in place of the $P_R$ and $P_L$ selected from the map at step 11.

On the other hand, when it is determined that no command for diagnosing deterioration of the oxygen sensor 14 is given, the rich control proportional component $P_R$ and the lean control proportional component $P_L$ selected from the map are used since oxygen sensor diagnosis has not been required.

Thereafter, the routine goes from step 12 or 13 to step 14 in which an initial condition discriminating flag λconon is determined. The initial requirement discriminating flag λconon is initialized to be set to zero in accordance with a program shown in FIG. 11 when an ignition switch (IG/SW) becomes ON, i.e. when electrical power starts to be supplied to the control unit 11 (see step 163 in FIG. 11), and it is set to be 1 when the initial requirement for starting the air/fuel feedback control is satisfied. Only when the flag λconon is set to be 1, is the air/fuel ratio feedback control performed.

When it is determined that the flag λconon is zero, the initial requirement is not satisfied, i.e. the air/fuel ratio feedback control has not started yet. In this case, the routine goes to step 15 and after, to confirm whether or not the the initial requirement is satisfied.

At step 15, the engine coolant temperature Tw detected by the engine coolant sensor 12 is compared with a predetermined temperature, e.g. 40°. When the engine coolant temperature Tw is less than or equal to the predetermined temperature, the routine ends and the flag λconon remains zero.

On the other hand, when the engine coolant temperature Tw exceeds the predetermined temperature, the routine goes to step 16 and it is determined whether or not the oxygen sensor 14 is in an active state in which the oxygen sensor 14 can output voltage required for detecting the air/fuel ratio for the air/fuel mixture.

At step 16, output voltage $VO_2$ of the oxygen sensor 14 is compared with a predetermined rich-side voltage, e.g. 700 mV, so that it is determined whether or not the output voltage $VO_2$ of the oxygen sensor 14 is sufficient for determining that the air/fuel mixture is held rich. When the output voltage $VO_2$ is greater than or equal to the predetermined rich-side voltage, it is confirmed that the output voltage $VO_2$ is normal at least when the air/fuel mixture is held rich, and it is presumed that the output voltage $VO_2$ is also normal when the air/fuel mixture is held lean. In this case, the routine goes to step 18 in which the flag λconon is set to be 1 so that the setting of the air/fuel ratio feedback correction coefficient LAMBDA can be performed in the next cycle of the routine.

When the output voltage $VO_2$ of the oxygen sensor 14 is less than the predetermined rich-side voltage, the routine goes to step 17. At step 17, the output voltage $VO_2$ of the oxygen sensor 14 is compared with a predetermined lean-side voltage, e.g. 230 mV, so that it is determined whether or not the output voltage $VO_2$ of the oxygen sensor 14 is sufficient for determining that the air/fuel mixture is held lean. When the output voltage $VO_2$ is less than or equal to the predetermined lean-side voltage, it is determined that the oxygen sensor 14 can be used for detecting the air/fuel ratio, and the routine goes to step 18 in which the flag λconon is set to be 1.

On the other hand, when the output voltage $VO_2$ of the oxygen sensor 14 is greater than the predetermined lean-side voltage, i.e. when the output voltage $VO_2$ is near a slice-level voltage, e.g. 500 mV, although the engine coolant temperature Tw is greater than the predetermined temperature, the routine ends while the flag λconon remains zero.

Figure 7A:
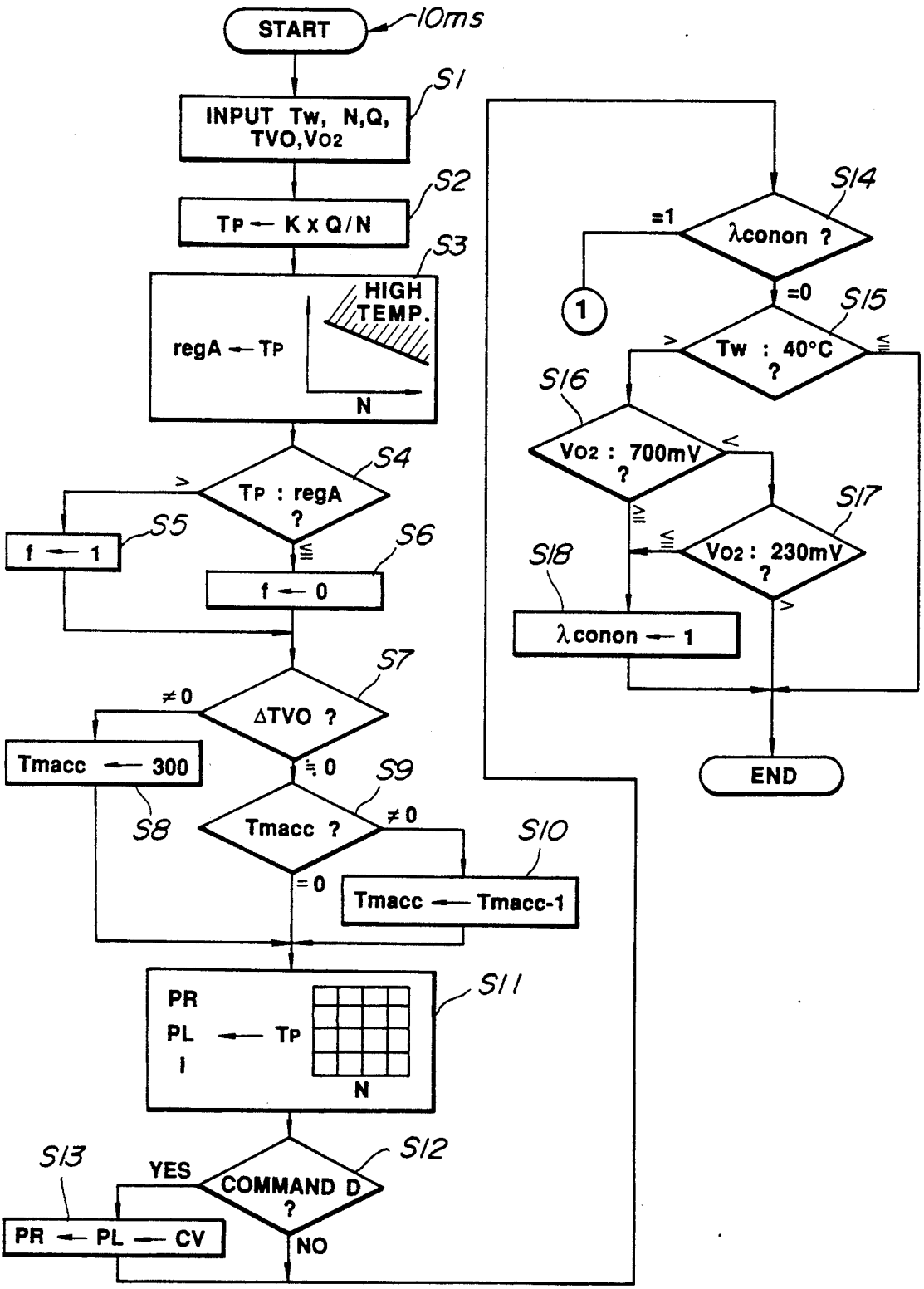
FIGS. 7(*a*) to 7(*d*) collectively show a flow chart of a program for setting an air/fuel ratio feedback correction coefficient LAMBDA through a proportional-integral control process.
Figure 7B:
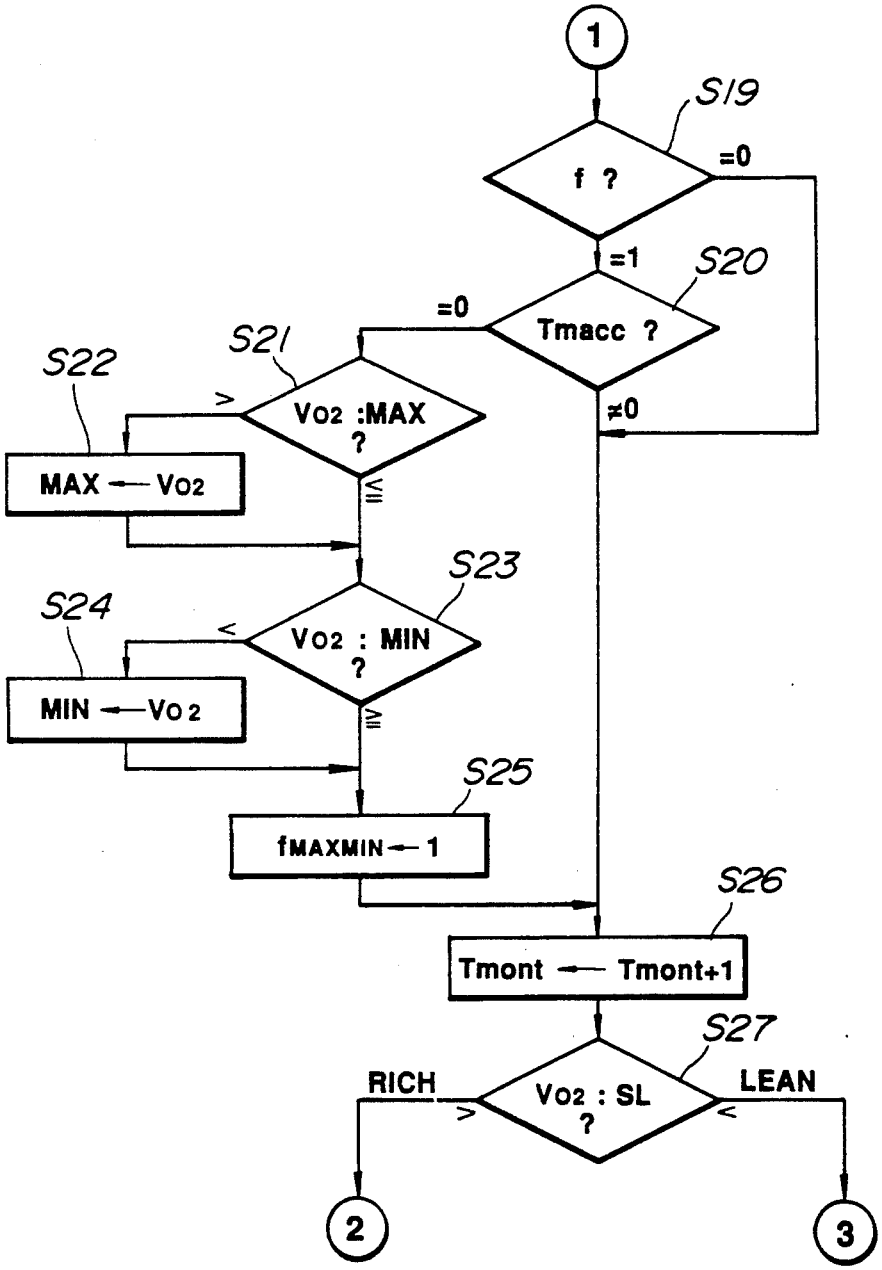
Figure 7C:
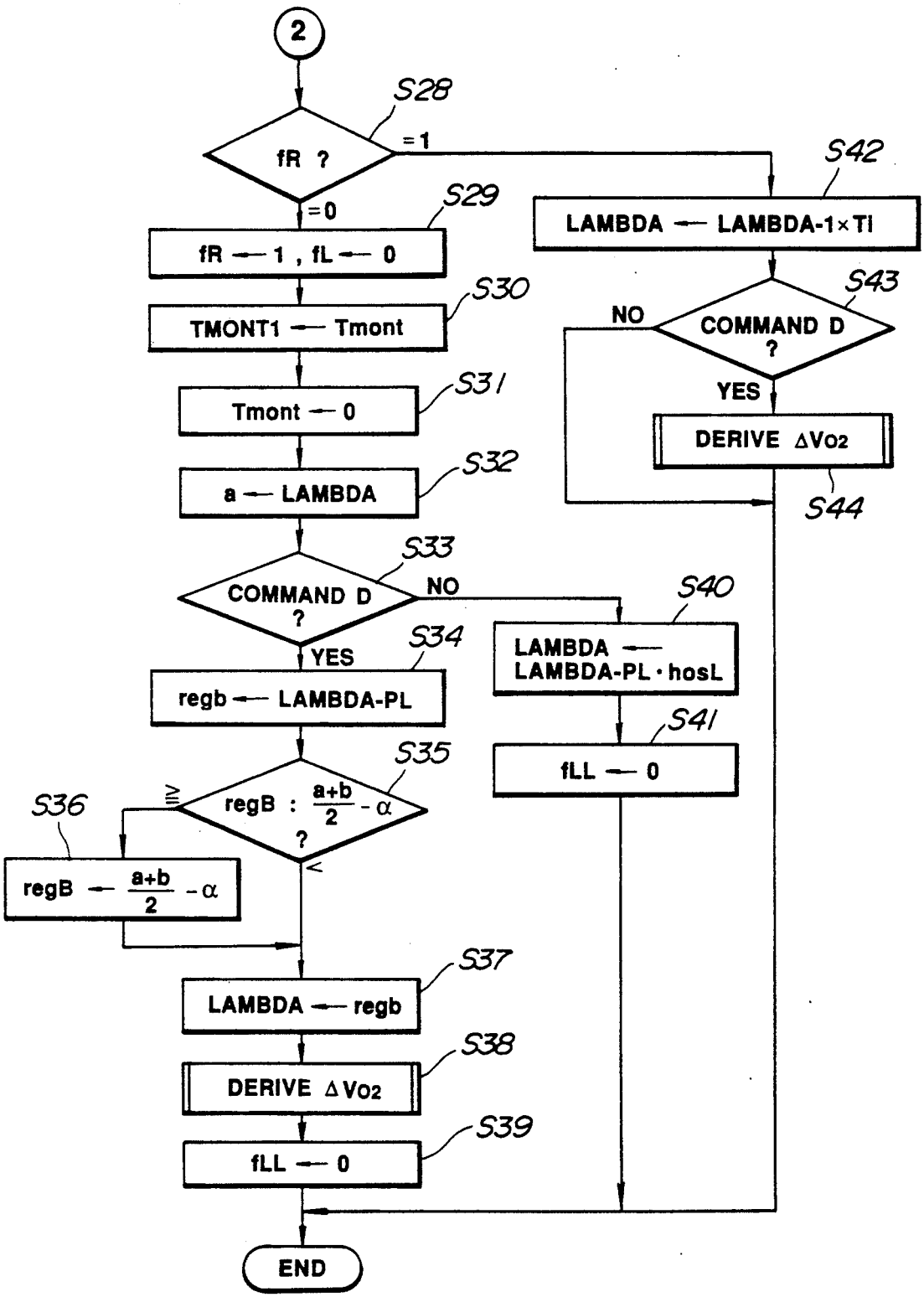
Figure 7D:
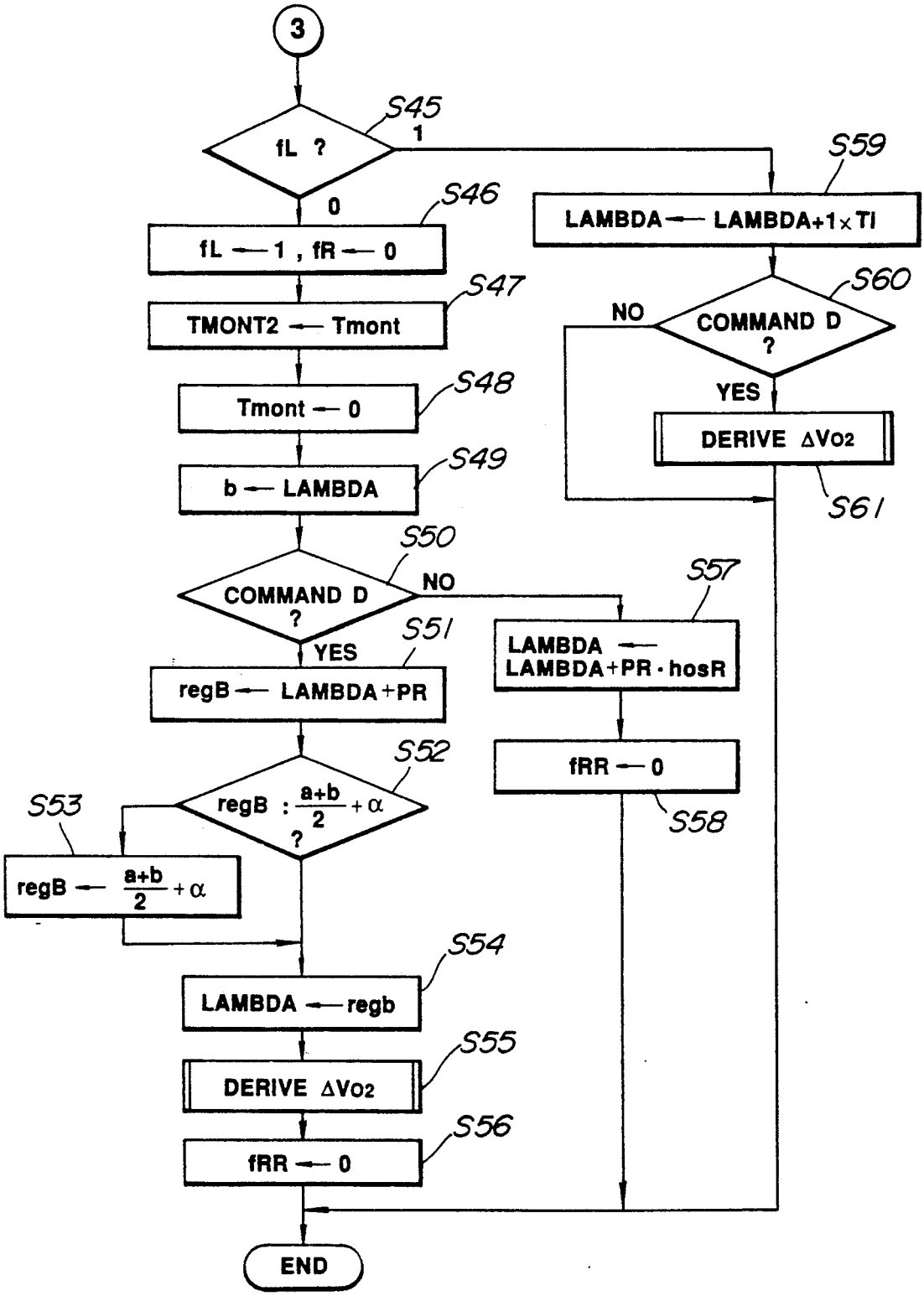

When it is determined that the flag λconon is set to be 1 at step 14, i.e. when it is confirmed that the initial requirement for starting the feedback control is satisfied, the routine goes from step 14 to step 19 (FIG. 7*b*).

At step 19, the value of the flag f for indicating if the current running condition of the engine 1 belongs to the predetermined high exhaust-temperature region, is determined. When the flag f is 1, i.e. when the current running condition belongs to the predetermined high exhaust-temperature region, the routine goes to step 20.

At step 20, it is determined whether or not the timer value Tmacc is zero. When the timer value Tmacc is zero, i.e. when the engine 1 operates in a steady running state, the routine goes to step 21.

At step 21, the current output voltage $VO_2$ of the oxygen sensor 14 is compared with the present maximum output voltage MAX thereof (the detection level on the rich side). When the current output voltage $VO_2$ exceeds the maximum output voltage MAX, the routine goes to step 22 in which the maximum output voltage MAX is updated to be the current output voltage $VO_2$.

Then, the routine goes from step 21 or 22 to step 23. At step 23, the current output voltage $VO_2$ of the oxygen sensor 14 is compared with the present minimum output voltage MIN (the detection level on the lean side). When the current output voltage $VO_2$ is less than the minimum output voltage MIN, the routine goes to step 24 in which the minimum output voltage MIN is updated to be the current output voltage $VO_2$.

Figure 11:
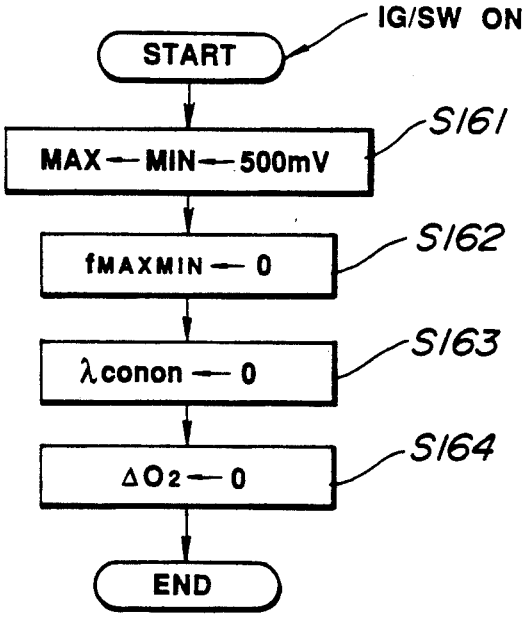

Furthermore, the maximum and minimum output voltages MAX and MIN are set to be a substantially middle value (500 mV) in a range of the output voltage which corresponds to the slice level of the output voltage at a time when the ignition switch becomes ON, in accordance with the program shown in FIG. 11 (see step 161). Therefore, when the engine 1 is in a steady running state while operating in the predetermined high exhaust-temperature region, the maximum and minimum output voltages MAX and MIN are successively sampled to be updated.

Thereafter, the routine goes from step 23 or 24 to step 25. At step 25, a flag $f_{MAXMIN}$ for indicating if the engine 1 has operated in the predetermined high exhaust-temperature region, is set to be 1. This flag $f_{MAXMIN}$ is set to be zero at a time when the ignition switch becomes ON, in accordance with the program shown in FIG. 11 (see step 162). Therefore, when engine running state is steady while the engine 1 operates in the predetermined high exhaust-temperature region, the flag $f_{MAXMIN}$ is set to be 1 for the first time only when the routine first goes to step 21.

On the other hand, when it is determined that the flag f is zero at step 19, i.e. when the engine 1 has not operated in the predetermined high exhaust-temperature region, and when it is determined that the timer value Tmacc is not zero, i.e. when the engine is in a transient running state, the routine bypasses steps 21 to 25 to go to step 26.

At step 26, a timer value Tmont is increased by 1. As will be described hereinafter, the timer value Tmont is reset to be zero when the air/fuel ratio varies from lean to rich or from rich to lean across the stoichiometric value. By means of this timer value Tmont, an elapsed time after the air/fuel ratio varies from lean to rich or rich to lean can be measured.

At next step 27, the output voltage $VO_2$ of the oxygen sensor 14 is compared with the slice level voltage SL, e.g. 500 mV, which is substantially the middle value of the output voltage range of the oxygen sensor 14 and which substantially corresponds to the stoichiometric value of the air/fuel ratio, so that it is determined if the air/fuel mixture is richer or leaner than the stoichiometric value.

When the output voltage $VO_2$ is greater than the slice level voltage SL, i.e. when the air/fuel mixture is held richer than the stoichiometric value, the routine goes to step 28. When the air/fuel mixture becomes rich and oxygen in the air/fuel mixture is insufficient, the oxygen sensor 14 is designed to output high voltage.

At step 28, on the basis of a flag fR, the status of the previous detection (rich or lean) is determined. As will be described hereinafter, this flag fR is reset to be zero when lean detection is performed, i.e. when it is determined that the air/fuel mixture is leaner than the stoichiometric value (the process when rich detection is performed will be described hereinlater). Therefore, when the flag fR is zero, it is determined that the air fuel ratio is changing from lean to rich, and the routine goes to step 29.

At step 29, the flag fR is set to be 1, and a flag fL, which is used for determining the status of the previous detection (lean or rich), as will be described hereinafter, is set to be zero.

At step 30, the timer value Tmont is set in TMONT1 which is used for measuring an elapsed time while the air/fuel mixture is held lean (a lean control time). As will be described hereinafter, the timer value Tmont is reset to be zero when lean detection is performed for the first time after a previous rich detection, and is counted up while the air/fuel mixture is held lean.

At step 31, the timer value Tmont is reset to be zero for allowing the next measurement for an elapsed time after rich detection to be performed.

At step 32, the current air/fuel feedback control correction coefficient LAMBDA is set as the maximum value a. The reason why the current correction coefficient LAMBDA is set as the maximum value is as follows. In the previous cycle of the program, it was, for example, determined that the air/fuel mixture was to be held lean, so that the correction coefficient LAMBDA was so controlled as to increase. In the current cycle of the program, it is determined that the air/fuel mixture is held rich, so that the correction coefficient LAMBDA is required to be so controlled as to decrease. Therefore, when it is determined that the air/fuel mixture is held rich, it is presumed that the correction coefficient LAMBDA reaches its maximum value before it is so controlled as to decrease.

At step 33, it is determined whether or not the command D for diagnosing deterioration of the oxygen sensor 14 is given, similar to the process of step 12. When it is determined that no command for diagnosing deterioration of the oxygen sensor 14 is given, i.e. when the feedback control is performed as usual, the routine goes to step 40. At step 40, the correction coefficient LAMBDA is decreased in accordance with the proportional control, by multiplying the lean control proportional component $P_L$ selected on the basis of the basic fuel injection amount Tp and the engine revolution speed N at step 11, by a lean control correction coefficient hosL. to subtract the obtained value from the last correction coefficient LAMBDA. The result is set as a new correction coefficient LAMBDA. When the average air/fuel ratio deviates from near the stoichiometric value thereof by losing a balance between rich and lean controls (a balance between controls for increasing and decreasing the correction coefficient LAMBDA), the lean control correction coefficient hosL is used for correcting the lean control proportional component $P_L$ to compensate variation of the balance between rich and lean controls, as will be described herein in detail.

At next step 41, a flag fLL used for diagnosing deterioration of the oxygen sensor 14, is reset to be zero, and the routine ends.

On the other hand, if it is determined that the command D for diagnosing deterioration of the oxygen sensor 14 is given at step 33, the routine goes to step 34 and after, so that processes required for diagnosing deterioration of the oxygen sensor 14 are performed.

At step 34, the correction coefficient LAMBDA is decreased in accordance with the proportional control by subtracting the lean control proportional component $P_L$, which is set to be the same predetermined value as that of the rich control proportional component $P_R$ at step 13 for diagnosing deterioration of the oxygen sensor 14, from the previous correction coefficient LAMBDA. The obtained value is set in a register B which will be hereinafter referred to as "reg B".

At step 35, a value obtained by subtracting a constant value $\alpha$ from a mean value of the correction coefficient LAMBDA, which is a mean value of the maximum value a of the correction coefficient LAMBDA derived at step 32 and the minimum value b thereof, is compared with the value of "reg B". The minimum value b is derived in similar process to that of step 32 when the lean detection is performed for the first time, which will be described hereinafter. When it is determined that the value of "reg B" is greater than or equal to the obtained value $(a+b)/2-\alpha$. the routine goes step 36 in which the value of "reg B" is updated to the value $(a+b)/2-\alpha$, and then, the routine goes to step 37.

On the other hand, when it is determined that the value of "reg B" is less than the obtained value, the routine directly goes to step 37 in which the correction efficient LAMBDA used for performing the feedback control is set to be the value of "reg B".

The air/fuel ratio feedback correction coefficient LAMBDA is derived through the PI (proportional-integral) control process by detecting if the air/fuel mixture is held rich or lean relative to the set point (the stoichiometric value). By using the air/fuel ratio feedback correction coefficient LAMBDA, the average air/fuel ratio for the air/fuel mixture is so controlled as to approach the set point while the actual air/fuel ratio for the air/fuel mixture fluctuates. Therefore, the correction coefficient LAMBDA required for practically performing the feedback control is the mean value of the maximum and minimum values thereof. Now, since it is detected that the air/fuel mixture varies from lean to rich across the set point (the stoichiometric value), the fuel injection amount is controlled to decrease by decreasing the air/fuel ratio feedback correction coefficient LAMBDA. If the air/fuel ratio feedback correction coefficient LAMBDA is so controlled as to become less than the mean value $(a+b)/2$ corresponding to the set point (the stoichiometric value), it is expected that the air/fuel mixture can go out of at least a rich condition in which the air/fuel mixture is held rich.

However, even if the proportional control process of the air/fuel ratio feedback correction coefficient LAMBDA is performed on the basis of the lean control proportional component $P_L$ is preset to be a predetermined value, the proportional control process by which the air/fuel mixture can go out of the rich condition is not always performed. In addition, the time required for the air/fuel mixture to go out of the rich condition varies on the same running condition of the engine 1 if the value of the lean control proportional component $P_L$ varies. According to the present invention, deterioration of the oxygen sensor 14 is detected by measuring an elapsed time until the detected air/fuel ratio begins to vary toward the set point (the stoichiometric value) after the proportional control process for the correction coefficient LAMBDA is performed at a time when the air/fuel ratio varies from lean to rich or from rich to lean across the set point. Therefore, in order to coordinate the detection condition, the air/fuel ratio feedback correction coefficient LAMBDA is set so that the air/fuel mixture can go out of at least a current rich condition by the proportional control.

Figure 8:
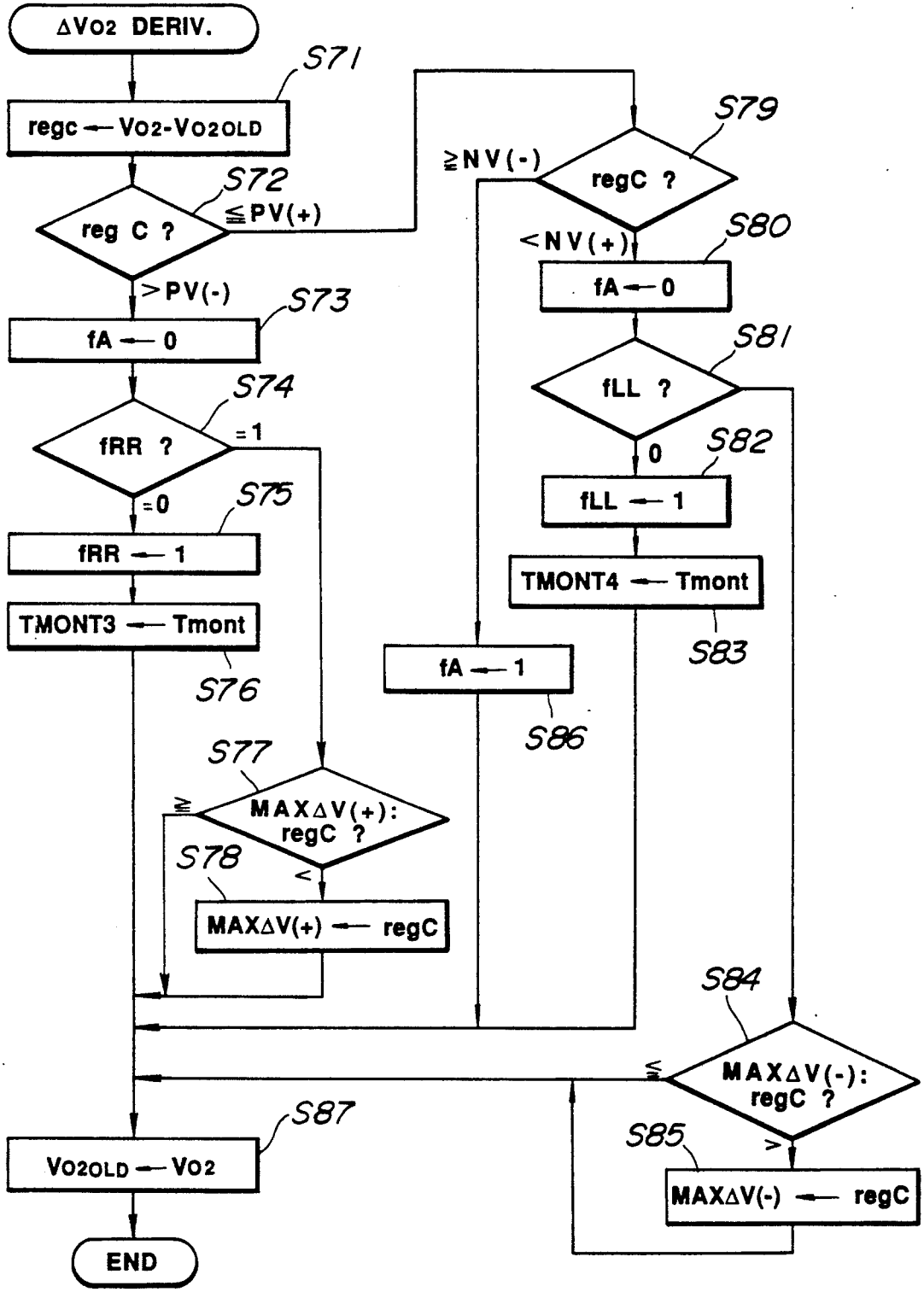
FIG. 8 is a flow chart of a program for deriving deviation $\Delta VO_2$ per unit time of an output voltage $VO_2$ of an oxygen sensor, the deviation $\Delta VO_2$ being used for the program collectively shown in FIGS. 7(*a*) to 7(*d*)

At step 38, a deviation $\Delta VO_2$ per unit time of the output voltage $VO_2$ of the oxygen sensor 14 (an output deviating speed) is derived in accordance with a program shown in FIG. 8.

First, at step 71, a variation $\Delta VO_2$ per unit time (10 ms) of the output voltage $VO_2$ of the oxygen sensor 14 is derived by subtracting the output voltage $VO_2OLD$ input at step 1 in the last cycle (10 ms before the current cycle) from the output voltage $VO_2$ input at step 1 in the current cycle. The variation $\Delta VO_2$ is set in a register C which will be hereinafter referred to as a "reg C".

At step 72, the value of "reg C" in which the newest variation $\Delta VO_2$ is set at step 71, is compared with a predetermined positive value (PV), so that it is determined whether or not the output voltage $VO_2$ of the oxygen sensor 14 increases at a greater rate than a predetermined rate.

When it is determined that the value of "reg C" is greater than the predetermined positive value (PV), the routine goes to step 73 in which a flag fA used for determining if the output voltage $VO_2$ is substantially constant, is reset to be zero, so that it can be determined that the output voltage $VO_2$ varies.

At step 74, the value of a flag fRR is determined. The flag fRR is used for determining if it is detected that the air/fuel ratio begins to increase at a greater rate than the predetermined rate. As will be described hereinafter, the flag fRR is reset to be zero when lean detection is performed, and then, it is set to be 1 when it is detected that the output voltage $VO_2$ is increasing at a greater rate than the predetermined rate.

Therefore, if it is determined that the flag fRR is zero at step 74, it is indicated that the output voltage $VO_2$ begins to increase after the lean detection is performed. For that reason, when it is determined that the flag fRR is zero at step 74, the routine goes to step 75 in which the flag fRR is set to be 1 so that it can be determined that the aforementioned detection was already performed. Then, at step 76, the timer value Tmont is set in TMONT3. The timer value Tmont is reset to be zero when lean detection is performed, and is used for measuring an elapsed time from the beginning of the lean detection. Therefore, TMONT3 indicates an elapsed time until the air/fuel ratio begins to vary in a rich direction after lean detection is performed, i.e. an elapsed time until the air/fuel ratio begins to vary toward the stoichiometric value immediately after the air/fuel mixture varies from rich to lean across the stoichiometric value.

On the other hand, when it is determined that the flag fRR is 1 at step 74, the routine goes to step 77. At step 77, the value of "reg C" in which the variation $\Delta VO_2$ derived at step 71 in the current cycle of the program is set, is compared with the last maximum positive variation MAXΔV(+). As will be described hereinafter, the maximum positive variation MAXΔV(+) is reset to be zero in accordance with a program collectively shown in FIGS. 9(*a*) and 9(*b*), and then, it is set to be the maximum value of the positive variation $\Delta VO_2$ of the output voltage $VO_2$. When it is determined that the value of "reg C" in which the current variation $\Delta VO_2$ is set is greater than the last maximum positive variation MAXΔV(+), the routine goes to step 78 in which the maximum positive variation MAXΔV(+) is renewed to be set to be the value of "reg C".

Thereafter, at step 87, the last output voltage $VO_2OLD$ is set to be the output voltage $VO_2$ input at step 1 in the current cycle of the program for deriving the next variation $\Delta VO_2$ (reg c).

On the other hand, when it is determined that the value of "reg C" is less than or equal to the predetermined positive value (PV), the routine goes step 79. At step 79, the value of "reg C" is compared with a predetermined negative value (NV), so that it is determined whether or not the output voltage $VO_2$ of the oxygen sensor 14 decreases at a greater rate than a predetermined rate.

When it is determined that the value of "reg C" is less than the predetermined negative value (NV), the routine goes to step 80 in which the flag fA, for determining if the output voltage $VO_Z$ is in a substantially stable condition, is set to zero, to indicate that the output voltage $VO_2$ is not varying.

At step 81, the value of a flag fLL is determined. As will be described hereinafter, the flag fLL is set to zero when rich detection is performed, and then, it is set to be 1 when it is detected that the output voltage $VO_2$ is decreasing at a greater rate than the predetermined rate.

Therefore, if it is determined that the flag fLL is zero at step 81, it indicates that the output voltage $VO_2$ begins to decrease after a rich detection has been performed. For that reason, when it is determined that the flag fLL is zero at step 81, the flag fLL is set to be 1 at step 82 to indicate that the decrease in output voltage $VO_2$ has been detected. Then, at step 83, the timer value Tmont is set in TMONT 4. The timer value Tmont is reset to be zero when rich detection is performed, and is used for measuring an elapsed time after the beginning of rich detection. Therefore, TMONT4 indicates an elapsed time until the air/fuel ratio begins to vary in a lean direction after a rich detection has been performed, i.e. an elapsed time until the air/fuel ratio begins to vary toward the stoichiometric value after the air/fuel mixture varies from lean to rich across the stoichiometric value.

On the other hand, when it is determined that the flag fLL is 1 at step 81, the routine goes to step 84. At step 84, the value of "reg C" in which the variation $\Delta VO_2$ derived at step 71 in the current cycle of the program is set, is compared with the maximum negative variation MAXΔV(−) of the previous program cycle. As will be described hereinafter, the maximum negative variation MAXΔV(−) is reset to be zero in accordance with the program collectively shown in FIGS. 9(*a*) and 9(*b*), and then, it is set to be the negative variation $\Delta VO_2$ of the output voltage $VO_2$, the absolute value of which is maximum. When it is determined that the value of "reg C" in which the current variation $\Delta VO_2$ is set, is less than the last maximum negative variation MAXΔV(−), the routine goes step 85 in which the maximum negative variation MAXΔV(−) is renewed to be set to be the value of "reg C".

Thereafter, at step 87, the last output voltage $VO_2OLD$ is set to be the output voltage $VO_2$ input at step 1 in the current cycle of the program.

Furthermore, when it is determined that the value of "reg C" is greater than the predetermined negative value (NV) at step 79, the variation of the output voltage $VO_2$ of the oxygen sensor 14 is not so great in both of positive and negative directions. Therefore, the flag fA is set to be 1 at step 86 so that it can be determined that the output voltage $VO_2$ is in a substantially stable condition, and the routine goes to step 87.

Again, referring to the flow chart of the program collectively shown by FIGS. 7(*a*) to 7(*d*), as previously described, in a case where it is determined that rich detection begins at step 28 (the flag fR is 0), the variation $\Delta VO_2$ of the output voltage $VO_2$ of the oxygen sensor 14 (the output variation speed) is derived at step 38 in accordance with the program and the flag fLL is reset to be zero at step 39 so that an elapsed time (TMONT4) until the air/fuel ratio begins to vary in a lean direction (toward the set point) after rich detection has been performed, can be detected. However, when it is determined that the flag fR is 1 at step 28, the routine goes from step 26 to step 42. At step 42, the correction coefficient LAMBDA is set to be a smaller value which is obtained by subtracting the integral component I selected at step 11 multiplied by the fuel injection amount Ti, from the correction coefficient LAMBDA of the previous program cycle. Therefore, while the air/fuel mixture is held rich, the correction coefficient LAMBDA is decreased by $I \times Ti$ every 10 ms, or every time the program reaches step 42.

At the next step 43, it is determined whether or not the command D for diagnosing deterioration of the oxygen sensor 14 is given in a similar process to that of step 12 and 33. Only when it is determined that the command D for diagnosing deterioration is given, does the routine go to step 44 in which the variation $\Delta VO_2$ of the output voltage $VO_2$ of the oxygen sensor 14 is derived in accordance with the program shown in FIG. 8.

On the other hand if, at step 27, it is determined that the output voltage $VO_2$ of the oxygen sensor 14 is less than the slice level voltage SL substantially corresponding to the set point (the stoichiometric value) of the air/fuel ratio, i.e. that the air/fuel mixture is leaner than the set point, the processes at steps 45 to 61 are performed. These processes are substantially similar to processes at steps 28 to 44 when rich detection processing is performed. The processes performed at step 45 to 61 are schematically described below.

At step 45, on the basis of the flag fL, it is determined whether or not the lean detection is performed, i.e. whether or not it is determined that the air/fuel mixture is leaner than the set point. The flag fL is reset to be zero when the rich detection is performed, i.e. when it is determined that the air/fuel mixture is richer than the set point. Therefore, when the flag fL is zero, it is determined that the previous detection was not a lean detection, the program goes to step 46 in which the flag fL is set to 1 and the flag fR is set to zero.

At step 47, the timer value Tmont is set in TMONT2 which is used for measuring an elapsed time while the air/fuel mixture is held rich (a rich control time). The timer value Tmont is reset to be zero when rich detection is performed, and is counted while the air/fuel mixture is held rich.

At step 48, after the mixture is no longer held rich, the timer value Tmont is reset to be zero for allowing the measurement of an elapsed time after a subsequent lean detection occurs.

At step 49, the current air/fuel feedback control correction coefficient LAMBDA is set to be the minimum value b. The reason why the current correction coefficient LAMBDA is set to be minimum value is as follows. In the previous program cycle, it was determined that the air/fuel mixture was held rich, so that the correction coefficient LAMBDA was so controlled as to decrease. In the current program cycle, it is determined that the air/fuel mixture is held lean, so that the correction coefficient LAMBDA is required to be so controlled as to increase. Therefore, when it is determined that the air/fuel mixture is held lean, it is presumed that the correction coefficient LAMBDA becomes the minimum value before it is so controlled as to increase.

At step 50, it is determined whether or not the command D for diagnosing deterioration of the oxygen sensor 14 is given, in similar process to that of step 12. When it is determined that no command for diagnosing deterioration of the oxygen sensor 14 is given, i.e. when the feedback control is performed as usual, the routine goes to step 57. At step 57, the correction coefficient LAMBDA is increased in accordance with the proportional control by multiplying the rich control proportional component $P_R$ selected on the basis of the basic fuel injection amount Tp and the engine revolution speed N at step 11, by a rich control correction coefficient hosR, and by adding the obtained value to the correction coefficient LAMBDA of the previous program cycle. The result is set as a new correction coefficient LAMBDA. When the average air/fuel ratio deviates from near the stoichiometric value thereof by losing a balance between rich and lean controls (a balance between controls for increasing and decreasing the correction coefficient LAMBDA), the rich control correction coefficient hosR is used for correcting the rich control proportional component $P_R$ to compensate for variation of the balance between the rich and lean controls.

At next step 58, the flag fRR used for diagnosing deterioration of the oxygen sensor 14, is reset to be zero, and the routine ends.

On the other hand, when it is determined that the command D for diagnosing deterioration of the oxygen sensor 14 is given at step 50, the routine goes to step 51 and after, and processes required for diagnosing deterioration of the oxygen sensor 14 are performed.

At step 51, the correction coefficient LAMBDA is increased in accordance with the proportional control by adding the rich control proportional component $P_R$, which is set to be the same predetermined (absolute) value as that of the lean control proportional component $P_L$ at step 13 for diagnosing deterioration of the oxygen sensor 14, using the previous correction coefficient LAMBDA. The obtained value is set in the register B (reg B).

At step 52, a value obtained by adding a constant value $\alpha$ to a mean value of the correction coefficient LAMBDA, which is a mean value of the maximum value a of the correction coefficient LAMBDA and the minimum value b thereof derived at step 49, is compared with the value of "reg B". The maximum value a is derived at step 32 when the rich detection is performed. When it is determined that the value of "reg B" is less than or equal to the obtained value $(a+b)/2+\alpha$, the routine goes step 53 in which the value of "reg B"

is updated to tbe set to be the value $(a+b)/2+\alpha$, and then, the routine goes to step 54.

On the other hand, when it is determined that the value of "reg B" is greater than the obtained value, the routine directly goes to step 54. At step 54, the correction efficient LAMBDA used for performing the feedback control is set to be the value of "reg B".

As mentioned above, the air/fuel ratio feedback correction coefficient LAMBDA is derived through the PI (proportional-integral) control process by detecting if the air/fuel mixture is held rich or lean relative to the set point (the stoichiometric value). By using the air/fuel ratio feedback correction coefficient LAMBDA, the average air/fuel for the air/fuel mixture is so controlled as to approach the set point while the actual air/fuel ratio for the air/fuel mixture fluctuates. Therefore, the correction coefficient LAMBDA required for practically performing the feedback control is the mean value of the maximum and minimum values thereof. Now, since it is detected that the air/fuel mixture varies from rich to lean across the stoichiometric value, the fuel injection amount is corrected by increasing the air/fuel ratio feedback correction coefficient LAMBDA. If the air/fuel ratio feedback correction coefficient LAMBDA is so controlled as to become greater than $(a+b)/2$ value), it is expected that the air/fuel mixture can go value), it is expected that the air/fuel mixture can go out of at least a lean condition in which the air/fuel mixture is held lean.

However, even if the proportional control process of the air/fuel ratio feedback correction coefficient LAMBDA is performed on the basis of the rich control proportional component $P_R$ which is preset to be a predetermined value, the proportional control process by which the air/fuel mixture can go out of the lean condition, is not always performed. In addition, a time required for the air/fuel mixture to go out of the lean condition may vary for the same running condition of the engine 1 if the value of the rich control proportional component $P_R$ varies. According to the present invention, deterioration of the oxygen sensor 14 is detected by measuring an elapsed time until the detected air/fuel ratio begins to vary toward the set point (the stoichiometric value) after the proportional control process for the correction coefficient LAMBDA is performed at a time when the air/fuel ratio varies from lean to rich or from rich to lean across the set point. Therefore, in order to coordinate the detection condition, the air/fuel ratio feedback correction coefficient LAMBDA is set so that the air/fuel mixture can go out of at least the current lean condition by the proportional control.

At step 55, the deviation $\Delta VO_2$ per unit time of the output voltage $VO_2$ (the output deviating speed) of the oxygen sensor 14 is derived in accordance with the program shown in FIG. 8.

In a case where it is determined that the lean detection is performed at step 45, after the variation $\Delta VO_2$ of the output voltage $VO_2$ of the oxygen sensor 14 (the output variation speed) is derived at step 55 in accordance with the above-mentioned process, the flag fRR is reset to be zero at step 56, so that an elapsed time (TMONT3) until the air/fuel ratio begins to vary in a rich direction (toward the stoichiometric) after the lean detection is performed, can be detected.

In addition, if is determined that the flag fL is 1 at step 45, the routine goes from step 45 to step 59. At step 59, the correction coefficient LAMBDA is set to be a greater value which is obtained by adding the integral component I selected at step 11 multiplied by the fuel injection amount Ti, to the last correction coefficient LAMBDA. Therefore, while the air/fuel mixture is held lean, the correction coefficient LAMBDA is increased by $I \times Ti$ at every 10 ms at step 59.

At step 60, it is determined whether or not the command D for diagnosing deterioration of the oxygen sensor 14 is given, in similar process to that of step 12 and 50. Only when it is determined that the command D for diagnosing deterioration is given, does the routine goes to step 61 and the variation $\Delta VO_2$ of the output voltage $VO_2$ of the oxygen sensor 14 is derived in accordance with the program shown in FIG. 8.

Figure 9A:
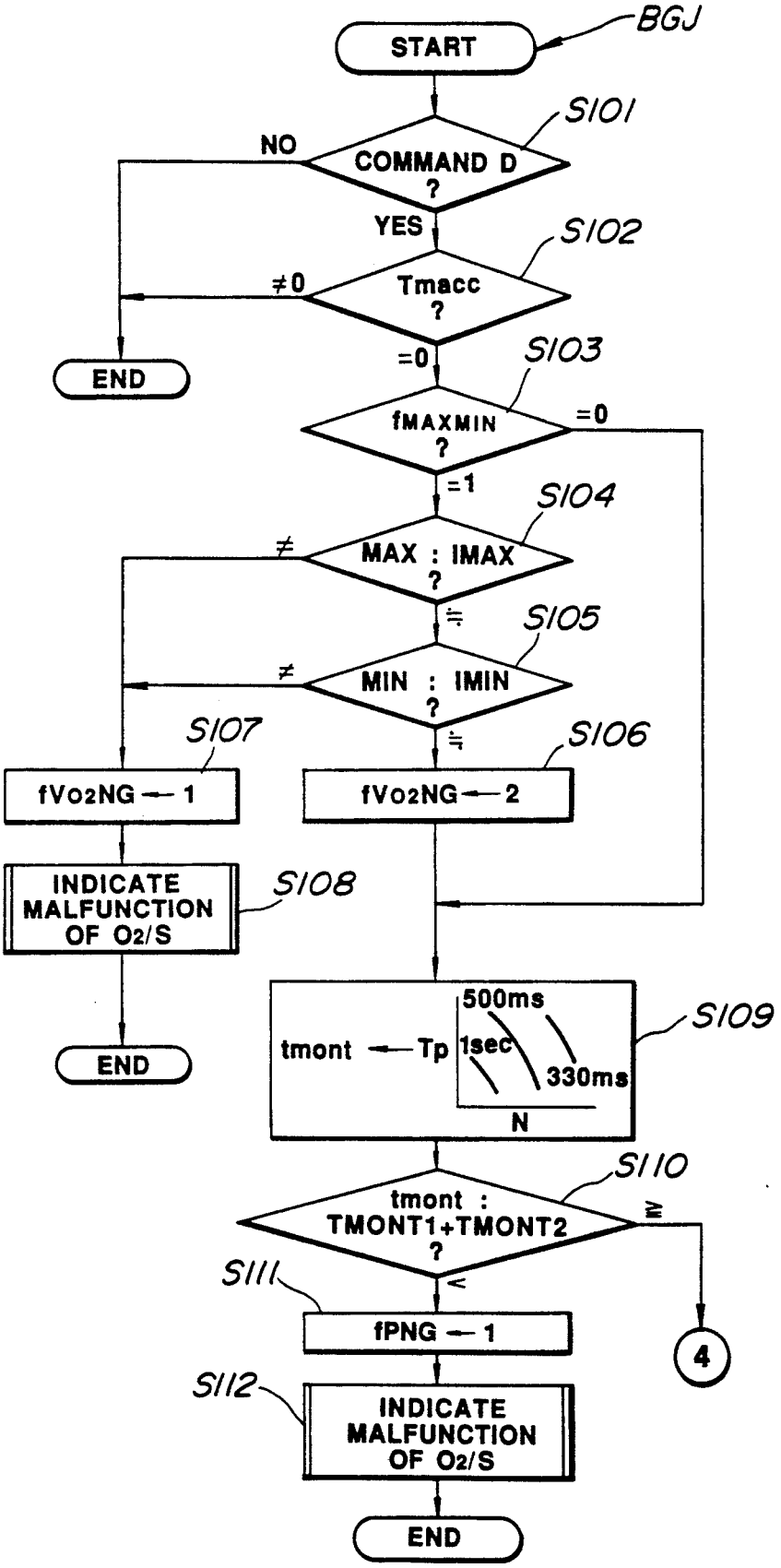
FIGS. 9(*a*) and 9(*b*) collectively show a flow chart of a program for diagnosing deterioration of an oxygen sensor, the diagnosis of deterioration being used for the program collectively shown in FIGS. 7(*a*) to 7(*d*)
Figure 9B:
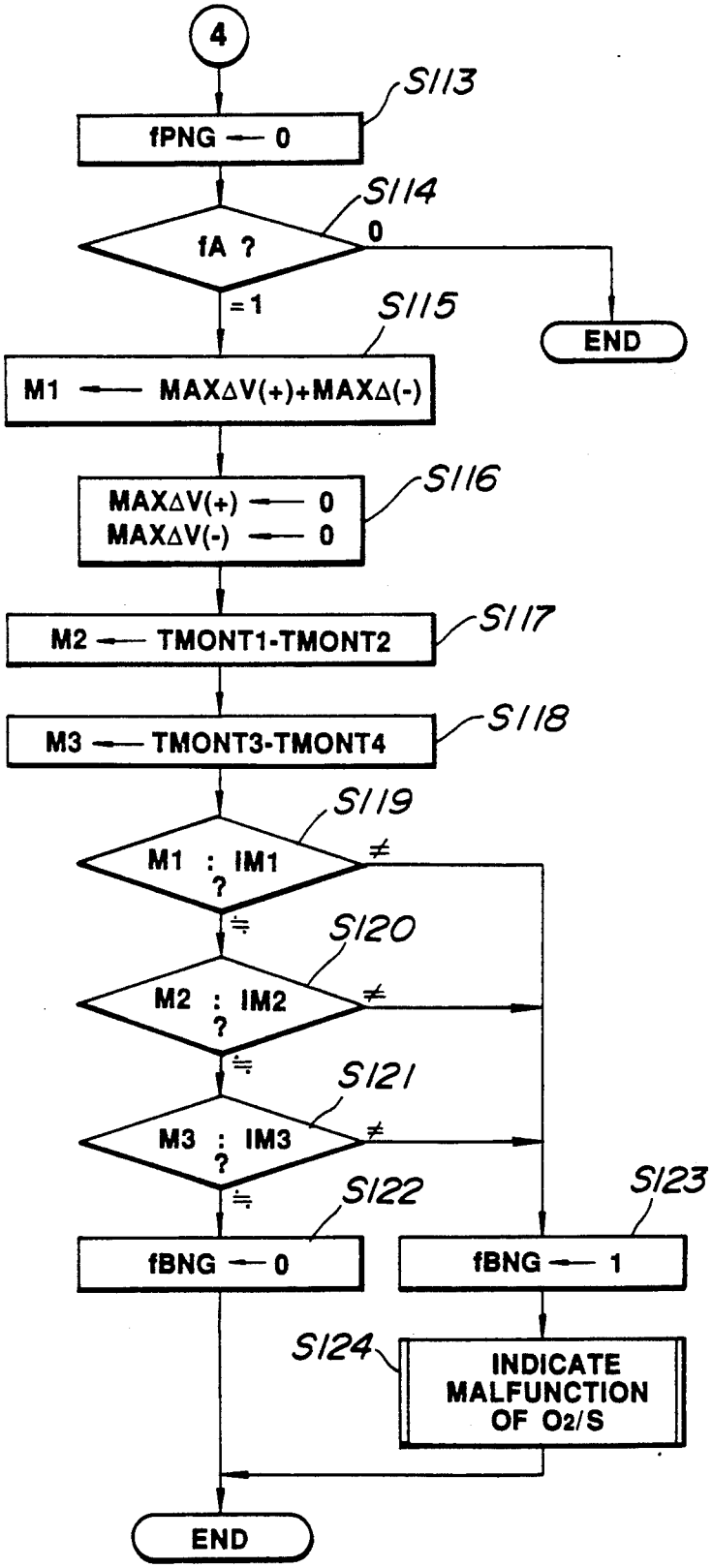

FIGS. 9(*a*) and 9(*b*) collectively show a flow chart of a program for diagnosing deterioration of the oxygen sensor 14. This program is executed as background processing (a background job).

First, at step 101, it is determined whether or not the command D for diagnosing deterioration of the oxygen sensor 14 is given. When no command is given, the routine ends, and when the command D is given, the routine goes to step 102.

At step 102, it is determined whether or not the timer value Tmacc is zero. When it is not zero, the routine ends. On the other hand, when it is zero, i.e. when the engine 1 operates in a steady running state, the routine goes to step 103, and deterioration of the oxygen sensor 14 is diagnosed. The reason why the deterioration of the oxygen sensor 14 is diagnosed only when the engine 1 operates in a steady running state, is as follows. When the engine 1 operates in a transient running state, the air/fuel ratio often deviates greatly from the stoichiometric value due to response time lag of the liquid fuel supplied to the engine 1 along the inner wall of the intake passage and so forth. When the sampling for control conditions for the air/fuel ratio feedback correction coefficient LAMBDA is performed on the basis of such a greatly deviated air/fuel ratio, it is apprehended that a mistaken diagnosis of sensor deterioration may easily occur.

At step 103, the value of the flag $f_{MAXMIN}$ is determined. As mentioned above, the flag $f_{MAXMIN}$ is reset to be zero when the ignition switch becomes ON, and thereafter, it is set to be 1 when the engine 1 operates in the predetermined high exhaust-temperature region. While the engine 1 is operating in the predetermined high exhaust-temperature region, the samplings of the maximum output voltage MAX (rich detection signal level) and the minimum output voltage MIN (lean detection signal level) of the output voltage $VO_2$ of the oxygen sensor 14 are performed. Therefore, when it is determined that the flag $f_{MAXMIN}$ is 1 at step 103, the routine goes to step 104 and then, at steps 104 and 105, the sampled maximum and minimum values MAX and MIN are compared with the initial values IMAX and IMIN which are set as the maximum and minimum values MAX and MIN when the oxygen sensor 14 is new. On the basis of this result, the deterioration of the oxygen sensor 14 is diagnosed.

Figure 17:
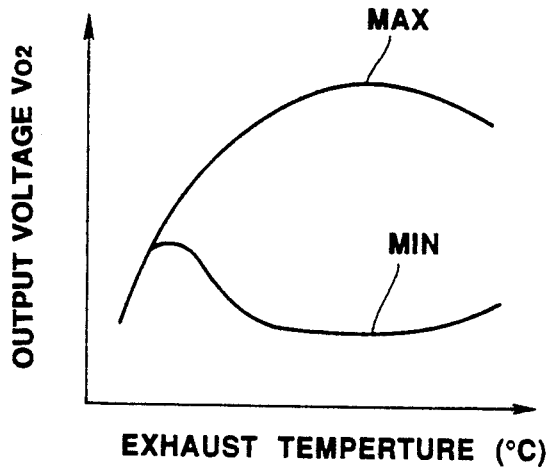
FIG. 17 is a graph showing a relationship between the exhaust air temperature and the output voltage of the oxygen sensor.

That is, as shown in FIG. 17, when the engine 1 operates in a higher exhaust-temperature region than a predetermined temperature, the oxygen sensor 14 outputs voltages corresponding to substantially constant maximum and minimum values MAX and MIN when the air/fuel mixture is held rich and lean, respectively. Therefore, if the initial values IMAX and IMIN for the maximum value (rich detection signal level) and minimum value (lean detection signal level) are stored, it can be determined whether or not the output level of the oxygen sensor 14 is abnormal by comparing the initial values IMAX and IMIN with the detected maximum and minimum values MAX and MIN.

The process described above begins at step 104, the maximum value MAX sampled in the predetermined high exhaust-temperature region is compared with the initial value IMAX. When the sampled maximum value MAX is not substantially equal to the initial value IMAX, the routine goes to step 107 in which a flag $fVO_2NG$ used for indicating abnormality of the output level of the oxygen sensor 14 is set to be 1, so that the abnormality of the output level of the oxygen sensor 14 can be determined.

At step 108, it is indicated that the oxygen sensor 14 has some trouble by means of, e.g. an indicator on a dash board, for informing the vehicle driver of the situation.

In addition, at step 104, if it is determined that the maximum value MAX is substantially equal to the initial value IMAX, the routine goes to step 105 in which the minimum value MIN sampled in the predetermined high exhaust-temperature region is compared with the initial value IMIN. When the sampled minimum value MIN is not substantially equal to the initial value IMIN, the flag $fVO_2NG$ is set to be 1 at step 107, to indicate that the oxygen sensor 14 has some trouble at step 108.

On the other hand, when it is determined that both of the maximum and minimum values MAX and MIN are substantially equal to the initial values IMAX and IMIN at steps 104 and 105, respectively, the routine goes to step 108 in which the flag $fVO_2NG$ is set to zero, since the oxygen sensor 14 has no trouble with regard to the output level thereof.

Figure 1:
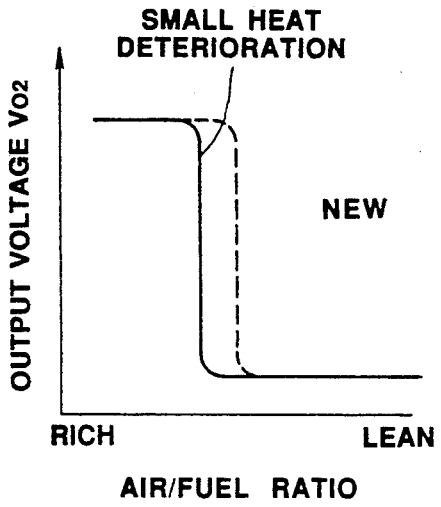
FIG. 1 is a graph showing a relationship between output voltage of an oxygen sensor and an air/fuel ratio for an air/fuel mixture when an oxygen sensor is new compared with that of an oxygen sensor after slight deterioration has occurred.
Figure 2:
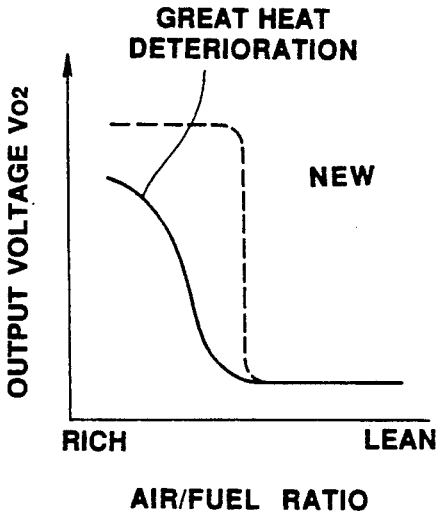
FIG. 2 is a graph showing a relationship between output voltage of an oxygen sensor and an air/fuel ratio for an air/fuel mixture when an oxygen sensor is new compared with that of an oxygen sensor in which great deterioration has occurred.
Figure 3:
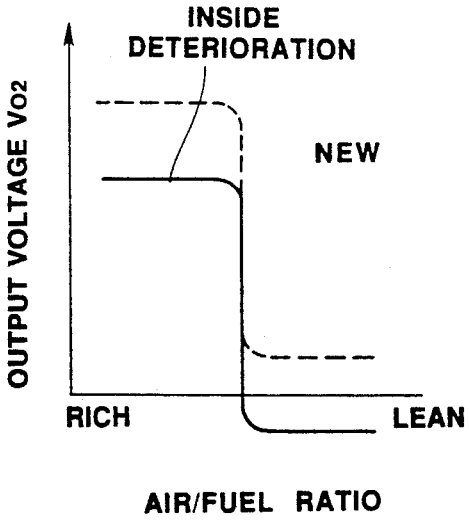
FIG. 3 is a graph showing a relationship between output voltage of an oxygen sensor and an air/fuel ratio for an air/fuel mixture when a new oxygen sensor is used compared with that of an oxygen sensor in which an inner electrode of a zirconia tube of the oxygen sensor has deteriorated.
Figure 4:
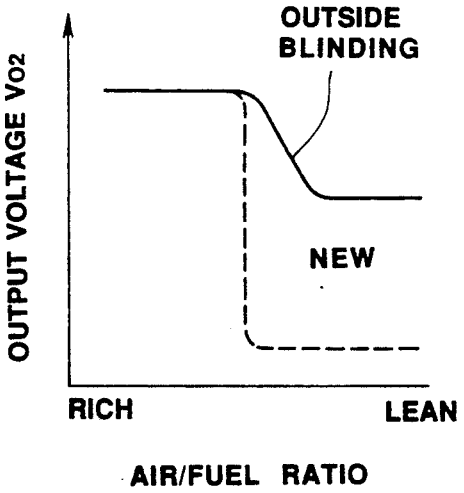
FIG. 4 is a graph showing a relationship between output voltage of an oxygen sensor and an air/fuel ratio for an air/fuel mixture when a new oxygen sensor is used compared with an oxygen sensor in which blinding has occurred producing an obfuscating layer inhibiting a zirconia tube of the oxygen sensor from directly sensing the exhaust gas.
Figure 5:
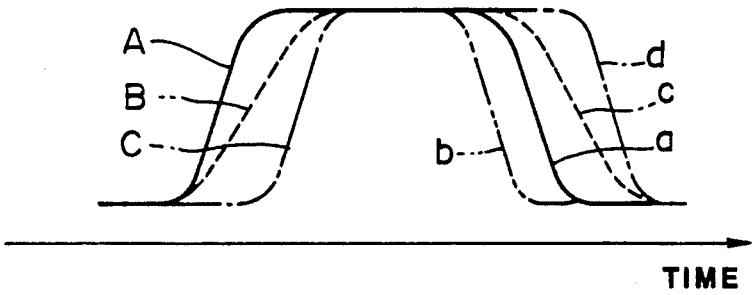
FIG. 5 is a time chart of output voltage of an oxygen sensor when a new oxygen sensor is used, compared with the outputs of oxygen sensors subjected, respectively, to to small and great amounts of deterioration.

In a zirconia tube type oxygen sensor 14, the maximum and minimum values MAX and MIN of the output voltage $VO_2$ vary relative to the initial values IMAX and IMIN of a new oxygen sensor, when the inner electrode (atmosphere sensing electrode) of the sensor deteriorates, or when blinding is produced obfuscating the outer surface of the zirconia tube, as shown in FIGS. 3 and 4.

After the output level of the oxygen sensor 14 is diagnosed as mentioned above, if no problems with the sensor output level are indicated, a diagnostic period of one cycle of a rich/lean control is executed beginning at step 109.

At step 109, on the basis of the engine revolution speed N and the basic fuel injection amount Tp (the engine load). an initial value "tmont" of a period for one cycle of rich/lean control, i.e. a period for one cycle of output voltage of a new oxygen sensor 14, as it would perform in the current engine running state, is selected from a map in which initial values of periods for the respective cycles of rich/lean control in various engine running states, in accordance with the engine revolution speed N and the basic fuel injection amount Tp, are set.

At step 110, the initial value "tmont" of a period for one control cycle selected from the map at step 108 is compared with a period for one control cycle obtained by adding the lean time (the rich control time) TMONT1 to the rich time (the lean control time) TMONT2. If the period for one control cycle is greater than the initial (a control period equivalent to that of a new sensor) period for one control cycle, a flag fPNG is set to be 1 at step 111 to indicate that the period for one control cycle is abnormal, and that the oxygen sensor 14 has some trouble.

The period for one control cycle becomes greater than the initial period, when blinding is produced between the sensor device and the exhaust gas to be detected, or when heat deterioration is produced in zirconia or the like constituting the sensor device. In this case a warning indication is sent to a vehicle dash board or the like in step 112, similar to the process of step 108 and the program ends.

On the other hand, when it is determined that the period for one control cycle is not greater than the initial (or control) period, the routine goes to step 113 in which the flag fPNG is set to be zero to indicate that the oxygen sensor is normal.

At step 114, the value of the flag fA is read. When the flag fA is 1, i.e. when the output voltage $VO_2$ of the oxygen sensor 14 is substantially constant, the routine goes to step 115 and after, and diagnosis for deterioration of the oxygen sensor 14 is performed.

At step 115, a value M1 is set by adding the maximum positive variation $MAX\Delta V(+)$ to the maximum negative variation $MAX\Delta V(-)$, which are sampled in accordance with the program shown in FIG. 8.

At step 116, the maximum positive and negative variations $MAX\Delta V(+)$ and $MAX\Delta V(-)$ are reset to be zero for allowing the $MAX\Delta V(+)$ and $MAX\Delta V(-)$ to be newly sampled.

At step 117, a value M2 is set by subtracting the rich time (the lean control time) TMONT 2 from the lean time (the rich control time) TMONT 1. At step 118, a M3 is set to be a value obtained by subtracting the elapsed time TMONT4 until the air/fuel ratio begins to vary in a lean direction immediately after the rich detection was performed, from the elapsed time TMONT3 until the air/fuel ratio begins to vary in a rich direction after the lean detection was performed.

At step 119, the value M1, which indicates a difference between variation speeds when the output voltage of the oxygen sensor 14 increases and when it decreases, is compared with a predetermined initial (control) value IM1 which corresponds to a value M1 of a new oxygen sensor, and it is determined whether or not this the current value M1 differs from the characteristics of the control, or new, value IM1. If it is determined that M1 is not substantially equal to the control value IM1, it is presumed that there is a variation in one response time of the oxygen sensor 14 in at least one direction, that is, when the air/fuel ratio varies from rich to lean or from lean to rich across the stoichiometric value. Therefore, the flag fBNG is set to 1 at step 123, and it is indicated at step 124 that the oxygen sensor 14 has some trouble and the program ends.

If, it is determined that the value M1 is substantially equal to the initial value IM1, the routine goes to step 120.

At step 120, the value M2 which is a difference between the rich time (the lean control time) and the lean time (the rich control time) of the feedback control, is compared with a predetermined initial (control) value IM2 which corresponds to the value M2 of a new oxygen sensor, and it is determined whether or not the balance between the rich and lean control times varies from those of a new oxygen sensor. If this balance varies from the initial balance, the air/fuel ratio deviates from the stoichiometric value present when the oxygen sensor 14 was new. Therefore, in this case, the flag fBNG is set to 1 at step 123, and it is indicated at step 124 that the oxygen sensor 14 has some trouble and the program ends.

When it is determined that the value M2 is substantially equal to the initial value IM2, the routine goes step 121.

At step 121, the value M3, which indicates a difference between the elapsed times TMONT3 and TMONT4, is compared with a predetermined initial value IM3 which corresponds to the value M3 of a new oxygen sensor, and it is determined whether or not the response balance between the rich and lean detections varies from the initial response balance when the oxygen sensor 14 is initially used. When it is determined that this response balance varies from the initial response balance so that M3 is not substantially equal to the initial value IM3, the flag fBNG is set to 1 at step 123, and it is indicated at step 124 that the oxygen sensor 14 has some trouble and the program ends.

On the other hand, when it is determined that all of M1, M2 and M3 are substantially equal to the initial values IM1, IM2 and IM3, respectively, i.e. when all response balances do not significantly vary from the respective initial (new) values, the flag fBNG is set to zero so that it can be determined that the oxygen sensor 14 has no trouble with respect to response balance.

As mentioned above, if the oxygen sensor 14 shows any one of various patterns of deterioration, an air/fuel ratio feedback control system, according to the present invention, can perform self-diagnosis of oxygen sensor deterioration on the basis of the variation characteristics of the oxygen sensor 14 for the respective deterioration patterns. Therefore, it can accurately diagnose deterioration of the oxygen sensor 14. In addition, since the system can indicate the diagnosed results to inform a vehicle driver of the need for maintenance of the deteriorated oxygen sensor, the engine 1 can be prevented from operating in a condition in which the air/fuel ratio deviates from the stoichiometric value at an early stage, thereby at an early time preventing a drop in the quality of exhaust emissions.

In addition, an air/fuel ratio feedback control system, according to the present invention, can modify the air/fuel ratio feedback correction coefficient LAMBDA on the basis of the aforementioned diagnosed results so that the air/fuel ratio can be controlled to approach the initial stoichiometric value, even if the oxygen sensor 14 shows some deterioration. This modification is performed in accordance with programs of FIGS. 10, 12 and 13.

Figure 10:
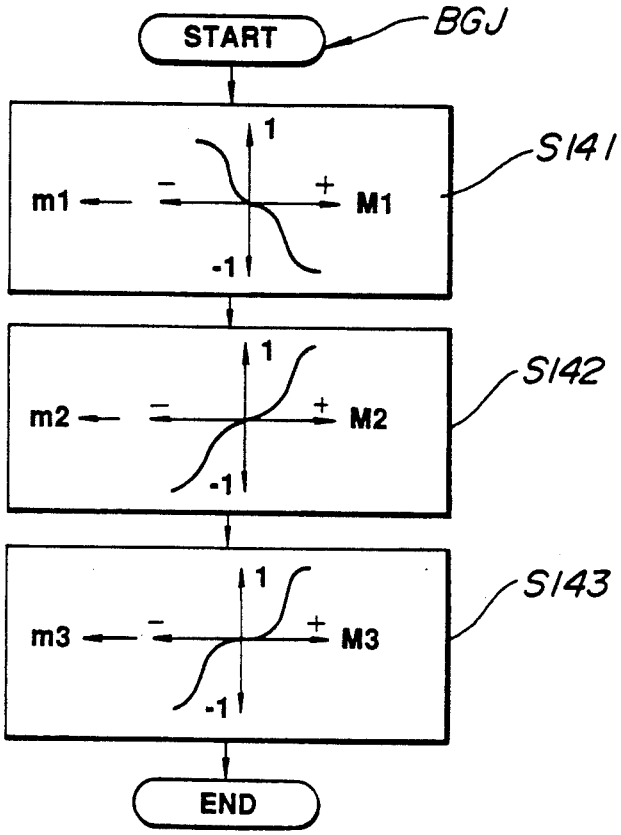
FIG. 10 is a flow chart of a program for setting membership characteristic values used for modifying the air/fuel ratio feedback correction coefficient LAMBDA when the oxygen sensor deteriorates.

The program shown in FIG. 10 is executed as background processing (a background job). At steps 141, 142 and 143, membership characteristic values m1, m2 and m3 are set on the basis of membership functions which are preset on the basis of fuzzy logic. The membership characteristic values m1, m2 and m3 indicate deviation amounts of the aforementioned M1 (the output variation speed), M2 (the rich/lean control time) and M3 (the elapsed time until the air/fuel ratio begins to vary toward the stoichiometric value), which indicate the balance between the rich and lean times in the feedback control, and variation from their initial values thereof, respectively.

Although the membership functions shown in FIG. 10 indicate that the initial values are zero (m1=m2=m3=0), initial values other than zero may be also used.

Figure 12A:
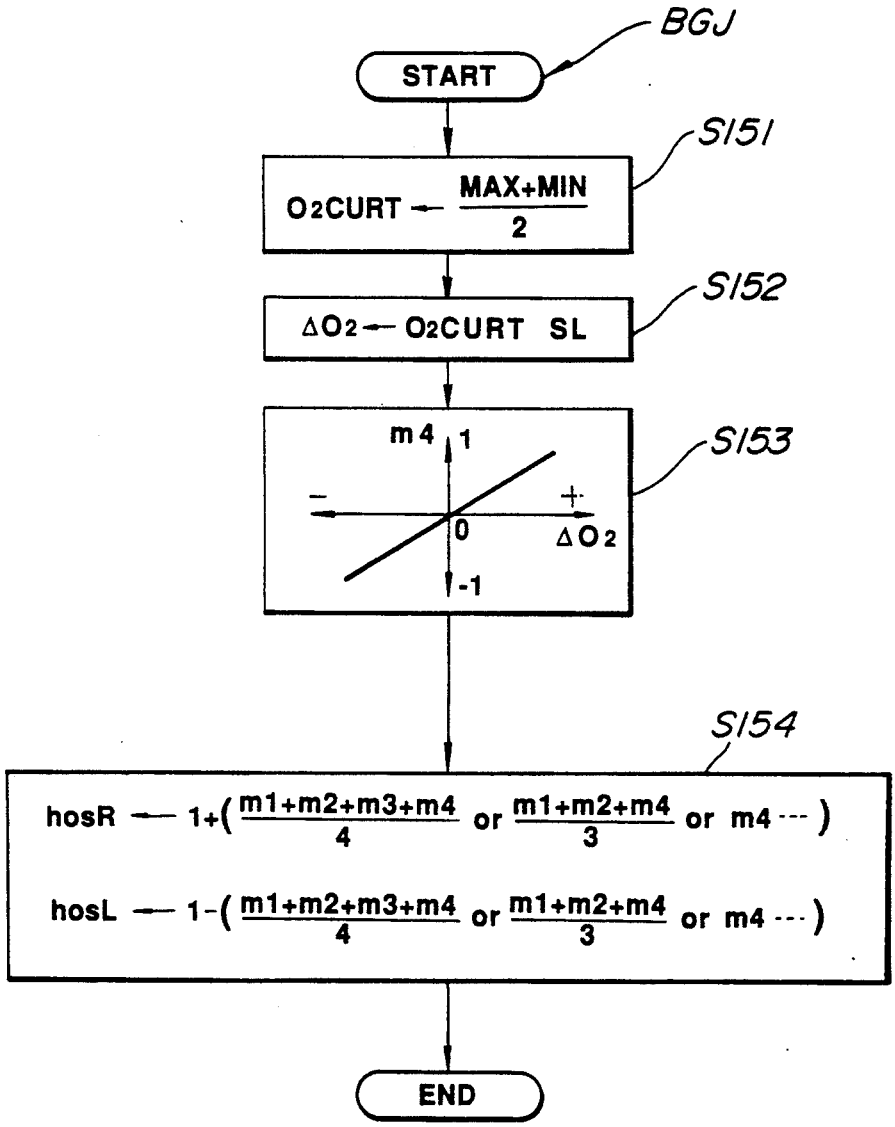
FIG. 12(*a*) is a flow chart of a program for setting correction coefficients hosR and hosL by using membership characteristic values, for compensating deviation of the set point of the air/fuel ratio due to deterioration of the oxygen sensor.
Figure 12B:
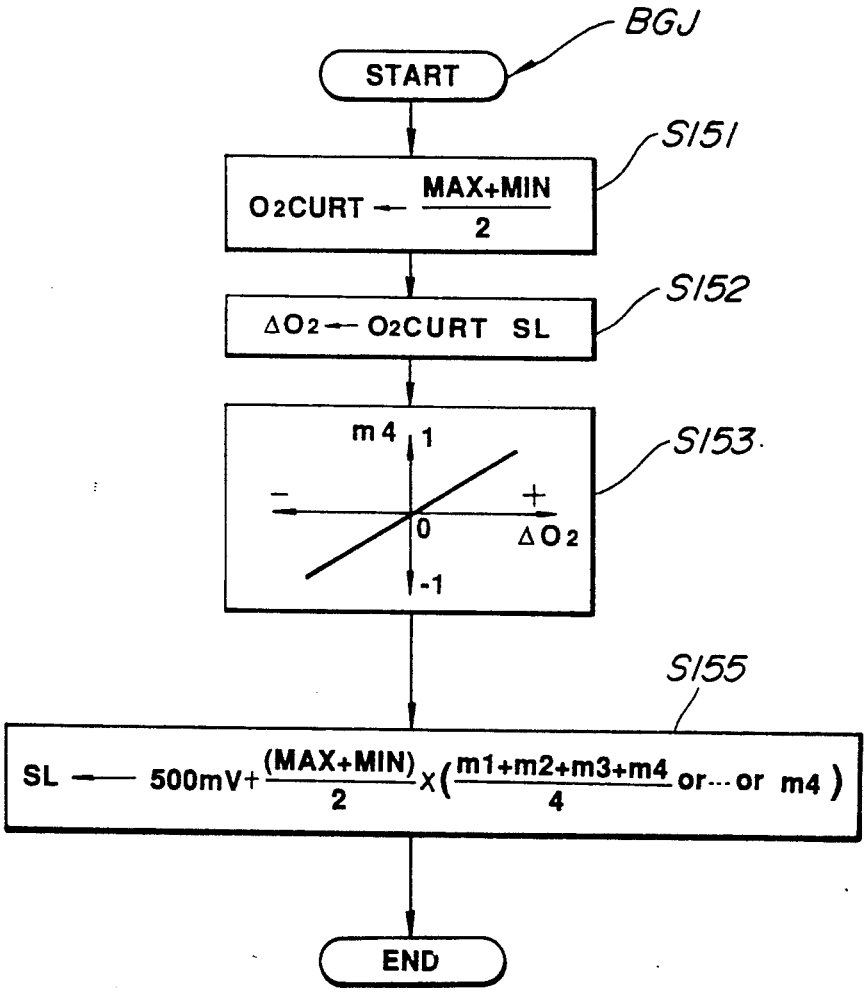
Figure 12C:
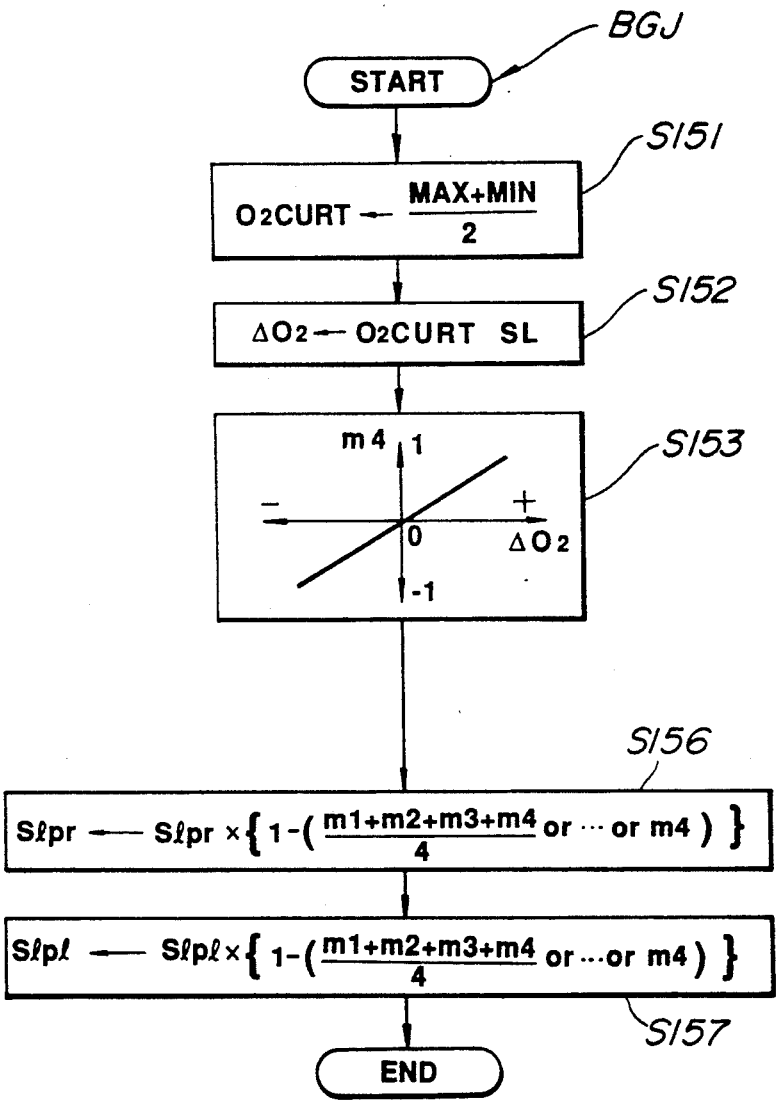

In the program of FIGS. 12*a*, 12*b* and 12*c*, first, at step 151, the mean value (the middle value in the output region) of the maximum and minimum values (the rich and lean detection signal values) of the output voltage of the oxygen sensor 14 is derived to be set as current value $O_2$CURT.

At step 152, a slice level which is set as the mean value of the maximum and minimum values of the output voltage of the oxygen sensor 14 when it is new and which corresponds to the stoichiometric value, is subtracted from the value of $O_2$CURT derived at step 151, and the obtained value is set as $\Delta O_2$ value. The $\Delta O_2$ indicates a deviation amount of the detection signal level of the oxygen sensor 14 from the initial value thereof. As the variation value is great, the absolute value thereof becomes great.

At step 153, the $\Delta O_2$ value derived at step 152 is converted into a membership characteristic value m4 which indicates a deviation amount of the detection signal, on the basis of a preset membership characteristic function. When $\Delta O_2$ is positive and the detection signal level of the oxygen sensor 14 deviates in a rich direction so that the air/fuel ratio tends to be controlled in a leaner direction than the initial set point, the membership characteristic value m4 is set to a positive value, and can be used similarly to the membership characteristic values m1, m2 and m3.

In this way, after the membership characteristic values m1 to m4 which respectively indicate variation amounts for deterioration of the oxygen sensor 14 are derived in accordance with the program of FIG. 10 and at step 153, the routine goes to step 154.

At step 154 (FIG. 12(*a*)), the correction coefficients hosL and hosR for correcting the lean and rich proportional components $P_L$ and $P_R$ which are used for performing the proportional control of the air/fuel ratio feedback correction coefficient LAMBDA, are set on the basis of the membership characteristic values m1, m2, m3 and m4, and the program ends.

As shown in FIG. 12(*a*). The correction coefficients hosR and hosL may be derived, for example, by adding the mean value of the membership characteristic values m1, m2, m3 and m4, the mean value of three membership characteristic values selected from among the four membership characteristic values, or by adding one of the membership characteristic values m1, m2, m3 and m4, to the reference value 1, and by subtracting the latter from the reference value 1, respectively.

Figure 18:
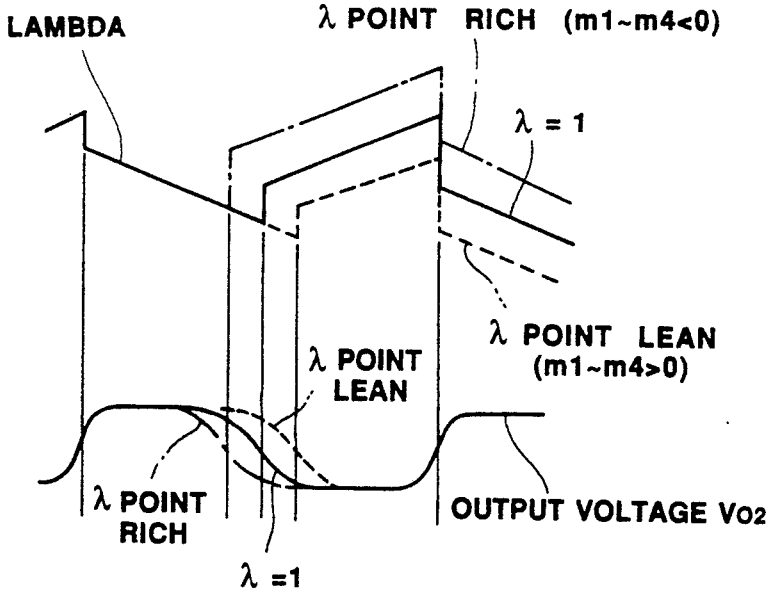
FIG. 18 is a time chart showing variations of the correction coefficient and the output voltage of the oxygen sensor relative to the membership characteristic values.
Figure 19A:
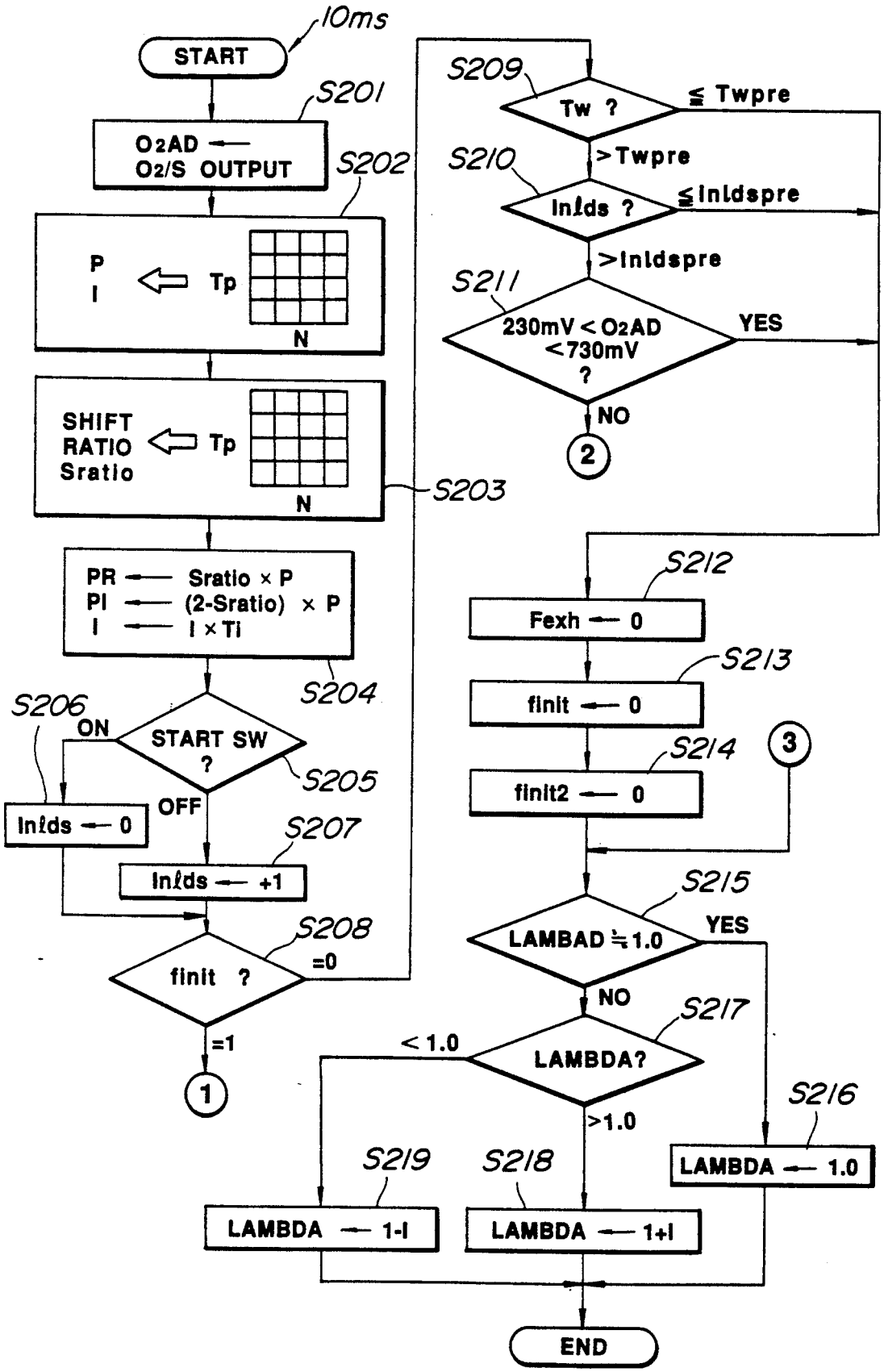
FIGS. 19(*a*) to (*e*) collectively show a flow chart of a program for detecting a proportional control timing by integrating output values of the oxygen sensor.
Figure 19B:
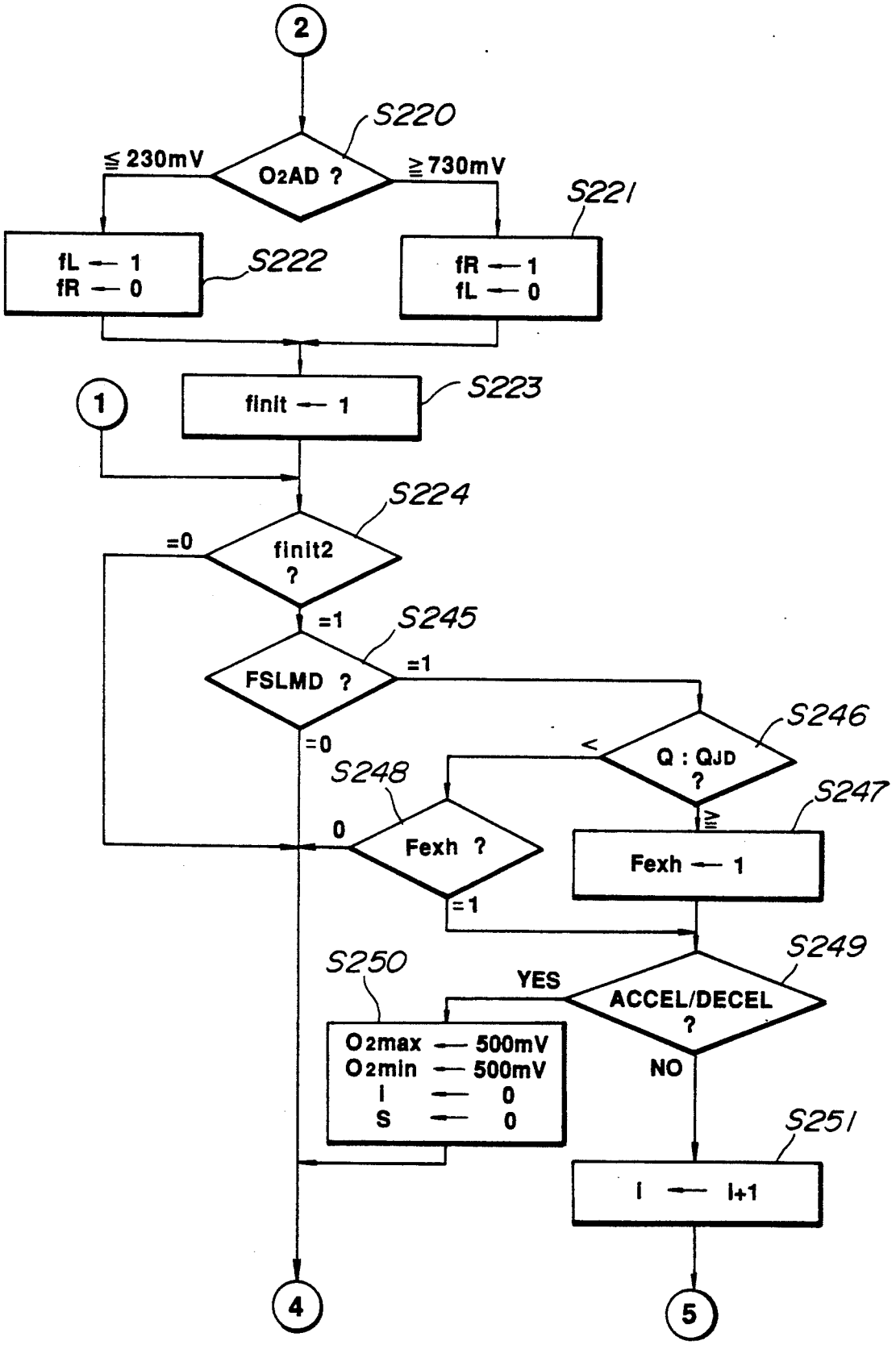
Figure 19C:
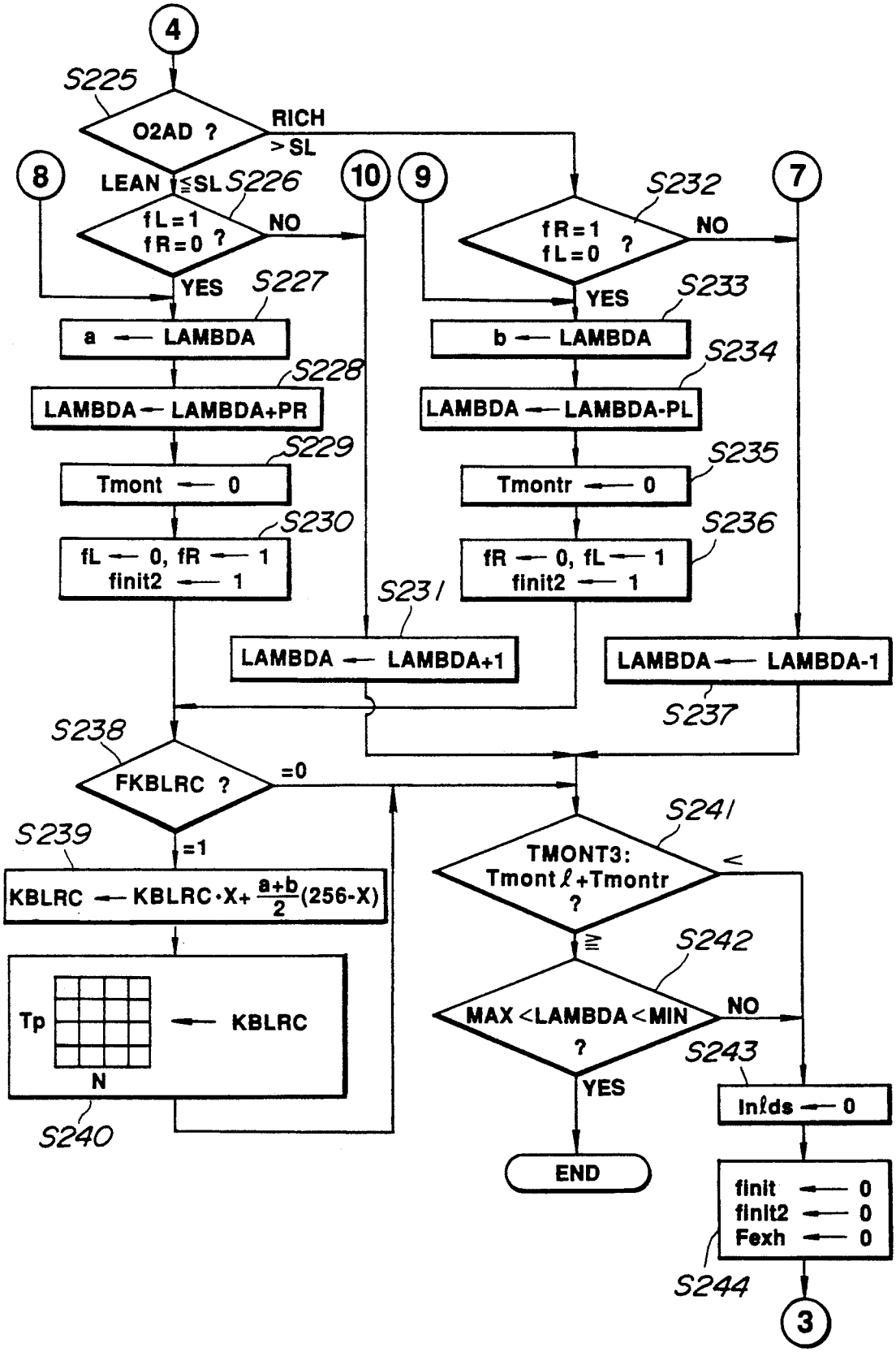
Figure 19D:
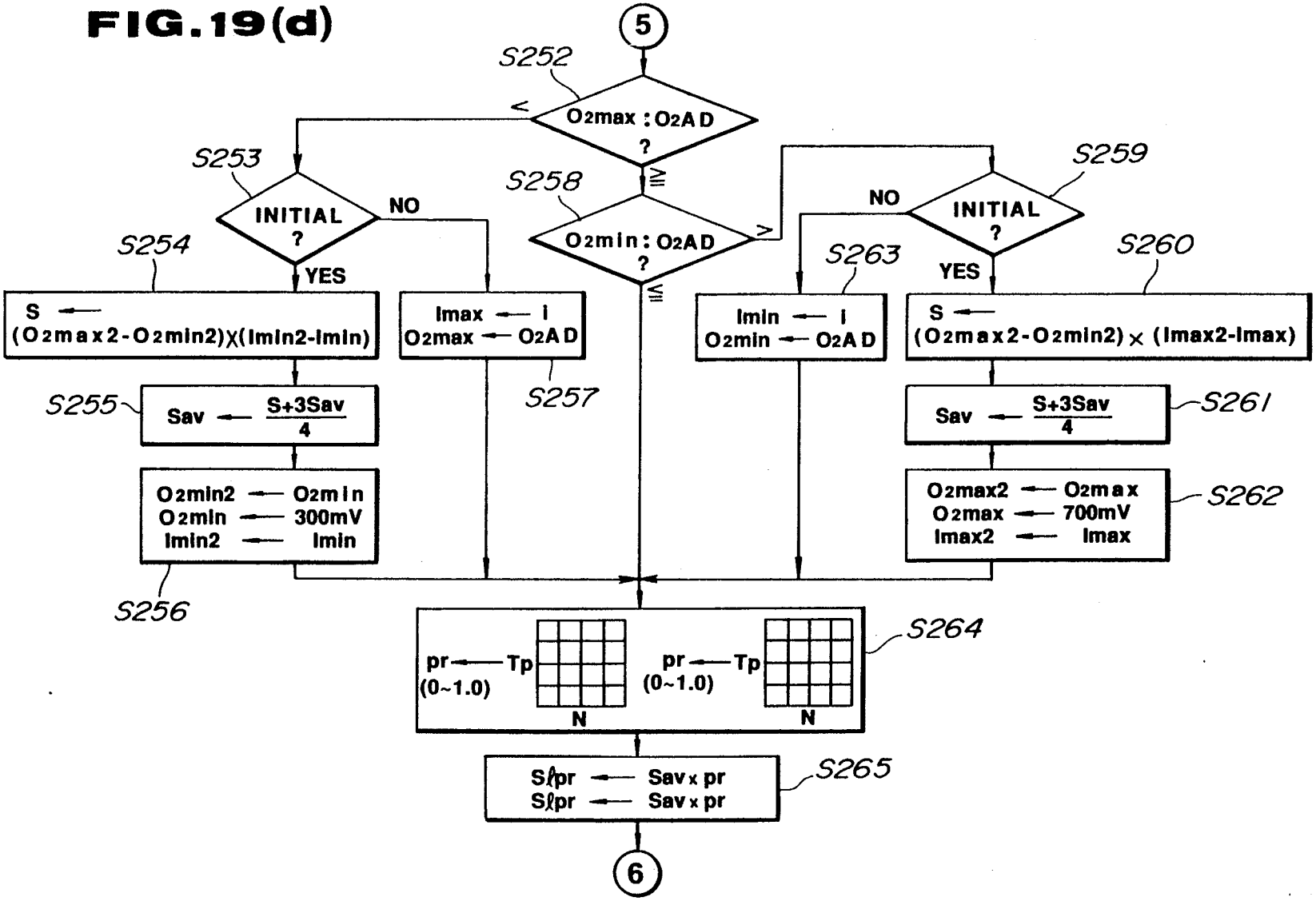
Figure 19E:
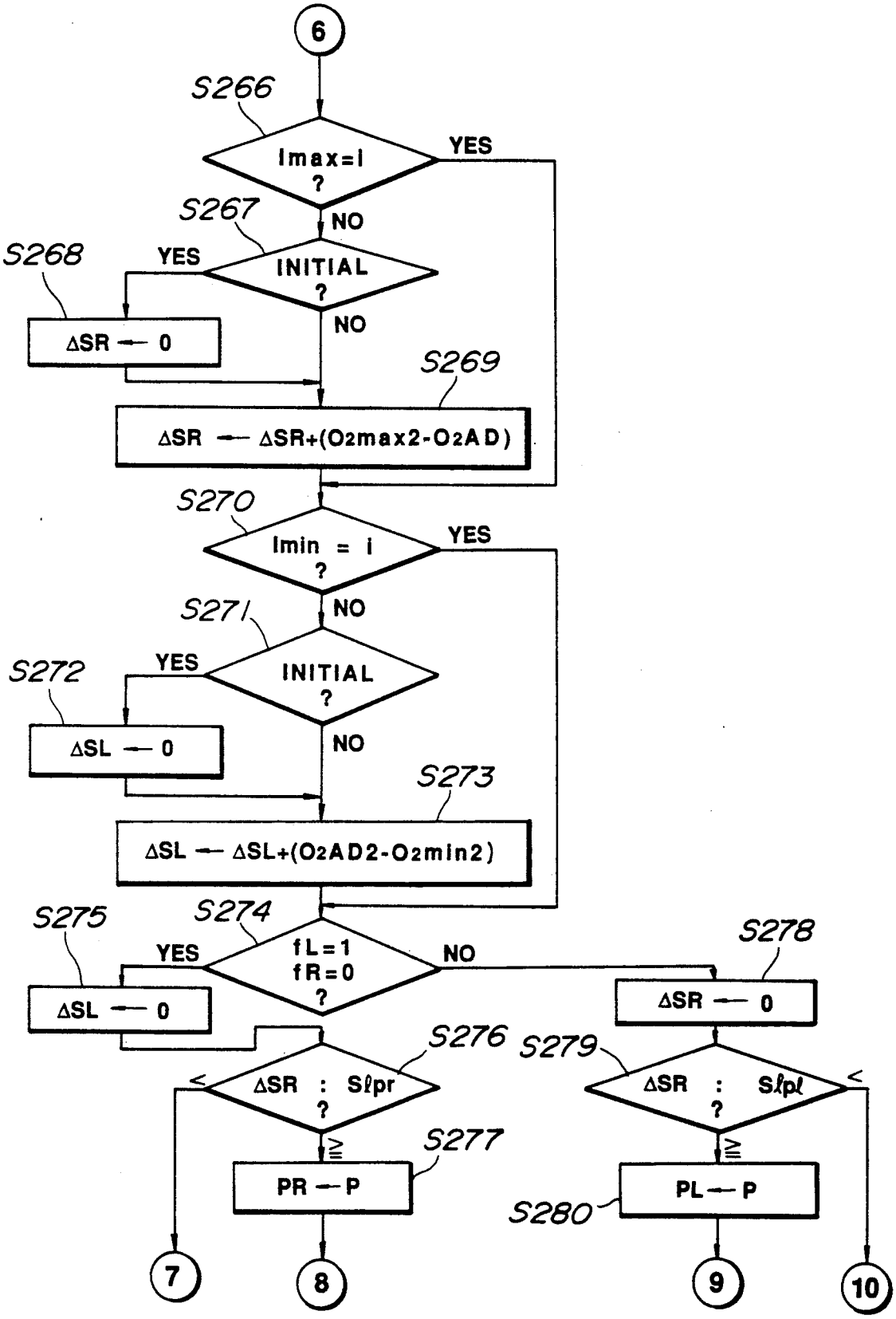

In a case where the membership characteristic values m1, m2, m3 and m4 are set to positive as shown by the dotted line of FIG. 18, the set point (the stoichiometric value) tends to deviate in a lean direction. Therefore, in this case, it is required that the correction amount for increasing the air/fuel ratio feedback correction coefficient LAMBDA (the rich control proportional component $P_R$) at the beginning of a lean detection is made to be relatively great, and that the the correction amount for decreasing the correction coefficient LAMBDA (lean control proportional component $P_L$) at the beginning of a rich detection is made to be relatively small.

Therefore, the correction coefficient hosL which is used for correcting the lean control proportional component $P_L$ when a rich detection begins to be performed, must be decreased as the tendency for the set point to deviate in a lean direction becomes great, and the correction coefficient hosR which is used for correcting the rich control proportional component $P_R$ when a lean detection begins to be performed must be increased as the tendency for the set point to deviate in a lean direction becomes great. For that reason, the correction coefficient hosL is set so as to decrease in accordance with increase of the membership characteristic values m1, m2, m3 and m4, by subtracting a predetermined value from the reference value 1. On the other hand, the correction coefficient hosR is set so as to be increased in accordance with increases of the membership characteristic values m1, m2, m3 and m4, by adding a predetermined value to the reference value 1.

The set correction coefficient hosL and hosR are multiplied by the proportional components $P_L$ and $P_R$ which are selected from the map on the basis of the basic fuel injection amount $T_P$ and the engine revolution speed N, to be used in the proportional control of the air/fuel ratio when rich or lean detection is initiated, as described in the case of the proportional-integral control for the air/fuel feedback control correction coefficient LAMBDA shown in the flow chart of the program collectively shown in FIGS. 7(*a*) to 7(*d*). In this way, the deviation of the set point for the feedback control, which is produced by the deviation of the response balance between the increase and decrease control due to deterioration of the oxygen sensor 14, is compensated by correcting the proportional components. In order to correct the proportional components, at least one parameter of the deviation amounts of; the output variation speed of the oxygen sensor (m1), the rich/lean control time (m2), the elapsed time until the air/fuel ratio begins to vary toward the stoichiometric value (m3), and the rich/lean detection signal level (m4) are utilized.

As mentioned above, the deviation of the response balance between the increase and decrease control due to deterioration of the oxygen sensor 14 is compensated by correcting ratio of the rich control proportional component $P_R$ to the lean control proportional component $P_L$.

Alternatively, as shown in FIG. 12*b*, the deviation of the response balance due to deterioration of the oxygen sensor 14 can be compensated by using the membership characteristic values m1, m2, m3 and m4 to correct the slice level SL used for determining rich or lean.

In the above case, with reference to FIG. 12*b*, after the membership characteristic value m4 is set at step 153, the slice level SL is set as the mean value of the maximum and minimum values of the output voltage of the oxygen sensor 14 when it is new and which corresponds to the stoichiometric value, and the routine goes to step 155. At step 155, a value of half of the difference between the maximum and minimum value of the output voltage of the oxygen sensor (MAX−MIN)/2 is multiplied by the membership characteristic values m1, m2, m3 and m4 (the mean value or any one of the membership characteristic values m1, m2, m3 and m4). In addition, by adding the obtained value to a predetermined value, e.g. 500 mV, corresponding to the initial slice level of the output voltage of a new oxygen sensor. the slice level SL is corrected.

In a case where the membership characteristic values m1, m2, m3 and m4 are positive so that the air/fuel ratio varies in a lean direction by the feedback control due to deterioration of the oxygen sensor 14, a lean detection region in which the lean detection is performed is made to be wider than a rich detection region in which the rich detection is performed by correcting the initial slice level so as to increase it. In this way, when the air/fuel ratio tends to vary in a lean direction by the feedback control due to deterioration of the oxygen sensor 14, the slice level SL is corrected to increase, so that the air/fuel ratio varies in a rich direction to approach the initial set point (the stoichiometric value) by the feedback control. In addition, when the output range of the oxygen sensor 14 becomes narrower than the initial output range thereof, if the slice level SL is corrected on the basis of the membership characteristic values m1, m2, m3 and m4 in a similar process to that of the initial output range, it is apprehended that the correction becomes excessive. Therefore, the slice level SL is corrected in accordance with the variation of the output range by the aforementioned value of half a difference between the maximum and minimum value of the output voltage of the oxygen sensor (MAX−MIN)/2, so that the correction amount of the slice level SL becomes small by using the same membership characteristic values m1, m2, m3 and m4 if the output range becomes narrow.

As mentioned above, by an increase and a decrease in the slice level SL in accordance with the direction and amount of deviation of the set point of the air/fuel ratio due to deterioration of the oxygen sensor 14, the deviation of the set point of the air/fuel ratio can be compensated so that the air/fuel ratio can be so controlled as to approach the initial set point (the stoichiometric value).

FIG. 12*c* shows steps 156 and 157 in which two values Slpr and Slpl, respectively representing parameters which define rich and lean control start timing, are respectively set by multiplying Slpr and Slpl which are set in accordance with the program collectively shown by FIGS. 19(*a*) to 19(*e*). Correction coefficients are derived by using the membership characteristic values m1, m2, m3 and m4 to decrease the value of the reference value 1 in the case of step 156 and increase the reference value 1, in the case of step 157. When the membership characteristic values m1 to m4 are positive, Slpr is corrected to decrease and Slpl is corrected to increase, and when the membership characteristic values m1 to m4 are negative, Slpr is corrected to increase and Slpl is corrected to decrease. The above processing as described for FIGS. 12(*a*) and 12(*b*) are used in connection with the previously described program of FIGS. 7(*a*) to 7(*d*), since the steps 156 and 157 of FIG. 12(*c*) are used in connection with the program of FIG. 19, they will be more fully described hereinlater.

As previously described, if the oxygen sensor 14 shows any one of various patterns of deterioration, an air/fuel ratio feedback control system, according to the present invention, can perform self-diagnosis of oxygen sensor deterioration on the basis of the variation characteristics of the oxygen sensor 14 for the respective deterioration patterns. Therefore, it accurately diagnoses deterioration of the oxygen sensor 14. In addition, since the system indicates the diagnosis results to a vehicle driver to inform the driver of the need for maintenance of the oxygen sensor, the engine 1 can be prevented from operating in a condition in which the air/fuel ratio deviates from the stoichiometric value at an early stage, preventing a drop in the quality of exhaust emissions. The air/fuel ratio feedback control system according to the present invention modifies the air/fuel ratio feedback correction coefficient LAMBDA on the basis of the aforementioned diagnosis results so that the air/fuel ratio can be controlled to approach the initial stoichiometric value, even if the oxygen sensor 14 shows some deterioration as shown previously in accordance with the programs of FIGS. 10, and 12.

In the previously described step 154 of FIGS. 12(*a*), 12(*b*), and 12(*c*), the correction coefficients hosL and hosR are set on the basis of the membership characteristic values m1, m2, m3 and m4 corresponding to various deterioration patterns of the oxygen sensor 14. Alternatively, according to the program shown in FIG. 13, the correction coefficients hosL and hosR can be set on the basis of only variations of the maximum and minimum levels of the detection signal (the rich/lean detection signal level) of the oxygen sensor 14, so that the proportional components can be corrected.

Figure 13:
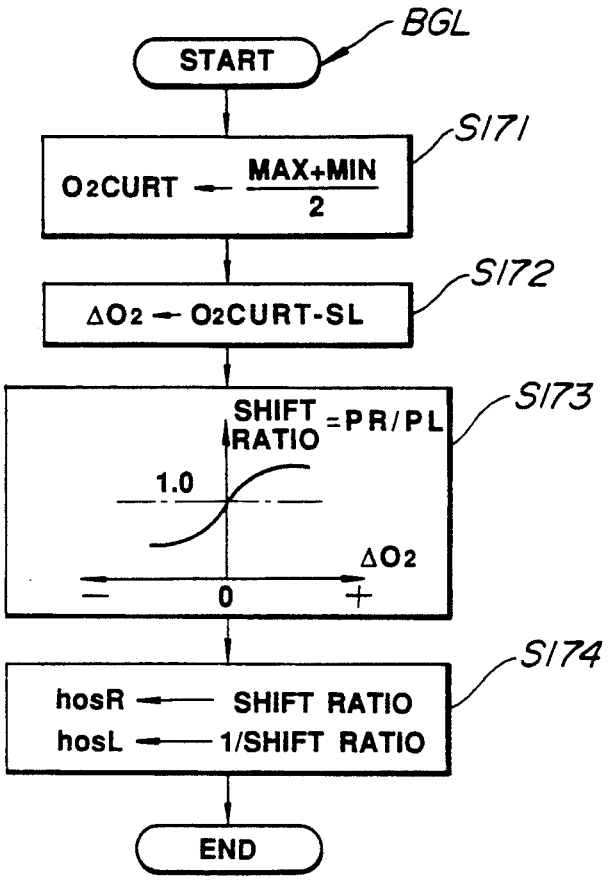
FIG. 13 is a flow chart of a program for setting correction coefficients hosL and hosR on the basis of variations of the maximum and minimum levels of a detection signal (a rich/lean detection signal level) of the oxygen sensor, for correcting the proportional components of the correction coefficient LAMBDA.

In the flow chart of the program of FIG. 13, at steps 171 and 172, which steps would be entered under the same conditions as those for entering step 151 of FIGS. 12, the deviation $\Delta O_2$ of the middle value in the output range of the oxygen sensor 14 is derived in a process similar to that of steps 151 and 152.

At step 173, on the basis of the value $\Delta O_2$ derived at step 172, a ratio ($=P_R/P_L$) of the rich control proportional component $P_R$ to the lean control proportional component $P_L$, which will be hereinafter referred to as a "shift ratio", is selected from a map in which a relationship between the shift ratio and $\Delta O_2$ is preset. When $\Delta O_2$ is positive, the shift ratio is set to a value greater than 1.0, and when $\Delta O_2$ is negative, the shift ratio is set to a value less than 1.0.

At step 174, the correction coefficient hosR is set to the shift ratio derived at step 173, and the correction coefficient hosL is set to a number reciprocal to the shift ratio. When $\Delta O_2$ is positive, since the air/fuel ratio deviates from the set point in a lean direction by the feedback control, it is required that the tendency for the air/fuel ratio to deviate in a lean direction is modified by increasing the rich control proportional component $P_L$. Therefore, when $\Delta O_2$ has a positive value, the correction coefficient hosR is made to be greater than the correction coefficient hosL by setting the shift ratio to be a value greater than 1.0, which causes the rich control proportional component $P_R$ to increase and the lean control proportional component $P_L$ to decrease. On the other hand, when $\Delta O_2$ has a negative value, since the air/fuel ratio deviates from the set point in a rich direction by the feedback control, the correction coefficient hosL is made to be greater than the correction coefficient hosR by setting the shift ratio to be a value less than 1.0. As a result, the lean control proportional component $P_L$ is corrected to be increased, and the rich control proportional component $P_R$ is corrected to be decreased, so that the air/fuel ratio which deviates in a rich direction is corrected to approach the initial set point (the stoichiometric value).

Figure 14:
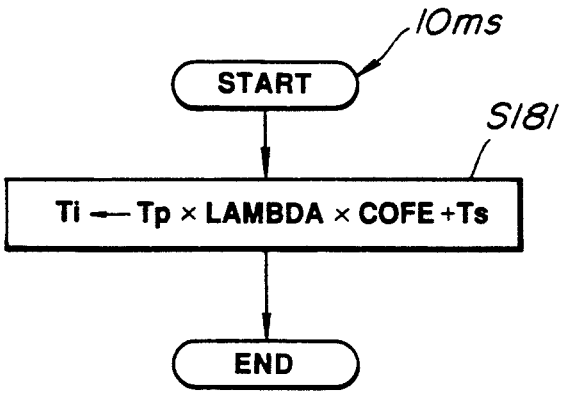
FIG. 14 is a flow chart of a program for deriving a fuel injection amount Ti by using the air/fuel ratio feedback correction coefficient LAMBDA set through a proportional-integral control in accordance with the program collectively shown in FIGS. 7(*a*) to 7(*d*)

The air/fuel ratio feedback correction coefficient LAMBDA which is set by the proportional-integral control in accordance with the program collectively shown by FIGS. 7(*a*) to 7(*d*), is used for deriving the fuel injection amount Ti in accordance with the program shown in FIG. 14.

The program shown in FIG. 14 is executed every 10 ms. At step 181, the fuel injection amount Ti is derived in accordance with, for example, the following formula.

$$Ti \leftarrow Tp \times LAMBDA \times COEF + Ts$$

in which COEF is a combined correction coefficient derived on the basis of various types of running states, such as an engine coolant temperature Tw detected by the engine coolant temperature sensor, and Ts is a correction value for compensating for variation of the effective open period of the fuel injection valve 10 due to voltage variation of a battery which is a power source for the fuel injection valve 10.

The finally set fuel injection amount Ti is set in a Ti register in an output unit of the microcomputer. The newest fuel injection amount Ti is read out at a predetermined timing in relation to the engine revolution cycle, to maintain a valve actuator of the fuel injection valve 10 in a valve open position for a period corresponding to the fuel injection amount Ti. In this way, the fuel injection valve 10 is controlled to perform intermittent fuel injection.

Figure 15:
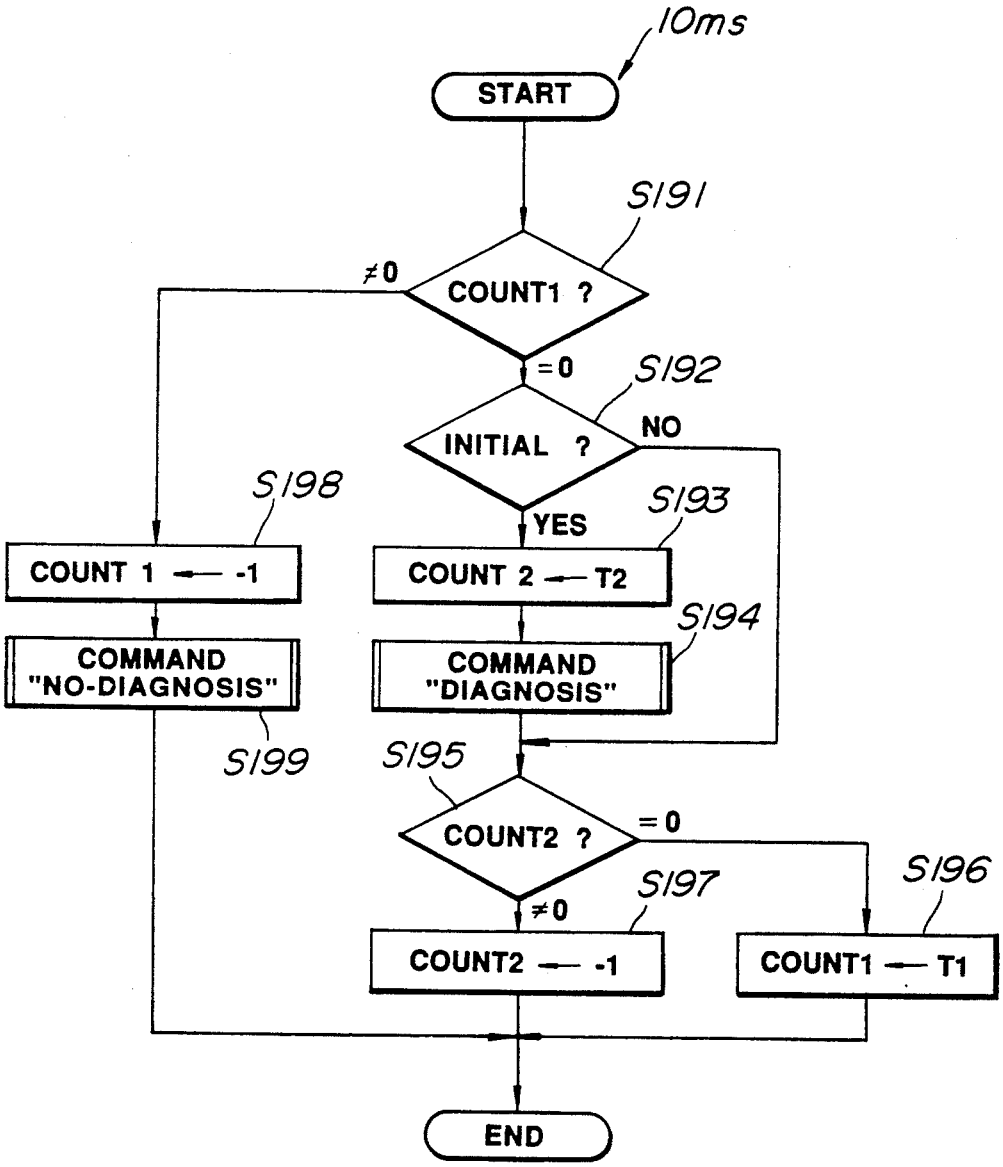
FIG. 15 is a flow chart of a program for producing a command D for diagnosing deterioration of an oxygen sensor, which command is used in the program collectively shown in FIGS. 7(*a*) to 7(*d*)
Figure 16:
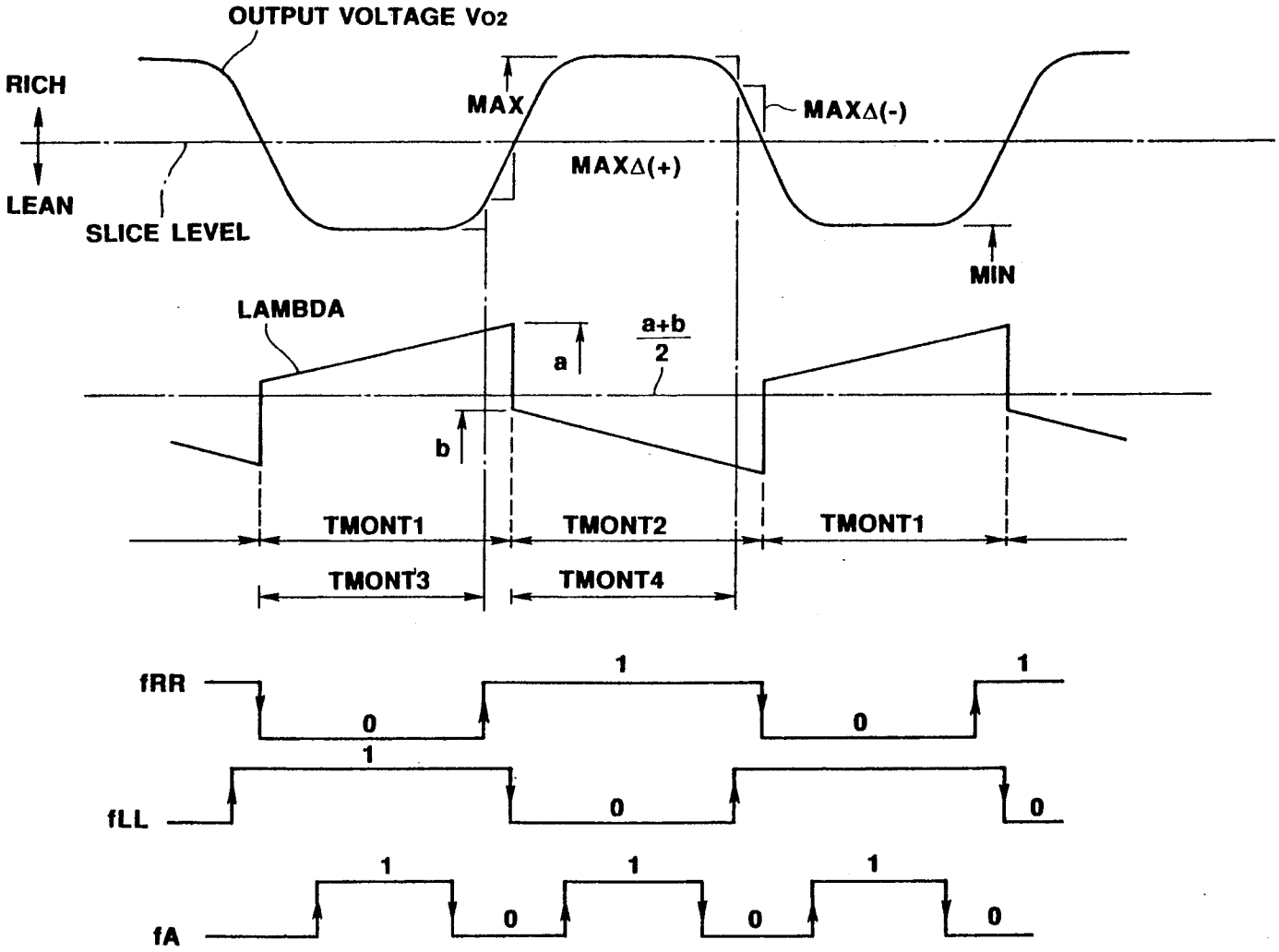
FIG. 16 is a time chart showing relationships between output voltage $VO_2$ of the oxygen sensor, the correction coefficient LAMBDA, and the values of the flags fRR, fLL and fA.

The commands for diagnosing deterioration of the oxygen sensor 14, which are read in the program collectively shown by FIGS. 7(*a*) to 7(*d*), are given in accordance with the program of FIG. 15.

The program of FIG. 15 is successively executed at very short time intervals, i.e. every 10 ms from a time when the ignition is switched on. First, at step 191, it is determined whether or not a first count COUNT1 is zero. As will be described hereinafter, the first count COUNT1 is used for measuring a command period for diagnosing deterioration of the oxygen sensor 14.

When the first count COUNT1 is zero, the routine goes to step 192 in which it is determined whether or not the determination of zero is the first one. When it is determined that the first count COUNT1 is zero, a second count COUNT2 for measuring a command period for deterioration diagnosis is set to a predetermined value T2 at step 193, and then, the command D for diagnosing deterioration of the oxygen sensor 14 is given at step 194.

After the command D for deterioration diagnosis is given at step 194, or if, at step 192, it is determined that the determination of zero is not the first one, the routine goes to step 195 in which it is determined whether or not the second count COUNT2 is zero. When the second count COUNT2 is zero, the first count COUNT1 is set to a predetermined value T1 at step 196, and when it is not zero, the second count COUNT2 is decreased by 1 at step 197.

When the first count COUNT1 is set to the predetermined value T1 at step 196, it is determined that the first count COUNT1 will not be zero at step 191 during the next cycle of the program. Therefore, the routine goes from step 191 to step 198 during the next cycle, additionally, if COUNT1 is not 0 in the present program cycle, the program will also go to step 198. At step 198, the first count COUNT1 is decreased by 1, and at the next step 199, a no-diagnosis command for the oxygen sensor 14 is maintained until the first count COUNT1 becomes zero.

That is, a command D for deterioration diagnosis of the oxygen sensor is given after the second count COUNT2 is set to the predetermined value T2 and is maintained as it is decreased by 1 at every execution of the program until T2=0, thereafter, a no-diagnosis command is maintained until the first count COUNT1 is decreased from the predetermined value T1 by 1 at every execution of this program to become zero (T1=0).

According to the aforementioned embodiment of the present invention, the proportional control is performed at a timing when the air/fuel mixture varies from lean to rich or from rich to lean, which timing is determined by comparing the output voltage of the oxygen sensor 14 with the slice level SL thereof. Alternatively, the proportional control may be performed at a timing when an integrated value of deviations of instantaneous values of the output voltage of the oxygen sensor 14 from the maximum and minimum values thereof becomes a predetermined value, so that the air/fuel ratio feedback control can be performed in an initial period if the output voltage of the oxygen sensor 14 exceeds the slice level SL.

In a case where such a proportional-integral control of the correction coefficient LAMBDA is performed, similarly to the aforementioned embodiment, deterioration of the oxygen sensor 14 can be also diagnosed on the basis of the output variation speed, the elapsed period until the air/fuel ratio begins to vary toward the stoichiometric value after it varies from rich to lean or from lean to rich across the stoichiometric value, the rich/lean control time and the detection signal level, and the deviation of the set point due to deterioration of the oxygen sensor 14 can be compensated on the basis of the diagnosis thereof.

Such a type of feedback control which uses a process for detecting a proportional control timing by integrating output values of the oxygen sensor 14, is collectively shown by FIGS. 19(*a*) to 19(*e*).

The program collectively shown by FIGS. 19(*a*) to 19(*e*) is executed every 10 ms. In this program, the air/fuel ratio feedback correction coefficient LAMBDA used for causing the actual air/fuel ratio to approach the set point (the stoichiometric value), is set in accordance with the proportional-integral control.

First, at step 201, analog-to-digital conversion of the detection signal (voltage) output from the oxygen sensor 14 in accordance with the oxygen concentration in the exhaust gas is performed, and a value $O_2AD$ is set for the converted value.

At step 202, a proportional constant P and an integral constant I corresponding to the current running state of the engine 1 are selected from a map which stores therein optimal values for the proportional constant P and the integral constant I for performing proportional-integral control of the air/fuel ratio feedback correction coefficient LAMBDA under all running conditions, classified by two parameters, i.e. the fuel injection amount $$Tp \leftarrow K \times Q/N, \text{ (K:constant)},$$

which is derived on the basis of the intake air flow rate Q detected by an air flow meter 9 and the engine revolution speed N calculated on the basis of the detection signal output from the crank angle sensor 15, and the engine revolution speed N.

At step 203, a shift ratio $S_{ratio}$ is selected from a map which uses the fuel injection amount Tp and the engine revolution speed N as parameters. The shift ratio $S_{ratio}$ is used for varying the value of the proportional constant P between the value when the rich control is performed and the value when the lean control is performed, so as to vary the set point of the air/fuel ratio controlled by the proportional-integral control.

At step 204, a rich control proportional constant $P_R$ ($S_{ratio} \times P$) and a lean control proportional constant $P_L$ $\{(2-S_{ratio}) \times P\}$ are derived using the proportional constant P derived at step 202 and the shift ratio $S_{ratio}$ selected at step 203, the integral constant I actually used is set by multiplying the integral constant I derived at step 202 by the fuel injection amount T1. For example, if the shift ratio $S_{ratio}$ is 1,2, the rich control proportional constant $P_R$ becomes 1.2 and the lean control proportional constant $P_L$ becomes 0.8. Therefore, the feedback control is performed to set a point of the air/fuel ratio which is arranged on a rich side relative to the boundary between the rich and lean detections performed by the oxygen sensor, since a common integral constant I is used.

At step 205, it is determined whether the start switch (not shown) is ON or OFF. When the start switch is ON, i.e. when cranking is performed, the routine goes to step 206 in which a counter Inlds for measuring an elapsed time after the start switch becomes OFF is set to zero. When the start switch is OFF, the routine goes to step 207 in which the counter Inlds is increased by 1.

Then, the routine goes from step 206 or 207 to step 208 in which the value of a flag $f_{init}$ for indicating if an initializing process has been performed is determined. When no initializing processing is performed, i.e. when the flag $f_{init}$ is set to zero, the routine goes to step 209.

At step 209, it is determined whether or not the engine coolant temperature Tw detected by the engine coolant temperature sensor 12 exceeds a predetermined temperature Twpre. When it is determined that the engine coolant temperature Tw exceeds the predetermined temperature Twpre, the routine goes to step 210 in which it is determined whether or not the counter value Inlds becomes greater than a predetermined value Inldspre. When a period of time longer than a predetermined time elapses after the start switch becomes OFF so that the counter value Inlds becomes greater than the predetermined value Inldspre, the routine goes to step 211.

At step 211, it is determined whether or not the output $O_2AD$ of the oxygen sensor 14, derived by analog-to-digital conversion at step 201, is within a predetermined intermediate range, e.g. 230 mV$<O_2AD<$730 mV when the minimum and maximum values are 0V and 1V, respectively. This process is performed in order to determine if the oxygen sensor 14 is in an active or nonactive state. Since the detection signal of the oxygen sensor 14 is within the intermediate range in the nonactive state, when it is determined that the output $O_2AD$ is not within the predetermined intermediate range at step 211, it is determined that the oxygen sensor 14 is active.

When it is determined that the oxygen sensor 14 is active, three requirements are satisfied, i.e. engine coolant temperature Tw is higher than a predetermined temperature, an elapsed time is longer than a predetermined time after the start switch becomes OFF and the oxygen sensor 14 is active, so that the air/fuel ratio feedback control can be performed. However, if at least one of the aforementioned three requirements is not satisfied, air/fuel ratio feedback control cannot be performed. In this case, the routine goes to step 212 and and the initializing process and clamping processing of the air/fuel ratio feedback correction coefficient LAMBDA are performed.

At step 212, a flag Fexh for indicating if the engine 1 has operated at a high exhaust-temperature is set to zero, which indicates that the engine 1 has not operated in the high exhaust-temperature region yet. At step 213, the flag $f_{init}$ is set to zero, which indicates that the initializing processing has not been performed yet. In addition, at step 214, a flag $f_{init2}$ for indicating if the proportional control is performed after the initializing processing is performed, is set to zero, which indicates that the proportional control has not been performed.

At step 215, it is determined whether or not the last air/fuel ratio feedback correction coefficient LAMBDA (the initial value=1.0) is substantially 1.0. When it is substantially 1.0, the routine goes to step 216 in which the air/fuel ratio feedback correction coefficient LAMBDA is set to 1.0 which is the initial value.

On the other hand, when it is determined that the air/fuel ratio feedback correction coefficient LAMBDA is not substantially 1.0 at step 215, the routine goes to step 217 in which it is determined whether or not the correction coefficient LAMBDA is greater than or less than 1.0. When the correction coefficient LAMBDA is greater than 1.0, the routine goes to step 218 in which the correction coefficient LAMBDA is set to 1+I (I is the integral constant derived at step 204). When the correction coefficient LAMBDA is less than 1.0, the routine goes to step 219 in which the correction coefficient LAMBDA is set to 1−I. Therefore, when the air/fuel ratio feedback control is not performed, the air/fuel ratio feedback correction coefficient LAMBDA is clamped at any one of 1.0, 1+I or 1−I.

In addition, when it is determined that the oxygen sensor 14 is active at step 211, since the feedback control can be performed on the basis of the detection results of the oxygen sensor 14, the routine goes to step 220 in which it is determined if the output value $O_2AD$ of the oxygen sensor 14 is greater than the maximum value (730 mV) or less than the minimum value (230 mV), i.e. which direction the air/fuel ratio deviates in a rich or lean direction relative to the stoichiometric value.

When the output value $O_2AD$ is greater than the maximum value (730 mV), i.e. when the air/fuel ratio deviates in a rich direction, the routine goes to step 221 in which the rich flag fR is set to 1 and the lean flag fL is set to zero. On the other hand, when the output value $O_2AD$ is less than the minimum value (230 mV), i.e. when the air/fuel ratio deviates in a lean direction, the routine goes to step 222 in which the lean flag fL is set to 1 and the rich flag fR is set to zero.

At the next step 223, the flag $f_{init}$ is set to 1 so that it can be determined that the initializing processing is finished.

When the flag $f_{init}$ is set to 1, the routine goes from step 208 or 223 to step 224. At step 224, the value of the flag $f_{initz}$ for indicating if the proportional control has been performed after the initializing processing was performed, is determined. When the flag $f_{init2}$ is zero so that the proportional control has not performed, i.e. when the air/fuel ratio has not varied across the set point thereof (the stoichiometric value) yet, the routine goes to step 225 and after, so that, by comparing the output value $O_2$ AD of the oxygen sensor 14 with a predetermined slice level SL thereof, the air/fuel ratio feedback correction coefficient LAMBDA is set in accordance with the usual proportional-integral control which is performed by detecting that the actual air/fuel ratio varies across the set point (the stoichiometric value).

At step 225, the output value $O_2AD$ of the oxygen sensor oxygen sensor 14 is compared with the slice level corresponding to the set point (the stoichiometric value) of the air/fuel ratio, so that it is determined if the actual air/fuel ratio detected by the oxygen sensor 14 is held rich or lean relative to the set point of the air/fuel ratio.

When the output value $O_2AD$ of the oxygen sensor 14 is less than or equal to the slice level SL, i.e. when the air/fuel ratio is held lean relative to the set point thereof, the routine goes to step 226 in which it is determined if the flag fL is 1 and the flag fR is zero.

The are two cases when it may be determined that fL=1 and fR=0, one of which is when the flags are set at step 222 when the program is executed in the current cycle, and the other of which is when it was determined that the air/fuel ratio is held rich at step 225 on or before the last cycle of the program. In this case, the routine goes to step 227 in which the current correction coefficient LAMBDA is set to the minimum value a. At next step 228, the current correction coefficient is increased by adding the rich control proportional constant $P_R$ set at step 204 thereto, so that the lean condition of the air/fuel mixture is adjusted by reversing the control direction to the rich direction.

At step 229, a timer Tmontlean for measuring a lean time in which the air/fuel ratio is held lean relative to the set point (the stoichiometric value), is set to zero, so that the lean time starts to be measured. At step 230, the lean flag fL is set to zero, the rich flag fR is set to 1, and the flag $f_{init2}$ is set to 1 which indicates that the proportional control has been performed.

On the other hand, when it is not determined that fL=1 and fR=0 at step 226, i.e. when fL=0, fR=1, and the air/fuel ratio remains lean, the routine goes to step 231. At step 231, the correction coefficient LAMBDA is set to be increased by adding the integral constant I derived at step 204 to the current correction coefficient LAMBDA, so that the tendency for the air/fuel ratio to be held lean can be gradually overcome.

In addition, when it is determined that the output value $O_2AD$ of the oxygen sensor 14 is greater than the slice level SL at step 225, i.e. when the air/fuel ratio is held rich relative to the set point (the stoichiometric value), the routine goes from step 225 to step 232 in which it is determined if fL=0 and fR=1.

When fL=0 and fR=1, the current correction coefficient LAMBDA is set to the maximum value b at step 233. Then, at step 234, the correction coefficient LAMBDA is decreased by subtracting the lean control proportional constant $P_L$ derived at step 204 from the current correction coefficient LAMBDA, so that the air/fuel ratio which is held rich approaches the set point (the stoichiometric value) by decreasing the fuel injection amount. In addition, at step 235, a timer Tmontrich for measuring a rich time in which the air/fuel ratio is held rich relative to the set point (the stoichiometric value), is set to zero, so that the rich time starts to be measured. At step 236, the rich flag fR is set to zero, the lean flag fL is set to 1, and the flag $f_{init2}$ is set to 1 since the proportional control has been performed.

On the other hand, when it is not determined that fR=1 and fL=0 at step 232, i.e. when fL=1, fR=0, and the air/fuel ratio remains rich, the routine goes to step 237. At step 237, the correction coefficient LAMBDA is set to decreased by subtracting the integral constant I derived at step 204 from the current correction coefficient LAMBDA, so that the tendency for the air/fuel ratio to be held rich can be gradually adjusted.

In a case where the correction coefficient LAMBDA is set in accordance with the proportional control as mentioned above after the output value $O_2AD$ is compared with the slice level SL, the routine goes to step 238 in which the value of a learning flag $F_{KBLRC}$ is determined. The learning flag $F_{KBLRC}$ is set to 1 when the air/fuel ratio feedback correction coefficient LAMBDA repeatedly varies between rich and lean at a stable period in a steady running state other than, for example, an acceleration state.

When it is determined that the learning flag $F_{KBLRC}$ is set to 1, learning is permitted. In this case, the routine goes to step 239 in which a learning correction coefficient KBLRC for correcting the basic fuel injection amount Tp is derived in accordance with the following formula.

$$KBLRC \leftarrow KBLRC \times X + (a+b)/2 \times (256 - X)$$

in which (a+b)/2 is the mean value of the newest maximum and minimum values of the air/fuel ratio correction coefficient LAMBDA. That is, the learning correction coefficient KBLRC is set to a weighted mean of the last learning correction coefficient KBLRC derived on the basis of the last running condition, and the mean value of the newest maximum and minimum values of the air/fuel ratio correction coefficient LAMBDA. The learning correction coefficient KBLRC is used for correcting variation of the air/fuel ratio under all running conditions to cause the air/fuel ratio to substantially approach the set point without the correction coefficient LAMBDA.

At step 240, the current learning correction coefficient newly derived at step 239 is used as renewal data for the learning correction coefficient KBLRC which is classified by using the basic fuel injection amount Tp and the engine revolution speed N as parameters, to rewrite the data of the corresponding running condition. Therefore, the learning correction coefficient KBLRC derived at step 239 is a value which is selected from the map of learning correction coefficients KBLRC shown at step 240, on the basis of the current basic fuel injection amount Tp and the current engine revolution speed N.

The learning correction coefficient KBLRC stored in the map is read out when the fuel injection amount Ti is calculated. The basic fuel injection amount Tp is multiplied by the learning correction coefficient KBLRC and the air/fuel ratio feedback correction coefficient LAMBDA to derive the fuel injection amount Ti.

When it is determined that the learning correction coefficient KBLRC is zero at step 238 so that the renewal calculation is not performed, and when the learning correction coefficient KBLRC is 1 so that the integral control of the correction coefficient LAMBDA is performed after the learning correction coefficient KBLRC is derived and the map data is rewritten, the routine goes from step 238 or 240 to step 241 in which it is determined whether or not the total time of Tmontlean and Tmontrich, corresponding to the lean and rich times during the feedback control, is shorter than a predetermined time TMONT3.

When one period of the rich/lean control is longer than the predetermined time TMONT3, it is presumed that the responsiveness of the air/fuel ratio feedback control is extremely reduced on the ground that the reaction rate of the oxygen sensor 14 is low and so forth. In this case, the counter Inlds for measuring an elapsed time after the start switch becomes OFF is set to zero at step 243, the flags $f_{init}$, $f_{init2}$ and $F_{exh}$ are set to zero at step 244, and the routine goes to step 215 so that the fuel control is performed by using the air/fuel feedback correction coefficient LAMBDA as a constant.

In addition, even if it is determined that the period of the rich/lean control is shorter than the predetermined time TMONT3, when it is determined that the correction coefficient LAMBDA is not within a predetermined range, the routine goes to steps 243 and 244 so that the fuel control is performed by using the air/fuel feedback correction coefficient LAMBDA as a constant.

As mentioned above, the value of the flag $f_{init2}$ for indicating if the proportional control has been performed after the initializing processing is performed, is determined. At this step, when it is determined the flag $f_{init2}$ is 1, the routine goes to step 245 in which a flag FSLMD for indicating whether or not the proportional-integral control is performed on the basis of the integrated value of deviations of the output values $O_2AD$ of the oxygen sensor 14 from the maximum and minimum values thereof.

Furthermore, the aforementioned integrated value is treated as the same value as an area surrounded by the maximum and minimum levels and the instantaneous value curve when a time chart of the output value $O_2AD$ is made.

When the flag FSLMD is 1, in place of determining the proportional control timing, i.e. the timing when the proportional control is performed (the timing from the rich control to the lean control and vice versa, or the timing of the correction control for increasing the fuel injection amount, to the timing of the correction control for decreasing the fuel injection amount and vice versa) as mentioned above, a proportional control timing is determined on the basis of an integrated value obtained by integrating deviations of the instantaneous values of the output $O_2AD$ of the oxygen sensor 14 from the maximum and minimum values thereof, i.e. on the basis of an area surrounded by the maximum and minimum levels and the instantaneous value curve when a graph is made by using time as the abscissa axis and the output value $O_2AD$ as the ordinate axis.

Furthermore, the flag FSLMD is used for optionally switching between the usual proportional control performed on the basis of the slice level and the aforementioned proportional control performed on the basis of the integrated value. When the aforementioned proportional control on the basis of the integrated value is performed, the flag FSLMD is set to 1.

When it is determined that the flag FSLMD is 1 at step 245, the routine goes to step 246 in which the intake air flow rate Q detected by the air flow meter 9 is compared with a threshold value $Q_{JD}$ of the intake air flow rate Q for determining a predetermined high exhaust-temperature region. When it is determined that the detected value Q is greater than or equal to the threshold value $Q_{JD}$, the routine goes to step 247 in which the flag $F_{exh}$ for indicating that the engine 1 has operated in the predetermined high exhaust-temperature region is set to 1. When it is determined that the detected value Q is less than the threshold value $Q_{JD}$, the routine goes to step 248 in which the value of the flag $F_{exh}$ is determined. When the flag $F_{exh}$ is set to 1 which indicates that the engine 1 has operated in the high exhaust-temperature region, the routine goes to step 249, and when the flag $F_{exh}$ is set to zero which indicates that the engine 1 has not yet operated in the high exhaust-temperature region, the routine goes to step 225 in which the output $O_2AD$ of the oxygen sensor 14 is compared with the slice level SL corresponding to the set point (the stoichiometric value) of the air/fuel ratio for performing proportional control.

When the engine 1 has operated in the high exhaust-temperature region, at step 249, it is determined whether of not the current engine running state is an acceleration or deceleration state on the basis of, for example, variation of opening angle of the throttle valve 7 and the engine revolution speed N. It is preferable that the steady running state is determined when a predetermined time elapses after acceleration or deceleration is terminated.

When the engine running state is an acceleration or deceleration state, the air/fuel ratio is unstable. In this case, if the aforementioned proportional control on the basis of the integrated value is performed in place of the proportional control on the basis of the inversion between rich and lean values of the actual air/fuel ratio, the proportional control can not be performed at a required timing since the inversion period of the air/fuel ration varies in a normal condition, so that the air/fuel ratio control performance is decreased. Therefore, when it is determined that the current engine running state is an acceleration or deceleration state, various parameters used for the proportional control on the basis of the integrated value are reset at step 250, and thereafter, the routine goes to step 225 in which the usual proportional control on the basis of the comparison with the slice level SL is performed so that the air/fuel ratio feedback control can be performed if the engine is in a transient running state. Furthermore, since the usual feedback control of the slice level SL is performed if the transient running state is detected, a timing for performing the proportional control, which will be described hereinafter, is not renewed when the engine is in a transient running state.

The parameters reset at step 250 include the maximum and minimum values $O_2$max and $O_2$min of the output $O_2$AD of the oxygen sensor 14, a sampling counted number i and an area S (the area surrounded by the maximum or minimum period for determining the timing for performing the proportional control). At step 250, the maximum and minimum values $O_2$max and $O_2$min are set to 500 mV corresponding to the middle value of the output of the oxygen sensor 14, and the sampling counted number i and the area S are set to zero.

On the other hand, when it is determined that the current engine running state is neither an acceleration nor deceleration state at step 249, the sampling counted number i is increased by 1 at step 251, and thereafter, the routine goes to step 252.

At step 252, if the output $O_2$AD of the oxygen sensor 14 near the middle value (the middle value 500 mV+200 mV) tends to increase, the maximum value $O_2$max with which the newest sampled value is sequentially renewed, is compared with the newest sampled value $O_2$AD.

As will be described hereinafter, the maximum value $O_2$max is set to 700 mV when the output $O_2$AD shows a tendency to decrease across the middle value (the middle value 500 mV−200 mV). At step 252, only when the output $O_2$AD becomes greater than 700 mV, it is determined whether or not the newest sampled value $O_2$AD is greater than the maximum value $O_2$max.

When it is determined that the newest sampled value $O_2$AD is greater than the maximum value $O_2$max at step 252, the routine goes to step 253 in which it is determined whether or not the current determination is the first one. When it is the first, i.e. when the newest sampled value $O_2$AD becomes greater than 700 mV for the first time, the routine goes to step 254.

Figure 21:
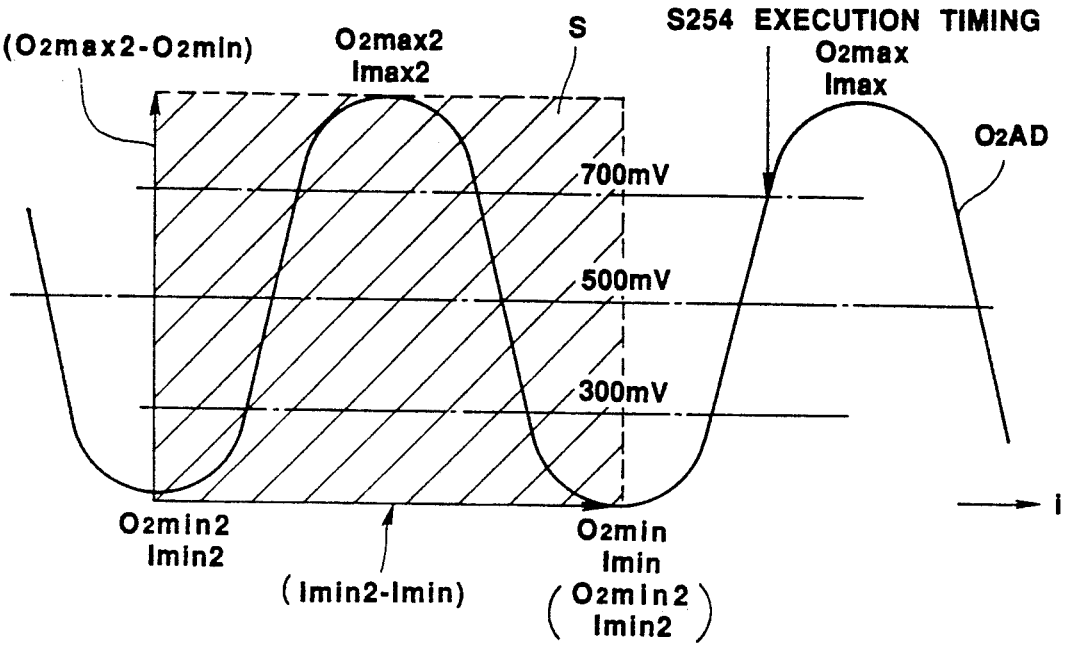
FIG. 21 is a time chart of the air/fuel ratio, which shows the area S and a timing for executing step 254 of the program collectively shown in FIGS. 19(*a*) to 19(*e*)

At step 254, as seen in FIG. 21 which describes variation of the output $O_2$AD by using time as the abscissa axis and the output $O_2$AD as the ordinate axis, the area S on the basis of variation of the output $O_2$AD in one cycle thereof, which is the shaded area (oblique line portion) of FIG. 21 and corresponds to a value obtained by integrating deviations of the output $O_2$AD from the maximum and minimum values $O_2$max and $O_2$min over a period between Imin2 and Imin, is derived by multiplying a difference between a time Imin when the output $O_2$AD becomes the last minimum value $O_2$min and a time Imin2 when the output $O_2$AD becomes the minimum value $O_2$min2 before the last minimum value $O_2$min (the period between the minimum values of the output $O_2$AD), by a deviation of the maximum value $O_2$max2 of the output $O_2$AD from the minimum value $O_2$min2 thereof.

The Imin is set to i when the output $O_2$AD becomes the minimum value at last. Therefore, if a difference between the Imin and Imin2 which is set to i when the output $O_2$AD becomes the minimum value before the last, one period between the adjoining minimum values can be derived.

Next at step 255, a weighted mean value of the area S in one period derived in the current cycle and the weighted mean value Sav derived in the previous cycle, are used to derive the newest weighted mean value Sav. As will be described hereinafter, the weighted mean area Sav is used for determining an area corresponding to the timing for performing the proportional control. By using the weighted mean value, it is possible to prevent the timing for performing the proportional control from varying due to small, or insignificant, variation of the area S.

At step 256, the minimum value $O_2$min2 before the the last minimum value $O_2$min is set as a determined value to be the minimum value $O_2$min of the output $O_2$AD sampled at last, and the last minimum value $O_2$min is set to 300 mV (=500 mV−200 mV) for sampling the minimum value $O_2$min in the next cycle. In addition, Imin 2 is set to the last Imin value which is the counted sampling value i when the minimum value $O_2$min2 is derived. That is, when the output $O_2$AD becomes less than 300 mV. the minimum value $O_2$min and Imin are renewed while the output $O_2$AD has a tendency to decrease, and thereafter, when the output $O_2$AD increases to become greater than 700 mV, the minimum value $O_2$min2 and Imin2 are set to the newest $O_2$min and Imin, respectively.

On the other hand, when it is determined in the current determination that the newest sampled value $O_2$AD, greater than the maximum value $O_2$ max, is not the first one at step 253, the routine goes to step 257. At step 257, Imax is set to the current count value i. and $O_2$max is set to the newest $O_2$AD value, so that the maximum value $O_2$max of the output $O_2$AD and the time Imax corresponding to the maximum value $O_2$max can be sampled.

In addition, when it is determined that the newest sampled value $O_2$AD is not greater than the maximum value $O_2$max at step 252, the routine goes to step 258 in which it is determined whether or not the newest sampled value $O_2$AD is less than the minimum value $O_2$min. Since the minimum value $O_2$min is set to 300 mV at step 256, when the output $O_2$AD becomes less than 300 mV, it is determined that the newest sampled value $O_2$ is less than the minimum value $O_2$min, and the routine goes to step 259. On the other hand, when 300 mV≦$O_2$AD≦500 mV, sampling of the maximum and minimum values and determination of the sampling time are not performed.

At step 259, it is determined whether or not the current determination is the first one. When it is the first, i.e. when the newest sampled value $O_2$AD is less than 300 mV for the first time, the routine goes to step 260 in which the area S in one period is derived in a similar process to that of step 254. In the case of step 260, the area S is derived on the basis of a period (Imax2−Imax) between the adjoining maximum values of the output $O_2$AD. At next step 262, the maximum value $O_2$max2 is set to the last maximum value $O_2$max, derived at step 257, the maximum value $O_2$max is set to 700 mV for sampling the next maximum value $O_2$max, and the last value Imax2 is set to Imax.

When it is determined in the current determination that the newest sampled value $O_2$AD, less than the minimum value $O_2$min, is not the first, at step 259, the routine goes to step 263. At step 263, the current count i is set in Imin, and the output $O_2$AD is set to $O_2$min, so that the minimum value of the output $O_2$AD and the sampling timing can be determined.

When the area S on the basis of the output $O_2$AD in one period (the value obtained by integrating a deviation of the maximum value from minimum value over a period) is derived in accordance with the aforementioned processes, the routine goes to step 264. At step 264, a ratio pr of a rich control portion of the area S to a lean control portion thereof, and a ratio pl of the lean control portion of the area S to the rich control portion thereof are respectively selected from maps in which the area ratio pr and pl are set at every running state which is classified by the basic fuel injection amount Tp and the engine revolution speed N, respectively. At next step 265, an area Slpr used for performing the rich proportional control and an area Slpl used for performing the lean proportional control are determined by multiplying the weighted mean value Sav of the area S by the area ratios pr and pl, respectively. That is, the timing, when the area S derived in one cycle between the adjoining maximum values or between the adjoining minimum values becomes a predetermined area, is the timing of the correction control for increasing the fuel injection amount to the time of the correction control for decreasing the fuel injection amount and vice versa.

Next at step 266, it is determined whether or not Imax=i. When the process was performed at step 257, Imax is i. In this case, the routine bypasses steps 267 to 269 to goes from step 266 to 270. When Imax is not i, the routine goes to step 267.

Figure 20:
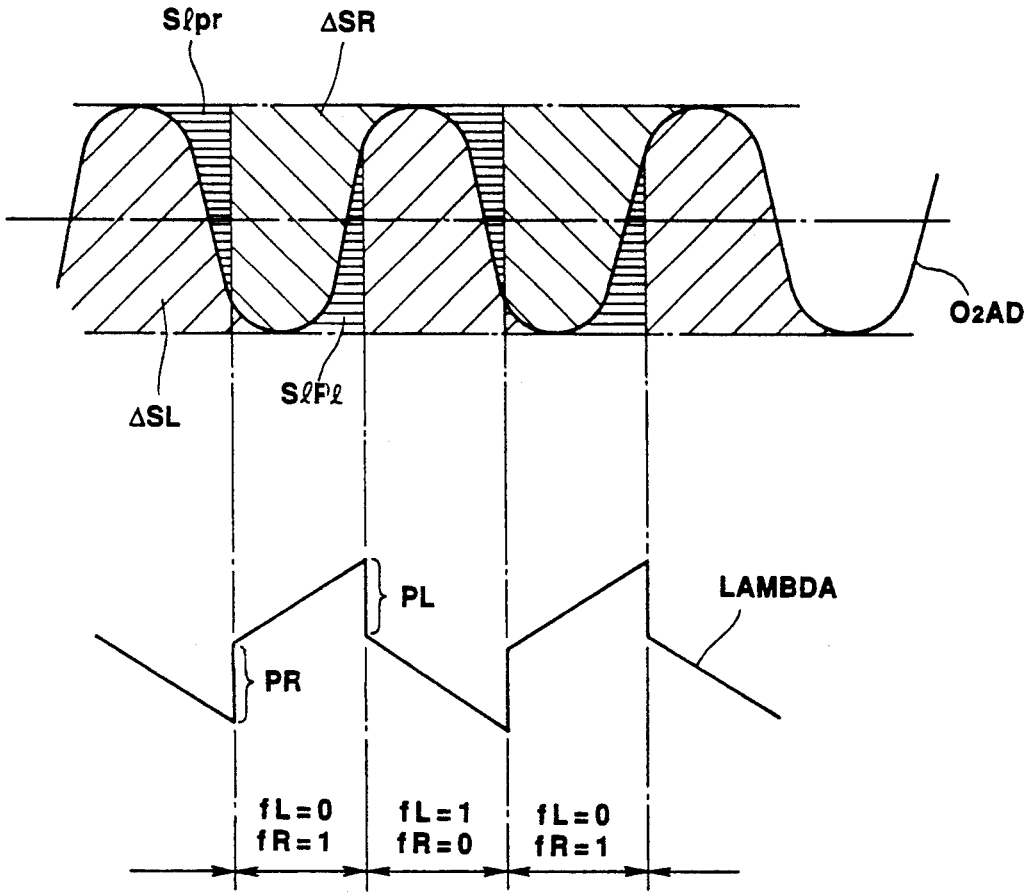
FIG. 20 is a time chart of the air/fuel ratio and the correction coefficient LAMBDA, which shows a relationship between the areas Slpr, Slpl, ΔSR and ΔSL.

At step 267, it is confirmed whether or not it is determined that Imax is not i. When the output $O_2$AD passes over the maximum value to start to decrease, the routine goes to step 268 in which a rich control area ΔSR (see FIG. 20) is set to zero, and thereafter, the routine goes to step 269. When the determination is not the first one, the routine bypasses step 268 to directly goes to step 269.

At step 269, the rich control area ΔSR corresponding to the integrated value of ($O_2$max2−$O_2$AD) when Imax does not equal i, is derived by adding a value which is obtained by subtracting the newest sampled value (the instantaneous value) $O_2$AD from the maximum value $O_2$AD, to the last rich control area ΔSR.

Similarly, at steps 270 through 273, the lean control area ΔSL corresponding to the integrated value of ($O_2$AD−$O_2$min) when Imin does not equal i, is derived.

Then, at step 274, it is determined whether or not the lean flag fL is 1 and the rich flag fR is zero. As mentioned above, when the lean control for causing the air/fuel ratio to vary from rich to lean is performed, the lean flag fL is 1 and the rich flag fR is 0.

When fL=1 and fR=1, i.e. while the lean control for causing the fuel injection amount to decrease is performed, the routine goes to step 275 in which the lean control area ΔSL which is unnecessary for performing the lean proportional control is set to zero, and thereafter, the routine goes to step 276.

At step 276, the rich control area ΔSR derived by integrating ($O_2$max2−$O_2$AD) after when Imax does not equal i, is compared with the area Slpr used for performing the rich proportional control. Before the rich control area ΔSR becomes greater than or equal to the area Slpr, the routine goes from step 276 to step 237 so that the lean integral control continues to be performed. When the rich control area ΔSR becomes greater than or equal to the area Slpr. the routine goes to step 277.

At step 277, the proportional constant P derived at step 202 is set to the rich proportional constant $P_R$, and then the routine goes from step 277 to step 227. As a result, when the rich control area ΔSR becomes greater than or equal to the area Slpr, the rich proportional control (the reversing control from the fuel injection amount decreasing control to the fuel injection amount increasing control) which is performed by adding the rich proportional constant $P_R$ to the last feedback correction coefficient LAMBDA, is performed. At this time, the lean flag fL is set to 1 and the rich flag fR is set to zero. Therefore, when the rich control (the increase fuel injection amount control) is performed, the routine goes from step 274 to step 276.

At step 278, the rich control area ΔSR which is unnecessary for performing the lean proportional control is set to zero, and then, at step 279, the lean control area ΔSL is compared with the area Slpl corresponding to the timing for performing the lean proportional control. Before the lean control area ΔSL becomes greater than or equal to the area Slpl, the routine goes to step 231, so that the rich control, i.e. the control for increasing the correction coefficient LAMBDA by the integral control, is performed. When the lean control area ΔSL becomes greater than or equal to the area Slpl, the routine goes to step 280 in which the lean control constant $P_L$ is set to the proportional constant P derived at step 202, and then, the routine goes to step 233 so that the lean proportional control is performed on the basis of the proportional constant $P_L$.

In this way, in place of the proportional control which is performed at a rich/lean reversal timing, i.e. a timing when the air/fuel ratio varies from rich to lean or from lean to rich, derived by comparing the output $O_2$AD with the slice level SL, the proportional control is performed at a timing when the integrated value (the area ΔSR) of a difference between the maximum value $O_2$max2 and the instantaneous value $O_2$AD becomes the predetermined value Slpr while the output $O_2$AD decreases, and at a timing when the integrated value (the area ΔSL) of a difference between the instantaneous value $O_2$AD and the minimum value $O_2$min2 becomes the predetermined value Slpl while the output $O_2$AD, and the predetermined values Slpr and Slpl corresponding to the proportional control timing are derived on the basis of the area S corresponding to one cycle of the output $O_2$AD.

The predetermined values Slpr and Slpl corresponding to the proportional control timing derived in the aforementioned processes, correspond to the initial state of the oxygen sensor 14 when it is new. When deterioration is produced in the oxygen sensor 14 to lose the balance between the rich and lean detections, the control point deviates due to deterioration of the oxygen sensor 14 if the proportional control is performed using the aforementioned Slpr and Slpl. Therefore, similar to the correction coefficients hosL and hosR used in the program collectively shown by FIGS. 7(*a*) to 7(*d*), if the aforementioned Slpr and Slpl are corrected on the basis of the membership characteristic values m1, m2, m3 and m4 which indicate the magnitude of deterioration of the oxygen sensor in accordance with the various deterioration patterns of the oxygen sensor 14 derived by the programs shown in FIGS. 7(*a*) to 7(*d*), 10 and 12*a* and *b*, the balance of the proportional control timing is necessarily lost, so that the deviation of the control point due to deterioration of the oxygen sensor 14 can be compensated.

Such controls for compensating the Slpr and Slpl are shown by steps 156 and 157 in FIG. 12*c*. These steps correspond to an integrated control value balance varying means. At steps 156 and 157, Slpr and Slpl are respectively corrected to be set by multiplying the Slpr and Slpl which are set in accordance with the program collectively shown by FIGS. 19(*a*) to 19(*e*), by the correction coefficients which are derived by using the membership characteristic values m1, m2, m3 and m4 to decrease and increase the reference value 1, respectively. When the membership characteristic values m1 to m4 are positive, the Slpr is corrected to decrease and the Slpl is corrected to increase, and when the membership characteristic values m1 to m4 are negative, the Slpr is corrected to increase and the Slpl is corrected to decrease.

For example, when the membership characteristic values m1 to m4 are positive and the set point of the air/fuel ratio deviates in a lean direction relative to the initial set point (the stoichiometric value), the timing when the correction coefficient LAMBDA is corrected to decrease by the lean control proportional component $P_L$, i.e. the timing when the rich detection is performed, is delayed by correcting the Slpr and Slpl to decrease and increase, respectively, so that the feedback set point which has a tendency for the air/fuel ratio to deviate in a lean direction, is corrected so as to return the initial set point (the stoichiometric value) of the air/fuel ratio. As a result, even if the oxygen sensor 14 deteriorates to lose the balance between rich and lean detections, the timing for performing the proportional control on the basis of the areas ΔSR and ΔSL can be corrected so that the air/fuel ratio can be controlled so as to approach the initial set point (the stoichiometric value) in accordance with the feedback control.

Furthermore, in the case of aforementioned proportional-integral control of the correction coefficient LAMBDA in which the timing for performing the proportional control is determine on the basis of the areas ΔSR and ΔSL, the deviation of the set point produced by deterioration of the oxygen sensor 14 can be also compensated by varying the ratio of the increased amount of the correction coefficient LAMBDA to the decreased amount thereof which are increased and decreased by the proportional control, similar to the proportional-integral control in which the proportional control is determined at a timing when the air/fuel mixture varies from rich to lean or from lean to rich.

When the oxygen sensor 14 deteriorates as mentioned above, the oxygen sensor 14 which outputs only positive voltage when now, often outputs negative voltage due to totally decreased level of the output voltage as shown in FIG. 3.

Generally, the output of the oxygen sensor 14 is converted from analog to digital by means of an A/D converter which can input only a positive output corresponding to the initial output state, to be read by a microcomputer. Therefore, if the oxygen sensor 14 outputs a negative voltage due to deterioration thereof as mentioned above, such an output can not be converted from analog to digital. As a result, in a case where the rich/lean detection is performed by using the middle value in the input signal range as the slice level, since the negative voltage can not be input, accuracy for setting the slice level is decreased so that expected rich/lean detection or diagnosis of level decrease of the lean detection signal can not often be performed.

Figure 22:
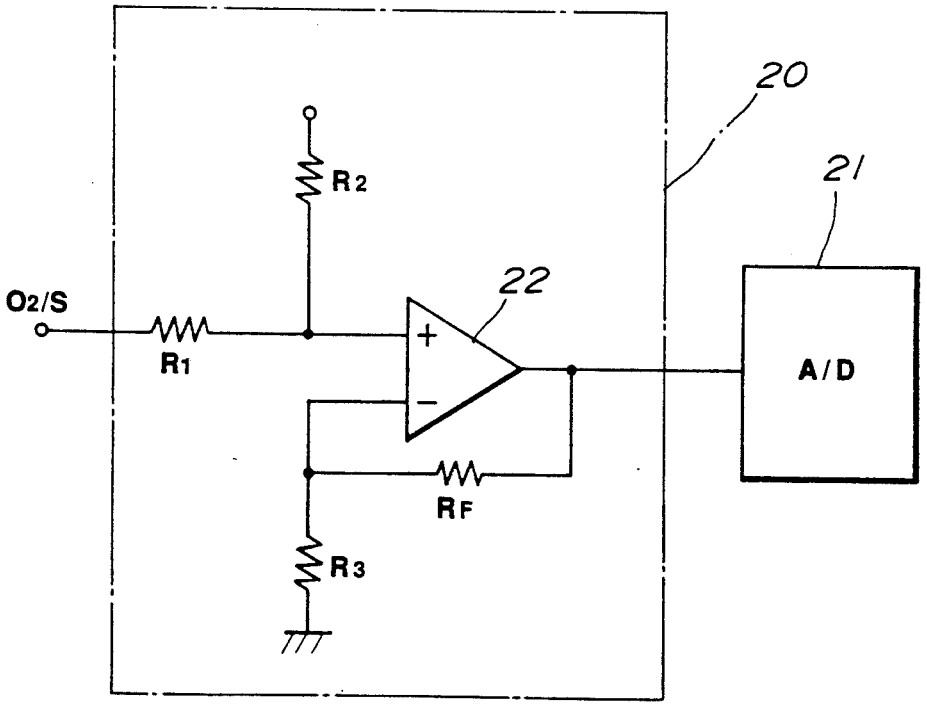
FIG. 22 is a block diagram of an analog adder circuit which can be applied to the preferred embodiment of an air/fuel ratio feedback control system, according to the present invention.

In order to eliminate the aforementioned disadvantage, in the aforementioned embodiment of an air/fuel ratio feedback control system, according to the present invention, it is preferable that an A/D converter 21 be used which can input only positive output voltage even if the oxygen sensor ($O_2$/S) 14 outputs negative voltage, as shown in FIG. 22.

That is, the output of the oxygen sensor 14 is input to an analog adder circuit 20, and a predetermined voltage is added to the sensor output by the analog adder circuit 20 so that the same polarity of voltage is output, thereby, even if a negative voltage is output, it is shifted to a positive voltage in accordance with the aforementioned voltage adding processing, so as to be able to be input to the A/D converter 21.

As is well known, the analog adder circuit 20 has an operational amplifier 22, the positive input terminal of which is connected to the output of the oxygen sensor ($O_2$/S) 14 via a resistor R1, and to a constant-voltage (e.g. 1 V) power source via a resistor R2, and the negative input terminal which is connected to ground via a resistor R3. In addition, the output terminal of the operational amplifier 22 is connected the negative input terminal via a resistor $R_F$.

With this construction, since the operational amplifier 22 outputs the total voltage which is input to the positive input terminal and which has the same polarity, if the absolute value of the positive voltage added by means of the constant-voltage power source is set to become greater than the absolute value of the negative voltage which can be output due to deterioration of the oxigen sensor 14, the detection voltage having a negative polarity is increased to be a positive voltage by means of the analog adder circuit 20 to be able to be input to the A/D converter 21. In this way, the maximum and minimum levels of the output voltage of the oxygen sensor 14 can be accurately detected to set the slice level, and, even if the oxygen sensor 14 outputs a negative voltage due to deterioration thereof, the expected rich/lean detection can be performed and a decreased level of the lean detection signal can be accurately detected.

In the embodiment of an air/fuel ratio feedback control system shown, according to the present invention, the basic fuel injection amount Tp is derived on the basis of the intake air flow rate Q detected by the air flow meter 9. However, an air/fuel ratio feedback control system, according to the present invention, can be applied to a fuel injection system which is provided with a pressure sensor for detecting an intake air pressure and in which the basic fuel injection amount Tp is set on the basis of the intake pressure PB, and to a fuel injection system in which the fuel injection amount Tp is derived on the basis of the opening area of an intake system and the engine revolution speed. In addition, the oxygen sensor 14 may be a sensor which is formed with a nitrogen oxide reducing catalyst layer as an outer layer, as disclosed in Japanese Patent First (unexamined) Publication (Tokkai Sho.) No 64-458.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An air/fuel ratio feedback control system for an internal combustion engine, said system comprising:

air/fuel ratio detecting means for monitoring an air/fuel ratio for an air/fuel mixture to be introduced into a combustion chamber of said engine to produce a detection signal representative of said air/fuel ratio, said detection signal having a detection level varying in accordance with said air/fuel ratio to a rich detection level when said air/fuel ratio is held richer than a set point of said air/fuel ratio, and to a lean detection level when said air/fuel ratio is held leaner than said set point;

correction value setting means for setting a correction value for causing said air/fuel ratio to approach said set point, said correction value including an increasing component used for causing said air/fuel ratio to become richer and a decreasing component used for causing said air/fuel ratio to become leaner;

fuel injection amount control means for controlling an amount of fuel to be introduced into said combustion chamber on the basis of said correction value;

signal level determining means for receiving said detection signal to determine magnitudes of said rich and lean detection levels to produce a rich detection level indicative signal and a lean detection level indicative signal; and correction value varying means for varying a ratio of an increasing component to a decreasing component of said correction value in accordance with said magnitudes of said rich and lean detection level indicative signals.

2. An air/fuel ratio feedback control system as set forth in claim 1, wherein said correction value setting means sets said correction value through proportional-integral control, and said increasing and decreasing components are used for proportional control.

3. An air/fuel ratio feedback control system as set forth in claim 1, wherein said air/fuel ratio detecting means outputs a voltage signal in accordance with said air/fuel ratio for said air/fuel mixture, and includes an adder circuit for adding a predetermined voltage to said voltage signal so as to always output a positive detection signal, said air/fuel ratio detecting means detecting a rich or lean condition in which said air/fuel mixture is held rich or lean on the basis of a converted value of said positive detection signal which is converted from an analog signal to a digital signal.

4. An air/fuel ratio feedback control system for an internal combustion engine, said system comprising:

air/fuel ratio detecting means for monitoring an air/fuel ratio for an air/fuel mixture to be introduced into a combustion chamber of said engine, to produce a detection signal representative of said air/fuel ratio, a detection level of said detection signal varying in accordance with said air/fuel ratio to a rich detection level when said air/fuel ratio is held richer than a set point of said air/fuel ratio, and to a lean detection level when said air/fuel ratio is held leaner than said set point;

correction value setting means for setting a correction value for causing said air/fuel ratio to approach said set point, said correction value including an increasing component used for causing said air/fuel ratio to be rich and a decreasing component used for causing said air/fuel ratio to be lean;

fuel injection amount control means for controlling an amount of fuel to be introduced into said combustion chamber on the basis of said correction value;

signal level varying speed measuring means for receiving said detection signal to determine a signal level increasing speed of said detection signal, which is an increase amount per unit time of said detection signal, and a signal level decreasing speed of said detection signal, which is a decrease amount per unit time of said detection signal, to produce a signal level increasing speed indicative signal and a signal level decreasing speed indicative signal;

increasing/decreasing time measuring means for receiving said detection signal to determine an increasing time, which is an elapsed time until said air/fuel ratio begins to approach said set point after said air/fuel ratio varies from lean to rich, and a decreasing time, which is an elapsed time until said air/fuel ratio begins to approach said set point after said air/fuel ratio varies from rich to lean, to produce an increasing time indicative signal and a decreasing time indicative signal;

rich/lean control time measuring means for receiving said detection signal to determine a rich control time, which is an elapsed time while said air/fuel ratio varies in a rich direction, and a lean control time, which is an elapsed time while said air/fuel ratio varies in a lean direction, to produce a rich control time indicative signal and a lean control time indicative signal;

rich/lean detection signal level determining means for receiving said detection signal to determine magnitudes of said rich and lean detection levels, to produce a rich detection level indicative signal and a lean detection level indicative signal; and balance correcting means for correcting a balance between said increasing and decreasing components of said correction value on the basis of at least one of, the relationships between said signal level increasing and decreasing speed indicative signals, between said increasing and decreasing time indicative signals, between said rich and lean control time indicative signals, and between said rich and lean detection level indicative signals.

5. An air/fuel ratio feedback control system as set forth in claim 4, wherein said balance correcting means includes slice level varying means for varying a slice level substantially corresponding to a middle value between said rich and lean detection levels for correcting said balance between increasing and decreasing components of said correction value.

6. An air/fuel ratio feedback control system as set forth in claim 4, wherein said balance correcting means includes component balance varying means for varying a ratio of increasing and decreasing components of said correction value to correct balance therebetween.

7. An air/fuel ratio feedback control system as set forth in claim 4, wherein said correction value setting means integrates deviations of said detection signal from maximum and minimum values thereof to reverse a varying direction of said correction value from increasing direction to decreasing direction when an integrated value of said deviations becomes a first predetermined value, and from decreasing direction to increasing direction when an integrated value becomes a second predetermined value, and wherein said balance correcting means includes means for varying a ratio of said first predetermined value to said second predetermined value for correcting said balance between increasing and decreasing components of said correction value.

8. An air/fuel ratio feedback control system as set forth in claim 4, wherein said air/fuel ratio detecting means outputs a voltage signal in accordance with said air/fuel ratio for said air/fuel mixture, and includes an adder circuit which adds a predetermined voltage to said voltage signal so as to always output a positive detection signal, said air/fuel ratio detecting means detecting a rich or lean condition in which said air/fuel mixture is held rich or lean on the basis of a converted value of said positive detection signal which is converted from an analog signal to a digital signal.

9. An air/fuel ratio feedback control system for an internal combustion engine, said system comprising:

air/fuel ratio detecting means for monitoring an air/fuel ratio for an air/fuel mixture to be introduced into a combustion chamber of said engine to produce a detection signal representative of said air/fuel ratio, a detection level of said detection signal varying in accordance with said air/fuel ratio to a rich detection level when said air/fuel ratio is held richer than a set point of said air/fuel ratio, and to a lean detection level when said air/fuel ratio is held leaner than said set point;

correction value setting means for setting a correction value for causing said air/fuel ratio to approach said set point, said correction value including an increasing component used for causing said air/fuel ratio to become richer and a decreasing component used for causing said air/fuel ratio to become leaner;

fuel injection amount control means for controlling an amount of fuel to be introduced into said combustion chamber on the basis of said correction value;

signal level varying speed measuring means for receiving said detection signal to determine a signal level increasing speed of said detection signal, which is an increase amount per unit time of said detection signal, and a signal level decreasing speed of said detection signal, which is an decrease amount per unit time of said detection signal, to produce a signal level increasing speed indicative signal and a signal level decreasing speed indicative signal; and balance correcting means for correcting a balance between said increasing and decreasing components of said correction value on the basis of a relationship between said signal level increasing and decreasing speed indicative signals.

10. An air/fuel ratio feedback control system for an internal combustion engine, said system comprising:

air/fuel ratio detecting means for monitoring an air/fuel ratio for an air/fuel mixture to be introduced into a combustion chamber of said engine to produce a detection signal representative of said air/fuel ratio, a detection level of said detection signal varying in accordance with said air/fuel ratio to a rich detection level when said air/fuel ratio is held richer than a set point of said air/fuel ratio, and to a lean detection level when said air/fuel ratio is held leaner than said set point;

correction value setting means for setting a correcting value for causing said air/fuel ratio to approach said set point, said correction value including an increasing component used for causing said air/fuel ratio to be rich and a decreasing component used for causing said air/fuel ratio to be lean;

fuel injection amount control means for controlling an amount of fuel to be introduced into said combustion chamber on the basis of said correction value;

increasing/decreasing time measuring means for receiving said detection signal to determine an increasing time, which is an elapsed time until said air/fuel ratio begins to approach said set point after said air/fuel ratio varies from lean to rich, and a decreasing time, which is an elapsed time until said air/fuel ratio begins to approach said set point after said air/fuel ratio varies from rich to lean, to produce an increasing time indicative signal and a decreasing time indicative signal; and balance correcting means for correcting a balance between said increasing and decreasing components of said correction value on the basis of a relationship between said increasing and decreasing time indicative signals.

11. An air/fuel ratio feedback control system for an internal combustion engine, said system comprising:

air/fuel ratio detecting means for monitoring an air/fuel ratio for an air/fuel mixture to be introduced into a combustion chamber of said engine to produce a detection signal representative of said air/fuel ratio, a detection level of said detection signal varying in accordance with said air/fuel ratio to a rich detection level when said air/fuel ratio is held richer than a set point of said air/fuel ratio, and to a lean detection level when said air/fuel ratio is held leaner than said set point;

correction value setting means for setting a correction value for causing said air/fuel ratio to approach said set point, said correction value including an increasing component used for causing said air/fuel ratio to be rich and a decreasing component used for causing said air/fuel ratio to be lean;

fuel injection amount control means for controlling an amount of fuel to be introduced into said combustion chamber on the basis of said correction value;

rich/lean control time measuring means for receiving said detection signal to determine a rich control time, which is an elapsed time while said air/fuel ratio varies in a rich direction, and a lean control time, which is an elapsed time while said air/fuel ratio varies in a lean direction, to produce a rich control time indicative signal and a lean control time indicative signal; and balance correcting means for correcting a balance between said increasing and decreasing components of said correction value on the basis of a relationship between said rich and lean control time indicative signals.

12. An air/fuel ratio feedback control system for an internal combustion engine, said system comprising:

air/fuel ratio detecting means for monitoring an air/fuel ratio for an air/fuel mixture to be introduced into a combustion chamber of said engine to produce a detection signal representative of said air/fuel ratio, a detection level of said detection signal varying in accordance with said air/fuel ratio to a rich detection level when said air/fuel ratio is held richer than a set point of said air/fuel ratio, and to a lean detection level when said air/fuel ratio is held leaner than said set point;

correction value setting means for setting a correction value for causing said air/fuel ratio to approach said set point, said correction value including an increasing component used for causing said air/fuel ratio to become richer and a decreasing component used for causing said air/fuel ratio to become leaner;

fuel injection amount control means for controlling an amount of fuel to be introduced into said combustion chamber on the basis of said correction value;

rich/lean detection signal level determining means for receiving said detection signal to determine magnitudes of said rich and lean detection levels to produce a rich detection level indicative signal and a lean detection level indicative signal; and balanced correcting means for correcting a balance between said increasing and decreasing component of said correction value on the basis of a relationship between said rich and lean detection level indicative signals.

* * * * *